US012656044B2

(12) United States Patent
Kim et al.

(10) Patent No.: US 12,656,044 B2
(45) Date of Patent: Jun. 16, 2026

(54) REFRIGERATOR HAVING GRILLE FAN ASSEMBLY

(71) Applicant: LG Electronics Inc., Seoul (KR)

(72) Inventors: Kihwang Kim, Seoul (KR); Sunghee Kang, Seoul (KR); Sangho Jung, Seoul (KR); Hojin Choi, Seoul (KR); Dong Hwi Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 17/797,651

(22) PCT Filed: Jan. 25, 2021

(86) PCT No.: PCT/KR2021/000982
§ 371 (c)(1),
(2) Date: Aug. 4, 2022

(87) PCT Pub. No.: WO2021/187746
PCT Pub. Date: Sep. 23, 2021

(65) Prior Publication Data

US 2023/0058849 A1 Feb. 23, 2023

(30) Foreign Application Priority Data

Mar. 17, 2020 (KR) ..... 10-2020-0032807

(51) Int. Cl.
*F25D 11/02* (2006.01)
*F25D 17/06* (2006.01)
(Continued)

(52) U.S. Cl.
CPC ..... *F25D 11/022* (2013.01); *F25D 17/065* (2013.01); *F25D 17/067* (2013.01);
(Continued)

(58) Field of Classification Search
None
See application file for complete search history.

(56) References Cited

U.S. PATENT DOCUMENTS

2008/0202149 A1* 8/2008 Lim ..... F25D 17/067 62/407
2008/0307823 A1* 12/2008 Lee ..... F25D 23/068 62/449
(Continued)

FOREIGN PATENT DOCUMENTS

CN 204359028 U 5/2015
CN 103256774 B 8/2015
(Continued)

OTHER PUBLICATIONS

Extended European Search Report in European Appln. No. 21772401.2, mailed on Feb. 20, 2024, 10 pages.
(Continued)

*Primary Examiner* — Jerry-Daryl Fletcher
*Assistant Examiner* — Daniel C Comings
(74) *Attorney, Agent, or Firm* — Fish & Richardson P.C.

(57) ABSTRACT

A refrigerator includes a refrigerating compartment, a freezing compartment, and an ice-making compartment. The refrigerating compartment is configured to receive cool air from a refrigerating compartment side grille fan assembly, and the ice-making compartment is configured to be located in any one refrigerating compartment door and to receive cool air from a freezing compartment side grille fan assembly with the freezing compartment. The refrigerating compartment side grille fan assembly is configured to supply a greater amount of cool air to a space at a refrigerating compartment door without the ice-making compartment than the amount of cool air supplied to other spaces, and the freezing compartment side grille fan assembly is configured to supply a greater amount of cool air to a space commu-
(Continued)

nicating with a recovery duct for the ice-making compartment than the amount of cool air supplied to other spaces.

16 Claims, 44 Drawing Sheets

(51) Int. Cl.
*F25D 17/08* (2006.01)
*F25D 21/14* (2006.01)

(52) U.S. Cl.
CPC ..... *F25D 17/08* (2013.01); *F25D 21/14* (2013.01); *F25D 2317/062* (2013.01); *F25D 2317/065* (2013.01); *F25D 2317/066* (2013.01); *F25D 2317/0666* (2013.01); *F25D 2317/067* (2013.01)

(56) References Cited

U.S. PATENT DOCUMENTS

2010/0064719 A1* 3/2010 Lee ..... F25D 17/065 62/419
2010/0313594 A1* 12/2010 Lee ..... F25D 17/062 62/340
2012/0096887 A1* 4/2012 Cho ..... F25D 21/08 62/276
2014/0216084 A1* 8/2014 Ren ..... F25D 11/04 62/186
2017/0241694 A1 8/2017 Ji et al.
2018/0283765 A1 10/2018 Yi et al.
2021/0262718 A1* 8/2021 Burlingham ..... F25D 17/065

FOREIGN PATENT DOCUMENTS

KR 20070072239 A * 7/2007 ..... F25D 17/08
KR 10-0839903 B1 6/2008
KR 20090046298 A * 5/2009 ..... F25D 17/067
KR 102013589 B1 * 8/2019 ..... F25D 17/08
WO WO-2019137375 A1 * 7/2019 ..... F25D 11/02

OTHER PUBLICATIONS

Office Action in Korean Appln. No. 10-2020-0032807, mailed on Apr. 8, 2025, 17 pages (with English translation).

* cited by examiner

REFRIGERATOR HAVING GRILLE FAN ASSEMBLY

CROSS-REFERENCE TO RELATED APPLICATIONS

This application is a National Stage application under 35 U.S.C. § 371 of International Application No. PCT/KR2021/000982, filed on Jan. 25, 2021, which claims the benefit of Korean Patent Application No. 10-2020-0032807, filed on Mar. 17, 2020. The disclosures of the prior applications are incorporated by reference in their entirety.

TECHNICAL FIELD

The present disclosure relates to a refrigerator having a refrigerating compartment and a freezing compartment that provide respective storage spaces, with an ice-making compartment being provided in a refrigerating compartment door.

BACKGROUND ART

In general, a refrigerator is a home appliance that is provided to store various foods or beverages for a long time by cool air generated by circulation of a refrigerant according to a refrigeration cycle.

The refrigerator is configured as one or a plurality of partitioned storage compartments for cooling stored items. Each of the storage compartments may be opened or closed by a rotary type door, or may be ejected and retracted to store the items in a drawer manner.

In particular, the storage compartments may include a freezing compartment for freezing the stored items and a refrigerating compartment for refrigerating the stored items. In addition, the storage compartments may include at least two freezing compartments or at least two refrigerating compartments.

In recent refrigerators, an ice-making compartment is provided in a refrigerating compartment door, so that a user can take out ice without opening the freezing compartment.

Cool air passed through an evaporator in a cabinet is supplied to the refrigerating compartment door through a cool air duct for the ice-making compartment. When the refrigerating compartment door is closed, the cool air is supplied to the ice-making compartment as the cool air duct for the ice-making compartment is connected to a connection flow path provided in the refrigerating compartment door.

The above refrigerator has been variously proposed in Korean Patent No. 10-1718995 (related art 1), Korean Patent Application Publication No. 10-2018-0057717 (related art 2), Korean Patent No. 10-1659622 (related art 3), and Korean Patent Application Publication No. 10-2009-0101525 (related art 4).

However, in the related arts, although it is sufficient for a portion with the ice-making compartment in the refrigerating compartment to receive relatively less cool air than other portions in the refrigerating compartment, the refrigerator having the ice-making compartment in the refrigerating compartment door as described above is configured to supply a uniform amount of cool air to the entire space in the refrigerating compartment.

The ice-making compartment receiving cool air in the freezing compartment is maintained at a relatively lower temperature than the temperature in the refrigerating compartment. Therefore, the portion with the ice-making compartment has a temperature lower than the temperature in the refrigerating compartment, and in each portion in the refrigerating compartment, a temperature deviation is generated between a portion adjacent to the ice-making compartment and a portion opposite to the portion with the ice-making compartment.

In the conventional refrigerator, refrigerating operation control is not precisely performed due to the temperature deviation for each portion in the refrigerating compartment.

In the above-described related art, the refrigerator is configured to recover cool air passing through the ice-making compartment provided in the refrigerating compartment door to the freezing compartment.

However, the recovered cool air has a temperature higher than the temperature in the freezing compartment, so temperature deviation is inevitably generated between a cool air recovery portion in the freezing compartment and other portions therein, resulting a problem that precise control of the temperature in the freezing compartment is difficult.

In particular, during the process in which the cool air recovered from the ice-making compartment flows into the freezing compartment, the recovered cool air interferes with a cool air flow in the freezing compartment, so that cool air is not sufficiently supplied to a specific portion in the freezing compartment.

Meanwhile, the refrigerator having the ice-making compartment in a freezing compartment door is configured such that a freezing fan module and an ice-making fan module are separately provided and are coupled to a shroud together.

In particular, the ice-making fan module includes a flow path for guiding cool air to the ice-making compartment. The above structure has been proposed in the above-described related arts 3 and 4, and in Korean Patent Application Publication No. 10-2017-0133840 and Korean Patent No. 10-0918445.

However, a grille fan assembly provided by coupling the separate ice-making fan module to the shroud as described above has a problem in assembling in that the ice-making fan module should be additionally assembled. Furthermore, in the process of installing the ice-making module in the grille fan assembly, a fan duct does not match with a cool air duct for the ice-making compartment due to a coupling error between the ice-making fan module and the grille fan assembly.

Furthermore, in the refrigerator having the ice-making compartment in the refrigerating compartment door, a lot of condensed water is generated in the ice-making fan module due to humid air flowing backward from the refrigerating compartment through the cool air duct for the ice-making compartment during the freezing operation. A malfunction in operation of an ice-making fan may be caused due to frozen condensed water.

Conventionally, various efforts have been carried out for removing condensed water in a portion where the ice-making fan module is located or for preventing the condensed water from being frozen.

However, despite the above efforts, a structure preventing the backflow of cool air from the cool air duct for the ice-making compartment or a structure for quickly removing the condensed water flowing into the ice-making fan module is not provided in the refrigerator, so the above problems still remain.

DISCLOSURE

Technical Problem

Accordingly, the present disclosure has been made keeping in mind the above problems occurring in the related art, and the present disclosure is intended to propose a new-type refrigerator configured to reduce the amount of cool air supplied to an ice-making compartment, so that temperature variation for each portion in a refrigerating compartment is minimized.

Another objective of the present disclosure is to provide a new type refrigerator configured to supply a greater amount of cool air to a space communicating with a recovery duct for an ice-making compartment among opposite spaces in a freezing compartment in comparison to the other space opposite to the space with the recovery duct for an ice-making compartment, so that temperature deviation for each portion in the freezing compartment is minimized.

A further objective of the present disclosure is to provide a new type refrigerator configured such that a cool air flow path for an ice-making compartment and a cool air flow path for a freezing compartment share cool air with each other. Whereby, during simultaneous operations of an ice-making fan and a freezing fan, some of cool air supplied through the cool air flow path for the ice-making compartment may be supplied to the freezing compartment through the cool air flow path for the freezing compartment, and even during single operation of the ice-making fan, the cool air in the freezing compartment may be prevented from flowing back into the cool air flow path for the ice-making compartment.

A further objective of the present disclosure is to provide a new type refrigerator configured to supply cool air to a cool air outlet for an upper section and a cool air outlet for a lower section through an upper shared flow path and a lower shared flow path, the outlets being located at any one side of a cool air flow path for a freezing compartment, so that a greater amount of cool air may be supplied to a space communicating with a recovery duct for an ice-making compartment among opposite spaces in the freezing compartment.

A further objective of the present disclosure is to provide a new type refrigerator having a condensed water discharge structure at a portion with an ice-making fan module, so that the ice-making fan module may be prevented from being frozen even when condensed water is generated around the ice-making fan module.

Technical Solution

In order to achieve the above objectives, a refrigerator of the present disclosure may be configured to supply a greater amount of cool air to a space at a side of opposite sides of a freezing compartment communicating with a recovery duct for an ice-making compartment, in comparison to an amount of cool air supplied to other portions in the freezing compartment. Whereby, a problem that the temperature in the freezing compartment is increased due to cool air recovered through the recovery duct for the ice-making compartment may be prevented.

The refrigerator of the present disclosure may be configured to have a partition wall configured to cross a center portion of a freezing compartment side grille fan assembly. Whereby, based on the partition wall, the inside of the freezing compartment may be divided into opposite spaces and a plurality of drawer boxes may be installed to be slide-movable.

The refrigerator of the present disclosure may be configured to have a cool air duct for the ice-making compartment. Whereby, cool air blown from the freezing compartment side grille fan assembly may be supplied to the ice-making compartment.

The refrigerator of the present disclosure may be configured such that a second end of the cool air duct for the ice-making compartment may be connected to a side surface of the freezing compartment side grille fan assembly. Whereby, a vertical height of the freezing compartment side grille fan assembly may be reduced and forced-supply of cool air may be efficiently performed.

The refrigerator of the present disclosure may be configured such that a supply guide duct may be provided in a refrigerating compartment door. Whereby, the height of a first end of the cool air duct for the ice-making compartment may be located at a lower portion of a side wall in the freezing compartment as much as possible.

The refrigerator of the present disclosure may be configured such that a cool air flow path for the ice-making compartment may be integrally formed on any one of facing surfaces between the grille panel and a shroud constituting the freezing compartment side grille fan assembly, and be formed to share cool air with a cool air flow path for the freezing compartment. Whereby, during single operation of a freezing fan or ice-making fan, cool air backflow may be prevented and a supply amount of cool air is increased during the simultaneous operations of the freezing fan and the ice-making fan.

The refrigerator of the present disclosure may be configured such that the cool air flow path for the freezing compartment and the cool air flow path for the ice-making compartment may be integrally formed on a front surface of the shroud. Whereby, compared to the related art in which a separate duct for the ice-making fan is provided and coupled to the shroud, the present disclosure may have a simple structure and does not have difficulty or malfunction in assembling.

The refrigerator of the present disclosure may be configured such that a flow path rib is provided on the shroud. Whereby, the cool air flow path for the freezing compartment and the cool air flow path for the ice-making compartment that are formed on the shroud may have separate flow paths that are partitioned by the flow path rib from each other and provided for cool air flow.

The refrigerator of the present disclosure may be configured such that the flow path rib may have an upper shared flow path. During operations of the ice-making fan, some of cool air supplied to the cool air flow path for the ice-making compartment through the upper shared flow path may be supplied to an upper space in the cool air flow path for the freezing compartment.

The refrigerator of the present disclosure may be configured such that the flow path rib may have a lower shared flow path. Whereby, during operation of ice-making fan, some of cool air blown to the cool air flow path for the ice-making compartment through the lower shared flow path may be supplied to a lower space in the cool air flow path for the freezing compartment.

The refrigerator of the present disclosure may be configured such that the lower shared flow path is formed so that cool air flows along a side wall of the cool air flow path for the freezing compartment. Whereby, interference between cool air introduced to the cool air flow path for the freezing compartment through the lower shared flow path and cool air flowing in the cool air flow path for the freezing compartment.

The refrigerator of the present disclosure may be configured such that a drainage hole is provided in the cool air flow path for the freezing compartment. Whereby, condensed water introduced through the lower shared flow path may be discharged to the outside of the freezing compartment side grille fan assembly so that the ice-making fan may be prevented from being frozen.

The refrigerator of the present disclosure may be configured to have a recovery guide duct in the refrigerating compartment door. Whereby, during closing operation of the refrigerating compartment door, cool air supplied from the cool air duct for the ice-making compartment may be supplied to the ice-making compartment.

The refrigerator of the present disclosure may be configured to have a suction guide provided at a lower end of a grille panel. Whereby, cool air flowing in the freezing compartment may be recovered to the cool air inlet side of a second evaporator.

The refrigerator of the present disclosure may be configured such that a second end of the recovery duct for the ice-making compartment may be located at a side portion of the suction guide in any one of opposite side walls of the freezing compartment. Whereby, cool air recovered through the recovery duct for the ice-making compartment may be recovered to the cool air inlet side of the second evaporator without affecting the temperature change of the freezing compartment.

The refrigerator of the present disclosure may be configured such that the second end of the recovery duct for the ice-making compartment may be formed to open toward the suction guide. Whereby, cool air recovered from the recovery duct for the ice-making compartment may be directly discharged through the suction guide.

The refrigerator of the present disclosure may be configured such that a vertical height of the recovery duct for the ice-making compartment is greater than a transverse width. Whereby, temperature change due to cool air recovered from the recovery duct for the ice-making compartment to the freezing compartment may be minimized.

The refrigerator of the present disclosure may be configured such that the second end of the recovery duct for the ice-making compartment may have an opening that gradually narrows as the opening goes downward. Whereby, temperature change due to cool air recovered from the recovery duct for the ice-making compartment to the freezing compartment may be minimized.

The refrigerator of the present disclosure may be configured to supply different amounts of cool air to opposite spaces in the refrigerating compartment. Whereby, by reducing the supply of cool air to a space in the refrigerating compartment requiring a relatively small amount of cool air, a greater amount of cool air may be supplied to other portions that requires a greater amount of cool air supply.

The refrigerator of the present disclosure may be configured, among the opposite spaces in the refrigerating compartment, the refrigerating compartment side grille fan assembly is configured to supply a greater amount of cool air to a first space of the opposite spaces at a refrigerating compartment door without the ice-making compartment, in comparison to an amount of cool air supplied to a second space of the opposite spaces at a refrigerating compartment door with the ice-making compartment. Whereby, the space at side without the ice-making compartment may receive a sufficient cool air.

Advantageous Effects

As described above, the refrigerator of the present disclosure is configured to reduce the amount of cool air supplied to the first refrigerating compartment door at which the ice-making compartment to supply the rest of cool air to other portions in the refrigerating compartment. Accordingly, temperature deviation for each portion in the refrigerating compartment can be minimized.

The refrigerator of the present disclosure is configured to supply a greater amount of cool air to a space communicating with the recovery duct for the ice-making compartment among the opposite spaces in the freezing compartment than the amount of cool air supplied to the other space opposite to the space with the recovery duct for the ice-making compartment. Accordingly, temperature deviation for each portion in the freezing compartment can be minimized.

In particular, even when the cool air passing through the ice-making compartment provided in the refrigerating compartment door is recovered to the freezing compartment, temperature change in the freezing compartment can be minimized.

The refrigerator of the present disclosure is configured to allow the cool air flow path for the ice-making compartment and the cool air flow path for the freezing compartment to partially share cool air with each other. Whereby, when the ice-making fan and the freezing fan are simultaneously operated, some of cool air supplied through the cool air flow path for the ice-making compartment is supplied to the freezing compartment through the cool air flow path for the freezing compartment, so that the amount of cool air supplied to the freezing compartment can be increased.

The refrigerator of the present disclosure is configured to supply cool air to the cool air outlet for the upper section and the cool air outlet for the lower section through the upper shared flow path and the lower shared flow path, the outlets being located at any one side of a cool air flow path for a freezing compartment. Accordingly, a greater amount of cool air can be supplied to the space communicating with the recovery duct for the ice-making compartment among the opposite spaces in the freezing compartment, so that the opposite spaces in the freezing compartment can be maintained at a predetermined temperature.

The refrigerator of the present disclosure is configured to efficiently discharge condensed water to the outside of the freezing compartment side grille fan assembly when the condensed water is generated in the portion with the ice-making fan module. Accordingly, the ice-making fan module can be prevented from being frozen.

MODE FOR INVENTION

Hereinbelow, a refrigerator according to an exemplary embodiment of the present disclosure will be described with reference to accompanying FIGS. 1 to 44.

Figure 1:
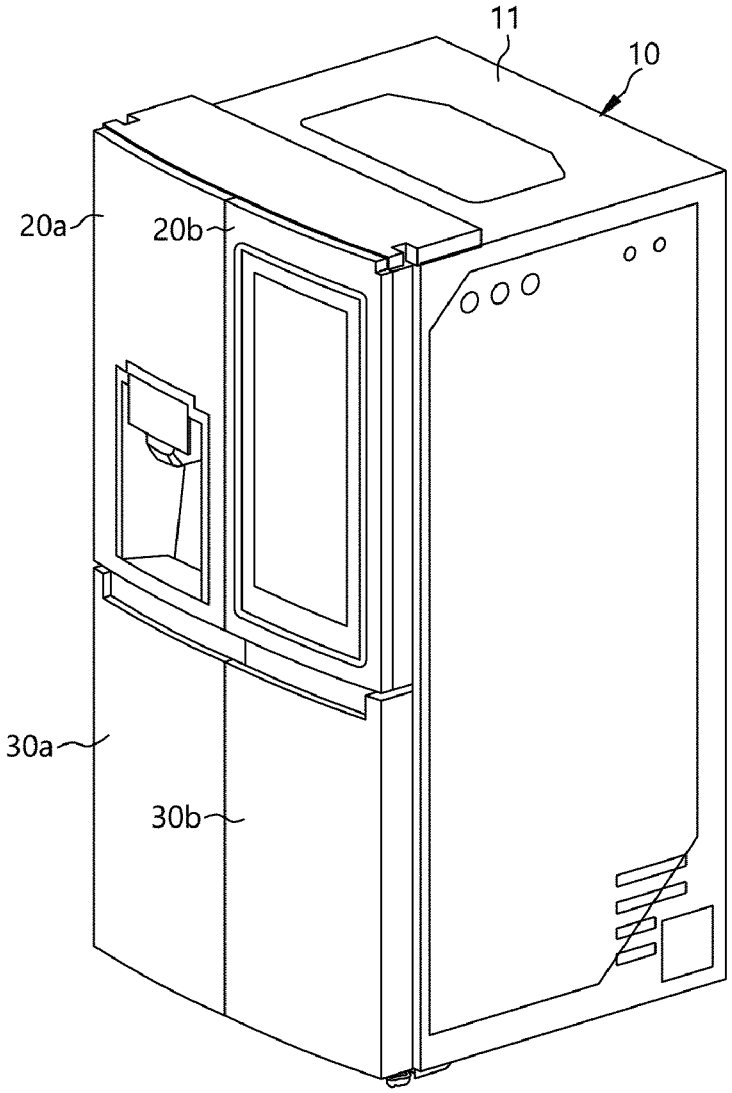
FIG. 1 is a perspective view showing an external structure of a refrigerator according to an embodiment of according to an embodiment of the present disclosure.
Figure 2:
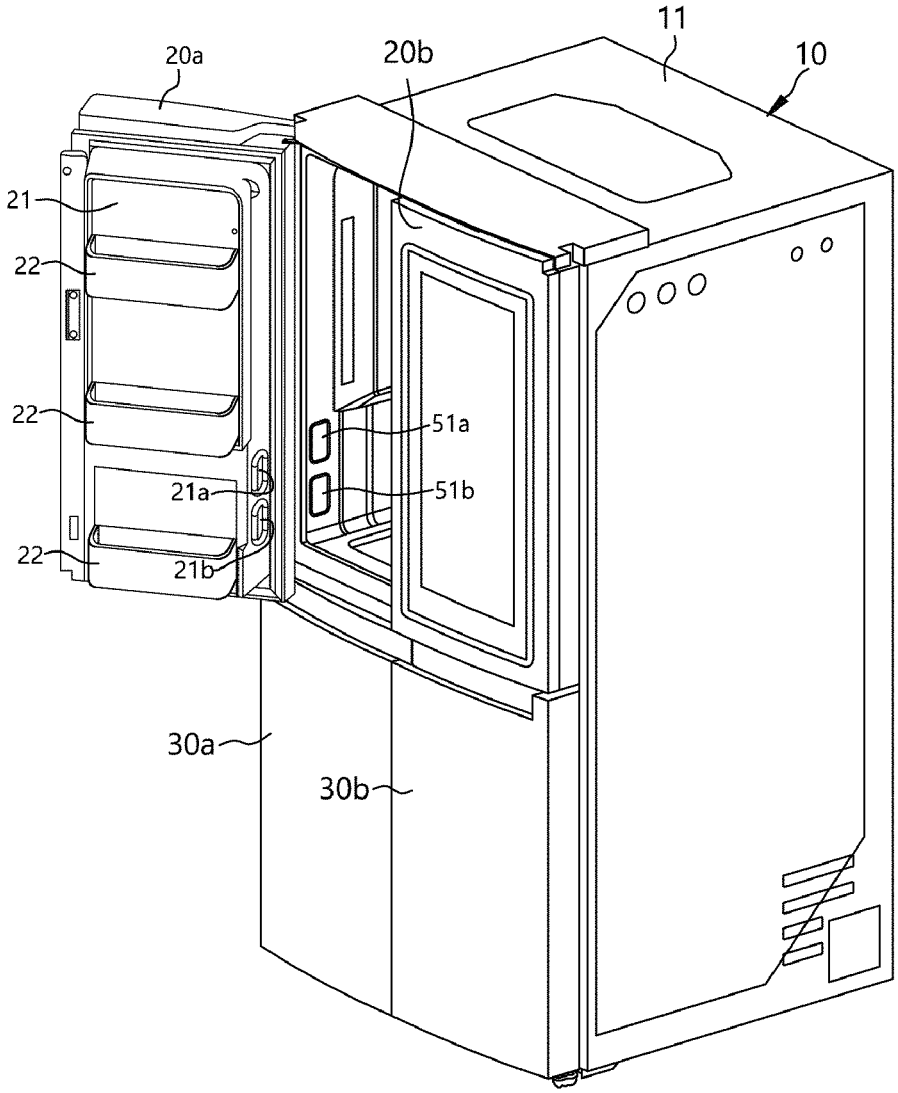
FIG. 2 is a perspective view showing a refrigerating compartment door with an ice-making compartment of the refrigerator according to the embodiment of the present disclosure in an opened state.

FIG. 1 is a perspective view showing an external structure of a refrigerator according to an embodiment of according to an embodiment of the present disclosure. FIG. 2 is a perspective view showing a refrigerating compartment door with an ice-making compartment of the refrigerator according to the embodiment of the present disclosure in an opened state.

Figure 3:
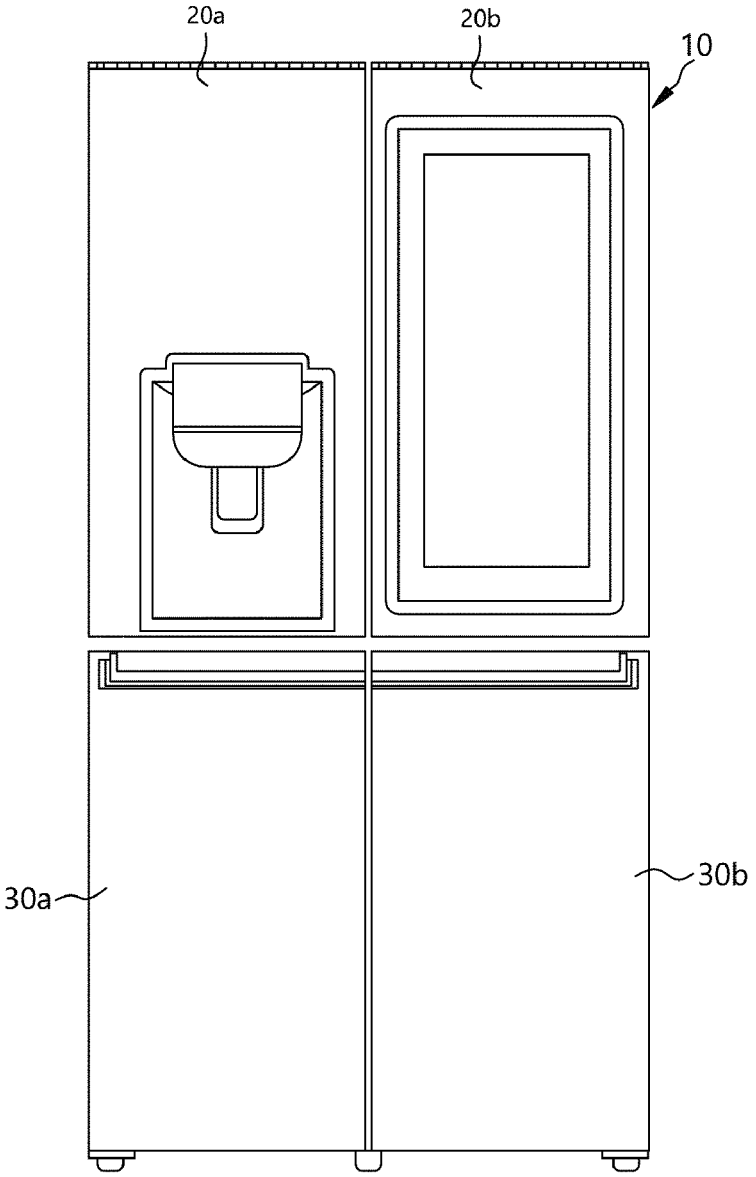
FIG. 3 is a front view schematically showing an internal structure of the refrigerator according to the embodiment of the present disclosure.
Figure 4:
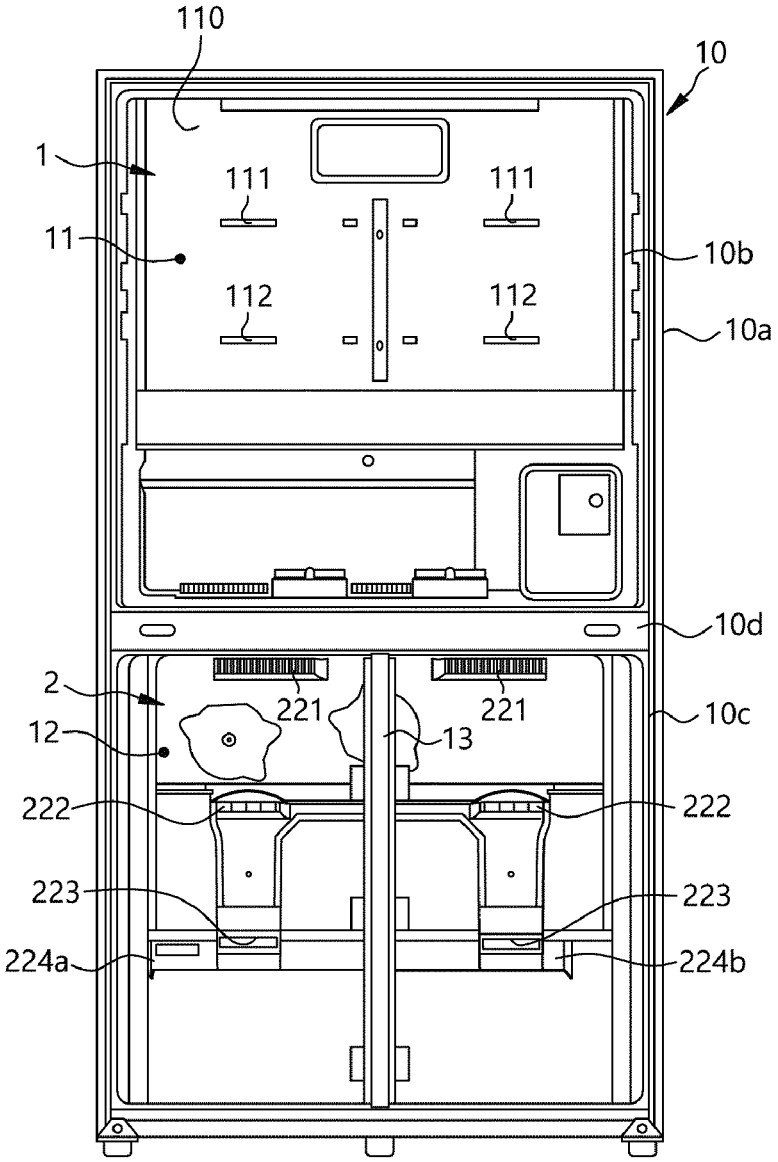
FIG. 4 is a front sectional view showing the internal structure of the refrigerator according to the embodiment of the present disclosure in a state in which two refrigerating compartment doors and two freezing compartment doors are omitted.
Figure 5:
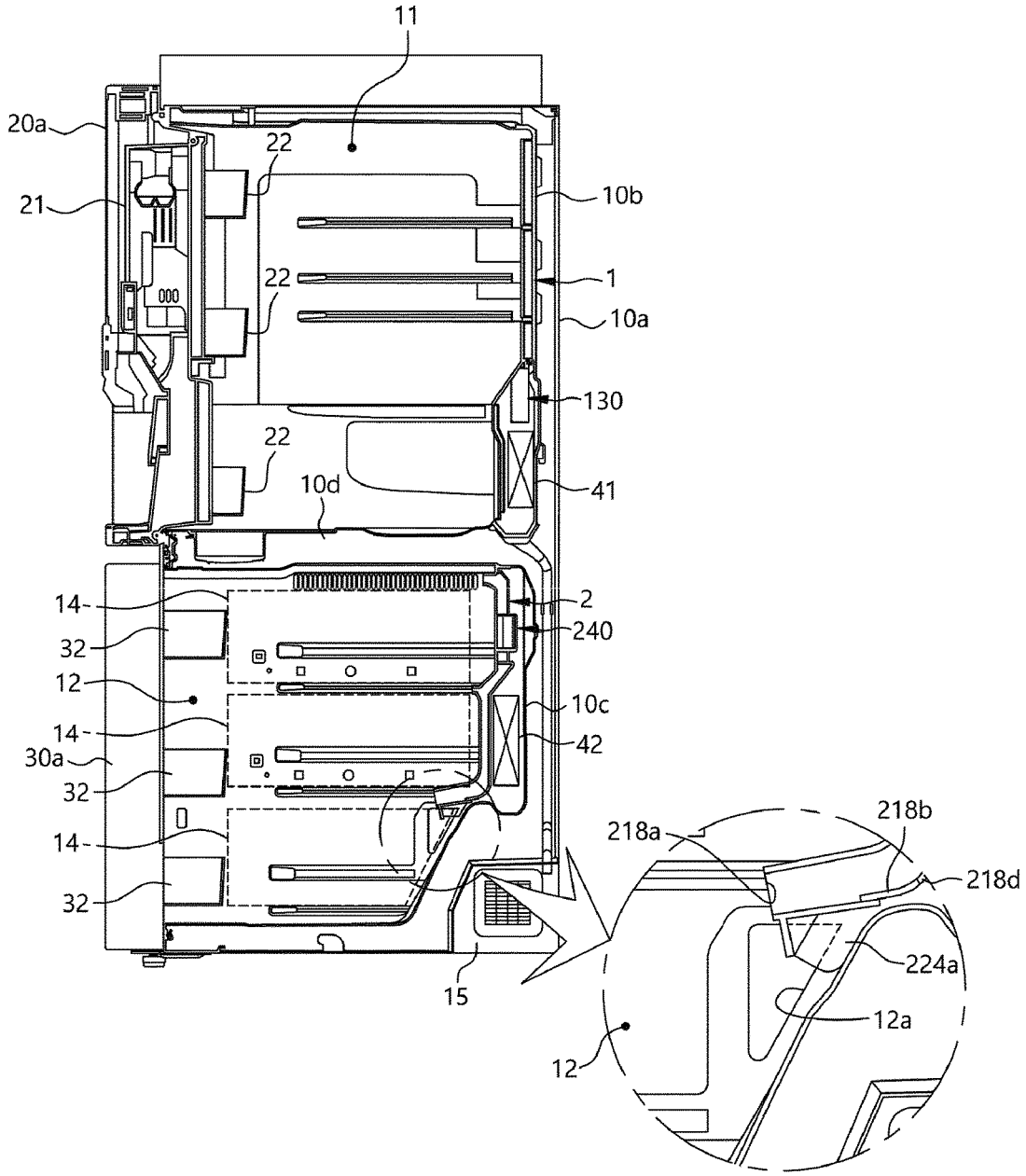
FIG. 5 is a side sectional view showing the internal structure of the refrigerator according to the embodiment of the present disclosure.

FIG. 3 is a front view schematically showing an internal structure of the refrigerator according to the embodiment of the present disclosure. FIG. 4 is a front sectional view showing the internal structure of the refrigerator according to the embodiment of the present disclosure in a state in which two refrigerating compartment doors and two freezing compartment doors are omitted. FIG. 5 is a side sectional view showing the internal structure of the refrigerator according to the embodiment of the present disclosure.

As shown in the drawings, the refrigerator according to the embodiment of the present disclosure includes a refrigerating compartment 11, a freezing compartment 12, and an ice-making compartment 21. The refrigerating compartment 11 is configured to receive cool air from a refrigerating compartment side grille fan assembly 1, and the ice-making compartment 21 is located at any one refrigerating compartment door 20*a* and is configured to receive cool air from a freezing compartment side grille fan assembly 2 with the freezing compartment 12.

The refrigerator according to the embodiment of the present disclosure will be described in detail as follows.

The refrigerating compartment 11 is a storage compartment provided to refrigerate stored items, and the freezing compartment 12 is a storage compartment provided to freeze stored items.

The refrigerating compartment 11 may be provided in an upper portion in a cabinet 10, and the freezing compartment 12 may be provided in a lower portion in the cabinet 10.

The cabinet 10 may consist of an outer casing 10*a* providing an external surface of the refrigerator and two inner casings 10*b* and 10*c* providing inner surfaces of the refrigerator.

Among the two inner casings 10*b* and 10*c*, an upper inner casing 10*b* (Hereinbelow, upper inner casing refers to "inner casing for refrigerating compartment") may be a portion providing the refrigerating compartment 11, and a lower inner casing 10*c* (Hereinbelow, lower inner casing refers to "inner casing for freezing compartment") may be a portion providing the freezing compartment 12.

That is, an inner space of the inner casing 10*b* may be used as the refrigerating compartment 11, and an inner space of the inner casing 10*c* may be used as the freezing compartment 12.

Each of the inner casings 10*b* and 10*c* may be formed in a box shape with an open front surface, and be formed to be spaced apart from each other.

A partition wall 10*d* (referring to FIGS. 4 and 5) may be provided in a space between the two inner casings 10*b* and 10*c*. The partition wall 10*d* may be a separate frame placed between the two inner casings 10*b* and 10*c*, may be a filling material filling between the two inner casings 10*b* and 10*c*, or may be configured as a void.

Furthermore, the refrigerating compartment 11 is configured to be opened and closed by a refrigerating compartment door 20*a*, 20*b*, and the freezing compartment 12 is configured to be opened and closed by a freezing compartment door 30*a*, 30*b*.

The refrigerating compartment door 20*a*, 20*b* is configured as two doors, and configured as double-door type rotary doors (a door installed to be horizontally rotatable) that may respectively open and close opposite portions in the refrigerating compartment 11. The freezing compartment door 30*a*, 30*b* may be configured as two doors, and configured as double-door type rotary doors (a door installed to be horizontally rotatable) that may respectively open and close opposite portions in the freezing compartment 12.

In particular, the ice-making compartment 21 is provided at an inside (a side located in the refrigerating compartment when the refrigerating compartment door is closed) of a refrigerating compartment door 20*a* (Hereinbelow, the door refers to a "first refrigerating compartment door"), among the two refrigerating compartment doors 20*a* and 20*b*. The ice-making compartment 21 is a storage compartment having an ice tray for making ice in the refrigerating compartment door 20*a*. The ice-making compartment 21 is configured to have a space partitioned from the refrigerating compartment 11. Here, the first refrigerating compartment door 20*a* is a refrigerating compartment door located on the left side when the refrigerator is viewed from the front.

Although not shown in the drawings, an ice-making compartment 21 may be additionally provided in another refrigerating compartment door 20*b* (a refrigerating compartment door is located on the right side when the refrigerator is viewed from the front. Hereinbelow, the refrigerating compartment door refers to "second refrigerating compartment door") among the refrigerating compartment doors 20*a* and 20*b*. Alternately, the ice-making compartment 21 may be provided in only the second refrigerating compartment door 20*b*.

Meanwhile, storage boxes 22 for the stored items may be provided on inside wall surfaces (wall surfaces exposed to the inside of the refrigerating compartment) of the first refrigerating compartment door 20*a* and the second refrigerating compartment door 20*b*.

The storage box 22 provided in the first refrigerating compartment door 20*a* may have a storage space smaller than the storage box provided in the second refrigerating compartment door 20*b*. Considering that the ice-making compartment 21 is provided in the first refrigerating compartment door 20*a*, the storage space of the storage box 22 in the first refrigerating compartment door 20*a* may be formed smaller than the storage space of the storage box in the second refrigerating compartment door 20*b* by a thickness of the ice-making compartment 21.

Furthermore, the freezing compartment 12 may have seating portions for upper, middle, and lower sections.

In addition, a separation wall 13 may be provided in the freezing compartment 12. The separation wall 13 may be a wall built for dividing the freezing compartment 12 into left and right spaces, and be configured to vertically cross a center portion The left and right spaces in the freezing compartment 12 divided by the separation wall 13 respectively have the seating portions of the upper, middle, and lower sections. In each of the seating portions of the upper, middle, and lower sections, a drawer box 14 may be provided to store the stored items (referring to FIG. 5).

The drawer box 14 may be installed to be ejected and retracted in a drawer manner. The drawer box 14 in each of the compartments may be configured such that an upper end of the drawer box 14 is spaced apart from a lower surface of another drawer box 14 located above the drawer box 14. That is, as a gap is formed between the drawer boxes 14, cool air may pass between the drawer boxes 14.

The two freezing compartment doors 30*a* and 30*b* are configured to open and close the opposite left and right portions in the freezing compartment 12 divided by the separation wall 13, respectively. That is, one freezing compartment door 30*a* (Hereinbelow, the door refers to "first freezing compartment door") is configured to open and close one space in the freezing compartment (the left space when the refrigerator is viewed from the front). Further, the other freezing compartment door 30*b* (Hereinbelow, the door refers to "second freezing compartment door") is configured to open and close the other space in the freezing compartment (the right space when the refrigerator is viewed from the front).

In addition, a storage box 32 for the stored items may be provided on an inside wall surface of each of the freezing compartment door 30*a*, 30*b*. The storage box 32 may be configured to have an open upper portion.

In addition, evaporators 41 and 42 are provided in front of rear wall surfaces (rear wall surfaces of the two inner casings) in the cabinet 10, respectively.

The evaporators 41 and 42 include a first evaporator 41 (an evaporator at refrigerating compartment side) for controlling the temperature in the refrigerating compartment 11, and a second evaporator 42 (an evaporator at freezing compartment side) for controlling the temperature in the freezing compartment 12. The first evaporator 41 is located at the rear in the inner casing 10*b* for the refrigerating compartment (at the rear in the refrigerating compartment), and the second evaporator 42 is located at the rear in the inner casing 10*c* for the freezing compartment (at the rear in the freezing compartment).

In addition, the two evaporators 41 and 42 are configured to selectively receive a coolant from one compressor.

The compressor may be provided in a machine chamber 15 in the cabinet 10 with a condenser. The machine chamber 15 may be provided in a lower rear portion outside the inner casing 10*c* for the freezing compartment. That is, a freezing space in the freezing compartment 12 may be reduced by a size of the machine chamber 15.

The grille fan assemblies 1 and 2 may be provided at the front of the evaporators 41 and 42.

The grille fan assemblies 1 and 2 may include the refrigerating compartment side grille fan assembly 1 provided in the refrigerating compartment 11, and the freezing compartment side grille fan assembly 2 provided in the freezing compartment 12.

The freezing compartment side grille fan assembly 2 may be configured of a different structure from the refrigerating compartment side grille fan assembly 1. The refrigerating compartment side grille fan assembly 1 provided in the refrigerating compartment 11 may be configured to include one fan module 130 (refrigerating fan module), but the freezing compartment side grille fan assembly 2 may be configured such that two fan modules 230 and 240 are integrally installed therein. Therefore, the freezing compartment side grille fan assembly 2 may be configured to selectively supply cool air to the freezing compartment 12 and the ice-making compartment 21.

The refrigerating compartment side grille fan assembly 1 may be configured to supply cool air that is heat-exchanged while passing through the first evaporator 41 to the refrigerating compartment 11. The freezing compartment side grille fan assembly 2 may be configured to supply cool air that is heat-exchanged while passing through the second evaporator 42 to the freezing compartment 12 and the ice-making compartment 21.

In particular, the freezing compartment side grille fan assembly 2 may be configured to have the two fan modules 230 and 240 and to selectively supply the cool air heat-exchanged while passing through the second evaporator 42 to the freezing compartment 12 and the ice-making compartment 21.

That is, the two fan modules 230 and 240 may be integrally provided in the single freezing compartment side grille fan assembly 2, and guide structures for cool air flows blown by the two fan modules 230 and 240 may be integrally formed in the freezing compartment side grille fan assembly 2.

Furthermore, a cool air duct 51 for the ice-making compartment may be provided in a gap defined between the outer casing 10*a* and any one side walls of the two inner casings 10*b* and 10*c* constituting the cabinet 10.

The cool air duct 51 for the ice-making compartment may be a duct that guides cool air supplied from the freezing compartment side grille fan assembly 2 to be supplied to the ice-making compartment 21.

Figure 6:
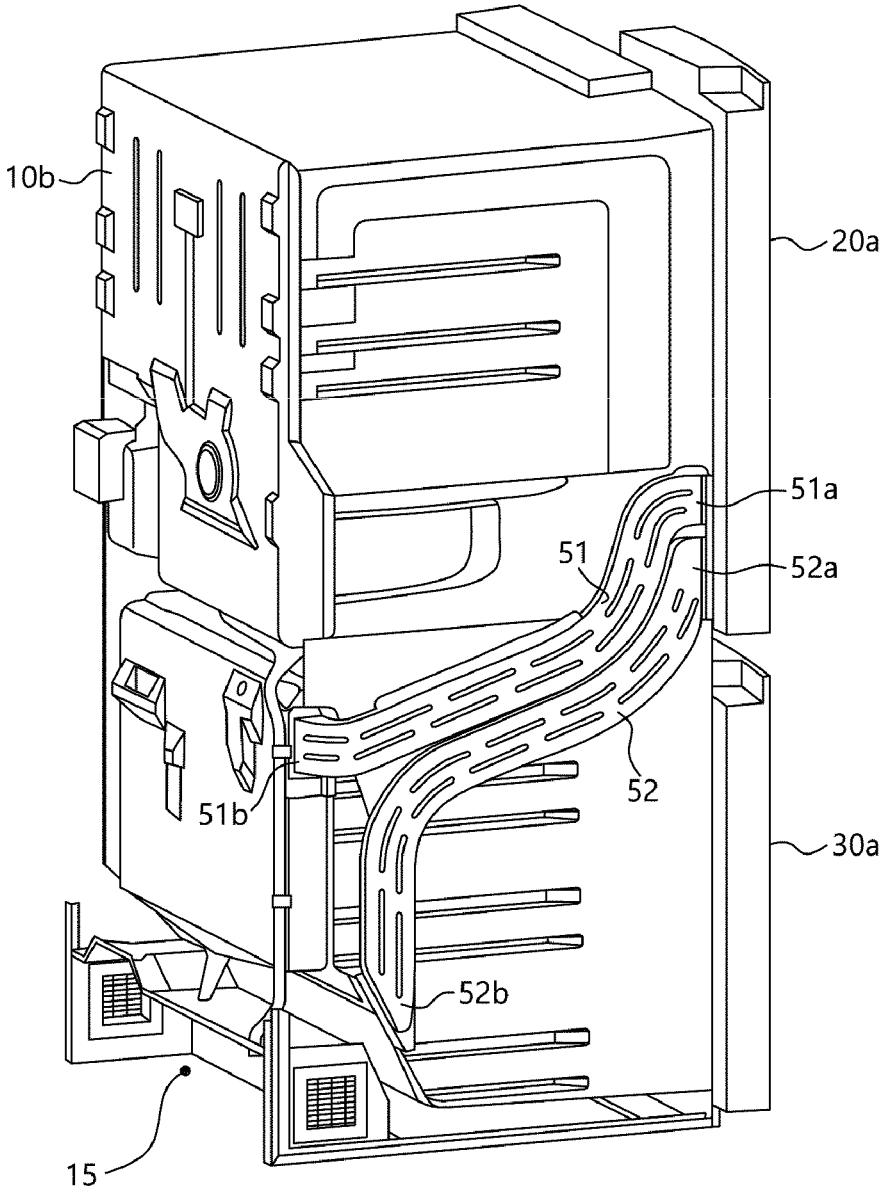
FIG. 6 is a perspective view showing an installation structure of a cool air duct for the ice-making compartment and a recovery duct for the ice-making compartment of the refrigerator according to the embodiment of the present disclosure in a state in which an outer casing of the refrigerator is omitted.
Figure 7:
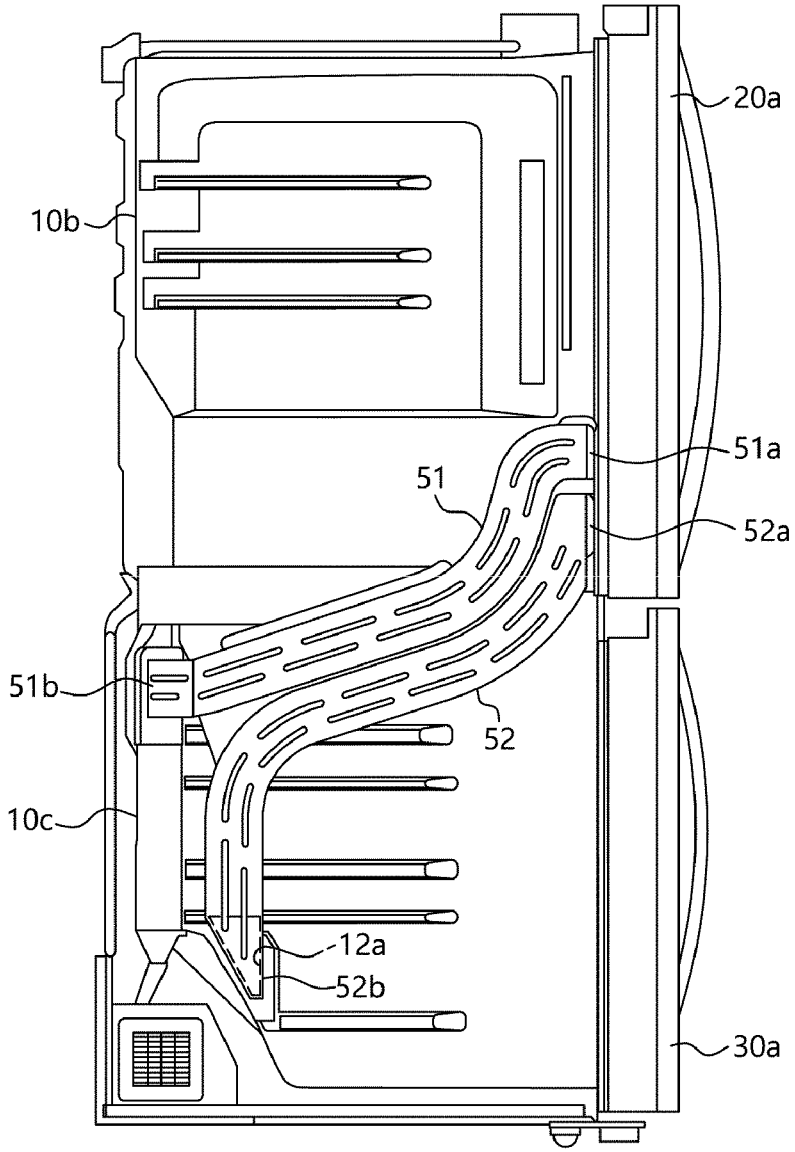
FIG. 7 is a side view showing the installation structure of the cool air duct for the ice-making compartment and the recovery duct for the ice-making compartment of the refrigerator according to the embodiment of the present disclosure in a state in which the outer casing of the refrigerator is omitted.

A first end 51*a* of the cool air duct 51 for the ice-making compartment may be installed by penetrating any one side surface (a side where the refrigerating compartment door with the ice-making compartment is located, the left side in the drawing when viewed from the front) of the freezing compartment side grille fan assembly 2. That is, an outlet through which cool air of the cool air flow path 213 for the ice-making compartment is discharged may be configured to be open toward any one side portion between a grille panel 220 and a shroud 210 constituting the freezing compartment side grille fan assembly 2. Accordingly, the cool air blown by an ice-making fan 241 may flow efficiently without sudden change of direction, as shown in FIGS. 6 and 7.

The cool air duct 51 for the ice-making compartment may be installed along any one side portion in the cabinet 10. In addition, the cool air duct 51 for the ice-making compartment may be installed such that a second end 51*a* thereof is exposed to the inside of the refrigerating compartment 11 by penetrating a side wall of the inner casing 10*b* for the refrigerating compartment.

The second end 51*a* of the cool air duct 51 for the ice-making compartment may be configured to supply the cool air to a supply guide duct 21*a* while matching with the supply guide duct 21*a* provided in the first refrigerating compartment door 20*a*, when closing operation of the first refrigerating compartment door 20*a* having the ice-making compartment 21 is performed. The supply guide duct 21*a* may be formed to extend to the ice-making compartment 21 and is configured to supply the cool air to the ice-making compartment 21.

Figure 8:
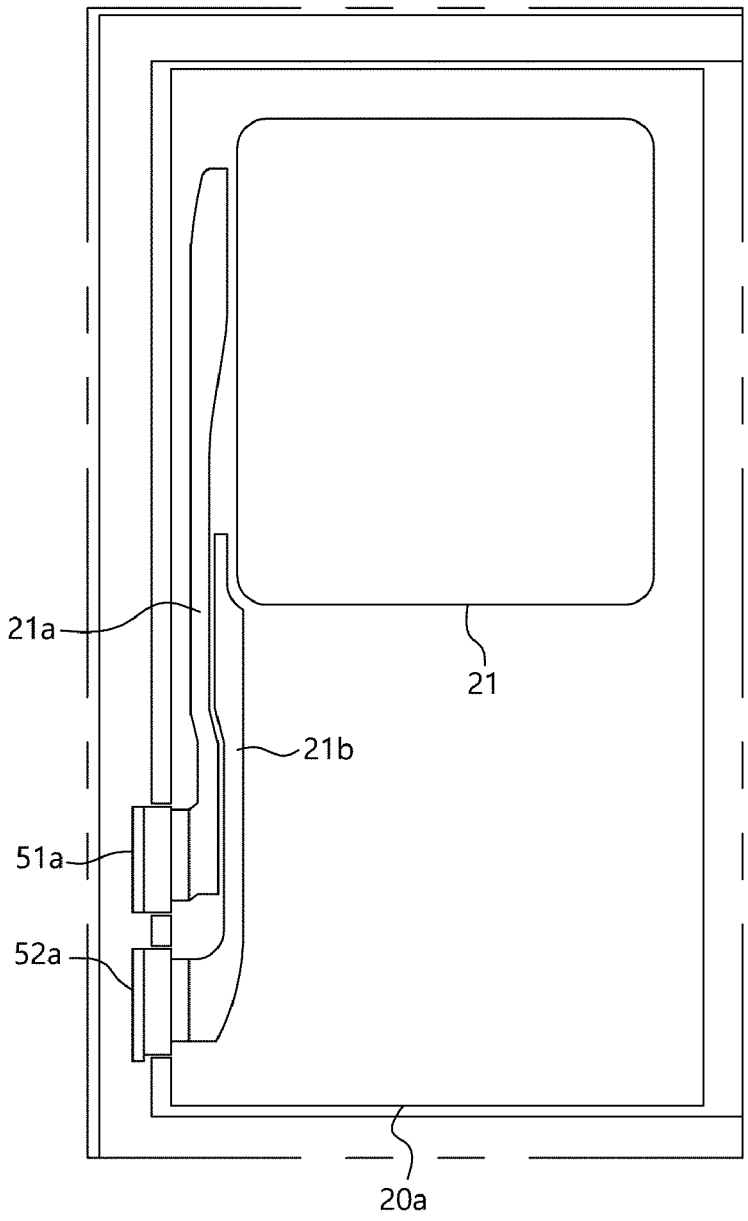
FIG. 8 is a view schematically showing a flow path structure for cool air supply to and recovery from the ice-making compartment of the refrigerator according to the embodiment of the present disclosure.

In addition, a recovery guide duct 21*b* may be provided in the first refrigerating compartment door 20*a*. A first end of the recovery guide duct 21*b* may be connected to the ice-making compartment 21 and a second end thereof may be formed to extend to a lower portion of a side wall of the first refrigerating compartment door 20*a*, thereby guiding a recovery flow of the cool air passing through the ice-making compartment 21, as shown in FIG. 8.

A recovery duct 52 for the ice-making compartment may be provided in a gap defined between the outer casing 10*a* and any one side wall of the inner casing 10*b*, 10*c* of the cabinet 10.

The recovery duct 52 for the ice-making compartment may be configured to guide the cool air passing through the ice-making compartment 21 to be recovered to the freezing compartment 12.

The recovery duct 52 for the ice-making compartment may be configured such that a first end 52*a* thereof is exposed to the inside of the refrigerating compartment 11 by penetrating the side wall of the inner casing 10*b* for the refrigerating compartment. The first end 52*a* of the recovery duct 52 for the ice-making compartment may be configured to match with the second end of the recovery guide duct 21*b* when closing operation of the first refrigerating compartment door 20*a* having the ice-making compartment 21 is performed.

In addition, the recovery duct 52 for the ice-making compartment may be configured such that a second end 52*b* thereof passes through a penetration hole 12*a* (referring to FIG. 5) provided in a side wall of the inner casing 10*c* for the freezing compartment to be exposed to the inside of the freezing compartment 12.

The second end 52*b* of the recovery duct 52 for the ice-making compartment may be located at the rearmost side of the lower section in the freezing compartment 12.

In particular, it may be preferable that the penetration hole 12*a* where the second end 52*b* of the recovery duct 52 for the ice-making compartment is located is located as close to a cool air suction side (a side where cool air recovered from the freezing compartment to the second evaporator is suctioned) of the freezing compartment side grille fan assembly 2 as possible. That is, the cool air recovered from the recovery duct 52 for the ice-making compartment may flow directly toward the second evaporator 42 without affecting the temperature and humidity in the freezing compartment 12 as little as possible.

In the embodiment of the present disclosure, the penetration hole 12*a* where the second end 52*b* of the recovery duct 52 for the ice-making compartment is located is located in a portion of any one of opposite side walls of the inner casing 10*c* for the freezing compartment while being in parallel to a side portion of the first suction guide 224*a* provided in the freezing compartment side grille fan assembly 2.

The second end 52*b* (or, the penetration hole 12*a* in which the second end is located) of the recovery duct 52 for the ice-making compartment may be formed in a triangular structure that gradually narrows as the second end goes downward, and be formed to be open toward the lower section in the freezing compartment 12.

That is, when a portion (or penetration hole) of a cool air outlet side of the recovery duct 52 for the ice-making compartment has a long structure in a transverse direction, the temperature in the freezing compartment 12 may be affected by such structure. However, in the triangular structure same as the embodiment of the present disclosure, the cool air outlet side portion (or penetration hole) of the recovery duct 52 for the ice-making compartment may have a vertically long structure while considering a shape of the machine chamber 15, so that the effect on the temperature in the freezing compartment 12 may be minimal.

Meanwhile, among the described-above components of the refrigerator according to the embodiment of the present disclosure, the refrigerating compartment side grille fan assembly 1 may be configured to supply a greater amount of cool air to a space at the first refrigerating compartment door 20*a* among opposite spaces in the refrigerating compartment 11, in comparison to the amount of cool air supplied to the other space at the second refrigerating compartment door 20*b*.

That is, the ice-making compartment 21 is provided in the first refrigerating compartment door 20*a*, and the temperature of cool air supplied to the ice-making compartment 21 is lower than the temperature of cool air in the refrigerating compartment 11. Considering the temperatures, the temperature around the ice-making compartment 21 is also lower than the temperature in the refrigerating compartment 11. Accordingly, since the space at the ice-making compartment 21 is maintained at a lower temperature than the temperature of other portions in the refrigerating compartment 11 without sufficient supply of cool air in the refrigerating compartment 11, the refrigerating compartment side grille fan assembly 1 may be configured to supply a greater cool air to the side with the second refrigerating compartment door 20*b*.

The structure of supplying a greater amount of cool air to the space at the second refrigerating compartment door 20*b* in the refrigerating compartment 11 in comparison to the space at the first refrigerating compartment door 20*a* may be embodied in various method.

For example, plurality of cool air outlets 111*a* and 111*b* for the refrigerating compartment provided on the refrigerating compartment side grille fan assembly 1 may be arranged in the side with the second refrigerating compartment door 20*b* among the opposite sides in the refrigerating compartment.

However, considering the aesthetic of the refrigerator, symmetrical arrangement of the cool air outlets 111*a* and 111*b* for the refrigerating compartment formed on the refrigerating compartment side grille fan assembly 1 may be preferable.

Accordingly, the cool air outlets 111*a* and 111*b* for the refrigerating compartment may be formed horizontally (or symmetrically) on the basis of a center portion in the refrigerating compartment 11. A part (or, all) of the cool air outlets 111*a* and 111*b* for the refrigerating compartment facing the first refrigerating compartment door 20*a* may be configured not to receive cool air.

Although not shown in the drawings, a grille provided in each of the cool air outlets 111*a* and 111*b* for the refrigerating compartment may be configured to face the side with the second refrigerating compartment door 20*b* of the opposite sides in the refrigerating compartment.

Hereinbelow, an embodiment of a specific structure of the refrigerating compartment side grille fan assembly 1 configured to supply cool air only to some of the cool air outlets 111*a* and 111*b* for the refrigerating compartment will be described in detail with reference to FIGS. 9 to 16.

As shown in the drawings, the refrigerating compartment side grille fan assembly 1 includes a refrigerating compartment side grille panel 110, a duct unit 120, and a refrigerating fan module 130.

The refrigerating compartment side grille panel 110 may be configured to constitute a front wall surface of the refrigerating compartment side grille fan assembly 1.

The refrigerating compartment side grille panel 110 may have the plurality of cool air outlets 111*a* and 111*b* for the refrigerating compartment. The cool air outlets 111*a* and 111*b* for the refrigerating compartment may consist of a cool air outlet 111*a* for an upper section supplying cool air to the upper section in the refrigerating compartment 11 and a cool air outlet 111*b* for a middle section supplying cool air to the middle section in the refrigerating compartment 11. The cool air outlet 111*a* for the upper section and a cool air outlet 111*b* for the middle section may be respectively configured to have two outlets, and the cool air outlets 111*a* and 111*b* are respectively configured to be transversely symmetrical based on the center portion of the refrigerating compartment 11.

The duct unit 120 may be configured to guide a flow of cool air supplied to the refrigerating compartment 11.

The duct unit 120 may be in close contact with a rear surface of the refrigerating compartment side grille panel 110, and cool air flow paths 121 and 122 for the refrigerating compartment may be formed on a rear surface of the duct unit 120.

The cool air flow paths 121 and 122 for the refrigerating compartment may be configured to guide cool air to be supplied to the refrigerating compartment 11, and include a first cool air flow path 121 for the refrigerating compartment and a second cool air flow path 122 for the refrigerating compartment. The first cool air flow path 121 for the refrigerating compartment may be configured to supply cool air to the space at the ice-making compartment 21 side among the opposite spaces of the refrigerating compartment 11. The second cool air flow path 122 for the refrigerating compartment may be configured to supply cool air to the space at the other side without the ice-making compartment 21 of the opposite sides of the refrigerating compartment 11.

In particular, the second cool air flow path 122 for the refrigerating compartment may be configured to pass through any one of the two cool air outlets 111 for the upper section and any one of the two cool air outlets 112 for the middle section. The first cool air flow path 121 for the refrigerating compartment may be configured to pass only through the other one of the two cool air outlets 112 for the middle section. That is, the cool air flow paths 121 and 122 may be configured such that the amount of cool air supplied to the inside of the refrigerating compartment 11 while flowing along the first cool air flow path 121 for the refrigerating compartment is relatively less than the amount of cool air supplied to the inside of the refrigerating compartment 11 while passing along the second cool air flow path 122 for the refrigerating compartment.

The refrigerating fan module 130 is configured to blow cool air to the cool air flow paths 121 and 122 for the refrigerating compartment.

The refrigerating fan module 130 includes a refrigerating fan 131 and a fan duct 132.

The refrigerating fan 131 may be configured as a slim centrifugal fan, and be configured to introduce cool air flowing through the first evaporator 41 in a shaft direction of the refrigerating fan 131 and to discharge the cool air in a radial direction thereof.

In addition, the fan duct 132 may have two flow paths 132*a* and 132*b* in which the refrigerating fan 131 is installed, the two flow paths 132*a* and 132*b* being divided into two ways to distribute cool air from opposite sides of the refrigerating fan 131, so that cool air may be provided to the two cool air flow paths 121 and 122 for the refrigerating compartment of the duct unit 120.

The two flow paths 132*a* and 132*b* of the fan duct 132 may be formed to have different sizes from each other. In particular, the two flow paths 132*a* and 132*b* of the fan duct 132 may be formed such that a portion connected to the second cool air flow path 122 for the refrigerating compartment has a flow path larger than a flow path of a portion connected to the first cool air flow path 121 for the refrigerating compartment. Whereby, the second cool air flow path 122 for the refrigerating compartment may receive a greater amount of cool air than the first cool air flow path 121 for the refrigerating compartment.

Accordingly, among the opposite spaces in the refrigerating compartment 11, a greater amount of cool air may be supplied to the space at the second refrigerating compartment door 20*b* than the amount of cool air supplied to the space at the first refrigerating compartment door 20*a*. Thus, the cool air may be sufficiently supplied to the storage box in the second refrigerating compartment door 20*b*.

Meanwhile, according to the embodiment of the present disclosure, the freezing compartment side grille fan assembly 2 may be configured to supply a greater amount of cool air to any one space (left space when the refrigerator is viewed from the front) of the two spaces in the freezing compartment 12 transversely divided by the separation wall 13 in comparison to the other space (the right space when the refrigerator is viewed from the front).

Since the recovery duct 52 for the ice-making compartment is installed to communicate with the freezing compartment 12, the temperature in a space communicating with the recovery duct 52 for the ice-making compartment in the freezing compartment 12 is relatively higher than the temperature in a space opposite to the space with the recovery duct 52 for the ice-making compartment. Therefore, a greater amount of cool air is supplied to the space with the recovery duct 52 for the ice-making compartment, so that temperature difference between both the spaces in the freezing compartment 12 may be reduced. Alternatively, as a through hole is formed on the separation wall 13 dividing the freezing compartment 12 into the left and right spaces, both the spaces in the freezing compartment 12 may communicate with each other through the hole to reduce temperature difference between both the spaces.

Hereinbelow, the embodiment of a specific structure of the freezing compartment side grille fan assembly 2 will be described in detail with reference to FIGS. 17 to 31.

As shown in FIGS. 17 to 20, the freezing compartment side grille fan assembly 2 includes the shroud 210.

The shroud 210 is a portion constituting a rear wall surface of the freezing compartment side grille fan assembly 2.

The second evaporator 42 may be located in the rear of the freezing compartment 12 of a rear wall surface in the cabinet 10 (a rear wall surface in the inner casing). The shroud 210 may be located at front of the second evaporator 42.

The shroud 210 may have a first inlet hole 211*a* and a second inlet hole 211*b* that are formed by penetrating the shroud 210.

The two inlet holes 211*a* and 211*b* are configured to allow the cool air, which is heat-exchanged while passing through the second evaporator 42 located at the rear in the freezing compartment 12, to flow into a space between the grille panel 220 for the freezing compartment and the shroud 210.

In a front surface of the shroud 210, the freezing fan module 230 is installed in a portion where the first inlet hole 211*a* is formed, and the ice-making fan module 240 is installed in a portion where the second inlet hole 211*b* is formed.

The freezing fan module 230 may be located to face the first inlet hole 211*a*, and the ice-making fan module 240 may be located to face the second inlet hole 211*b*.

In particular, the first inlet hole 211*a* may be located at a center portion between the upper section and the middle section constituting the freezing compartment 12. The second inlet hole 211*b* may be located at either side of the first inlet hole 211*a*. That is, the freezing fan module 230 may be located at the center portion between the upper section and the middle section constituting the freezing compartment 12 in each portion of the freezing compartment side grille fan assembly 2, and the ice-making fan module 240 may be located at either side of the freezing fan module 230. Therefore, the cool air blown in a radial direction of the freezing fan 231 by the operation of the freezing fan module 230 may be efficiently supplied to all of the upper, middle, and lower sections in the freezing compartment. Furthermore, the cool air blown in a radial direction of the ice-making fan 241 by the operation of the ice-making fan module 240 may be forcibly supplied toward the side of the freezing compartment side grille fan assembly 2 while having directionality.

The first inlet hole 211*a* may be designed in consideration of the air volume of cool air supplied to the freezing compartment 12 through the freezing fan module 230. The second inlet hole 211*b* may be designed in consideration of the pressure of cool air supplied to the ice-making compartment 21 through the ice-making fan module 240.

That is, since the freezing fan module 230 supplies the cool air to the freezing compartment 12 located at front of the freezing fan module 230, the freezing fan module 230 is configured to supply a sufficient amount of cool air. On the other hand, since the ice-making fan module 240 supplies the cool air to the ice-making compartment 21 located in the first refrigerating compartment door 20*a*, the ice-making fan module 240 needs to be configured to supply a sufficient amount of cool air over a long distance.

As in the conventional general technique, the freezing fan module 230 may use a type of fan for high air volume, and the ice-making fan module 240 may use a type of fan having excellent pressure-feeding power.

However, when the freezing fan module 230 and the ice-making fan module 240 use different types of fans, the communalization and standardization of the fan cannot be realized. In this case, there is a problem in that a type of each fan is inevitably determined according to the required air volume or pressure-feeding distance, and a flow path inevitably needs to be changed according to the determined fan type.

In the embodiment of the present disclosure, in order to solve the above problem, the freezing fan module 230 and the ice-making fan module 240 may be configured to use the same type of fan to realize the communalization and standardization of the fan.

In particular, in order to use the same type of fan for the freezing fan module 230 and the ice-making fan module 240, the first inlet hole 211*a* may be formed relatively larger than the second inlet hole 211*b*, so that the first inlet hole 211*a* may have a low pressure-feeding force, but may discharge a lot of cool air. The second inlet hole 211*b* may be formed relatively smaller than the first inlet hole 211*a*, so that second inlet hole 211*b* may have a small discharge amount of cool air, but have a high pressure-feeding force enough to supply cool air to the ice-making compartment 21. The above structures are shown in FIGS. 21 and 22.

Figure 21:
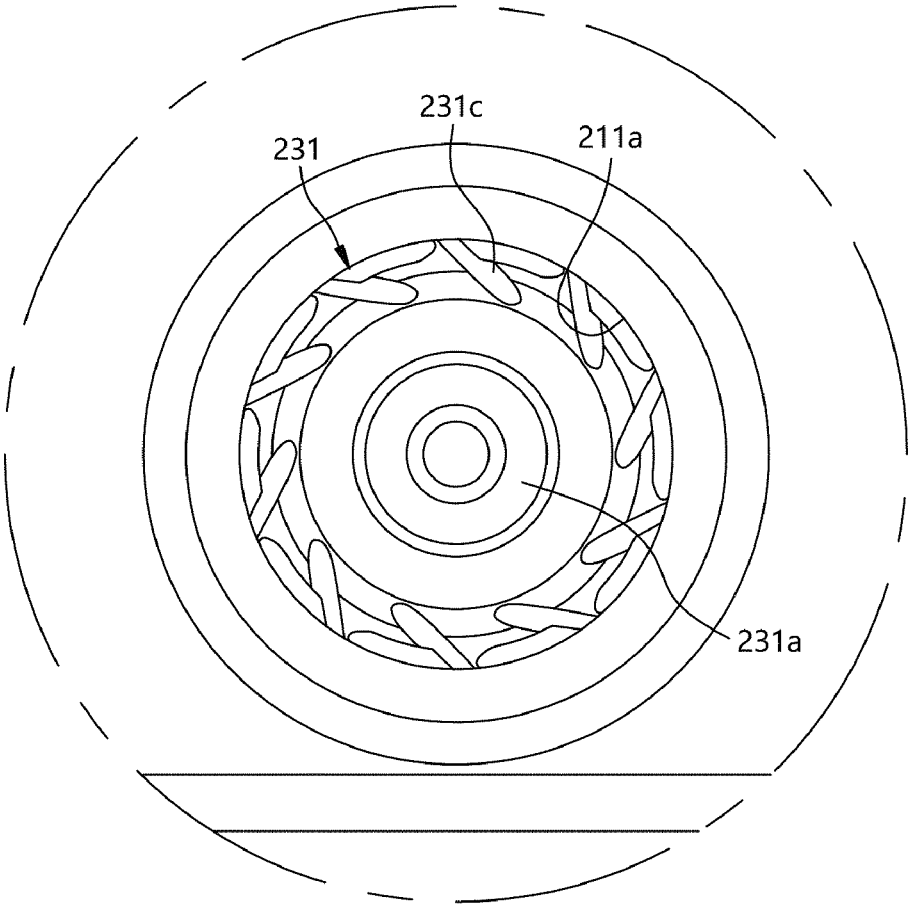
FIG. 21 is an enlarge view showing part "A" in FIG. 20.
Figure 22:
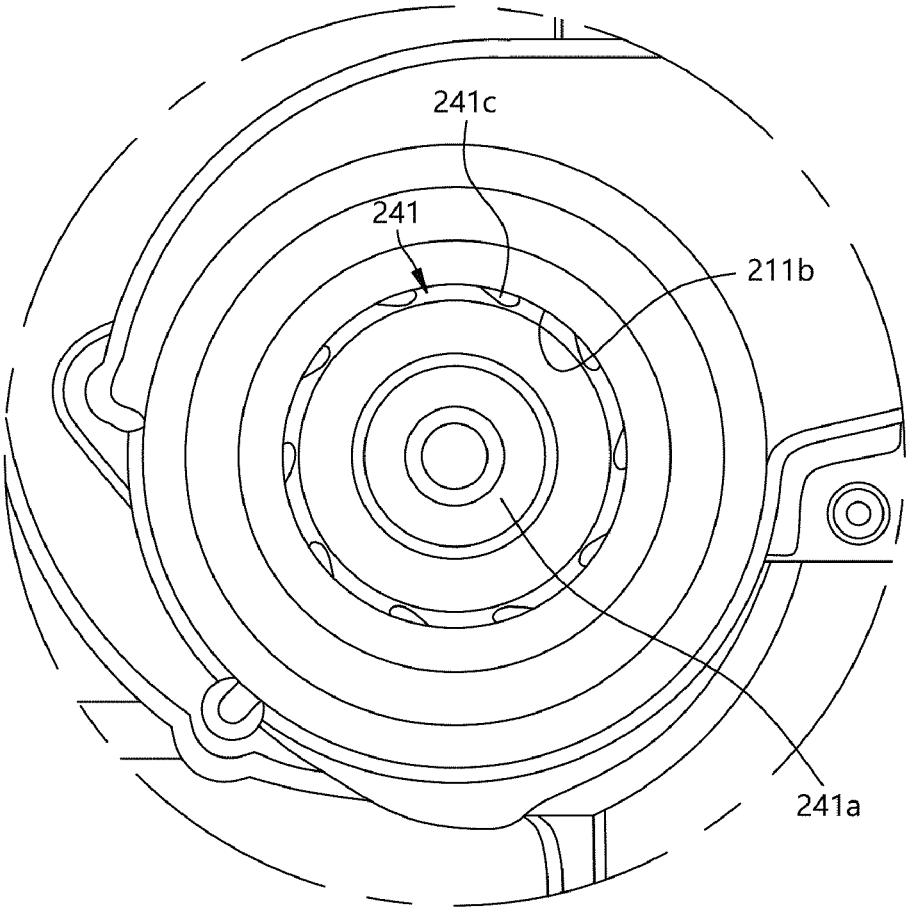
FIG. 22 is an enlarge view showing part "B" in FIG. 20.

Herein, the first inlet hole 211*a* may be formed to have an inner diameter enough to expose at least a half of each impeller 231*c* of the freezing fan 231 constituting the freezing fan module 230 (referring to FIG. 21).

That is, the above structure may allow the impeller 231*c* to guide the cool air passing through the first inlet hole 211*a* and supplied to a gap provided between impellers 231*c* to be directly discharged in the radial direction of the freezing fan 231.

Preferably, the first inlet hole 211*a* may be formed to have the inner diameter enough to expose a great portion of each impeller 231*c* of the freezing fan 231.

On the other hand, the second inlet hole 211*b* may be formed to have an inner diameter that does not expose a great portion of each impeller 241*c* of the ice-making fan 241 (referring to FIG. 22).

That is, when each impeller 241*c* of the ice-making fan 241 is further exposed through the second inlet hole 211*b*, the reverse flow, that is, cool air passes through the second inlet hole 211*b* in a reverse direction while being discharged in a rotational direction of the ice-making fan 241 is frequently generated. In this case, a cool air flow reversely passing through the second inlet hole 211*b* and a cool air flow passing through the second evaporator 42 and flowing into the second inlet hole 211*b* collide with each other, so that a pressure-feeding force of cool air facing the cool air flow path 213 for the ice-making compartment may be relatively lowered.

The second inlet hole 211*b* may be formed to have a size to expose only up to half of each impeller 241*c*, thereby increasing the pressure feeding force.

Preferably, the second inlet hole 211*b* may be formed to have the size such that each impeller 241*c* is not exposed. That is, a great portion of an open portion between impellers 241*c* may be covered so that that the reverse flow of cool air can be fundamentally prevented.

In addition, the cool air flow path 213 for the ice-making compartment and the cool air flow path 214 for the freezing compartment may be respectively formed at the front surface of the shroud 210.

The cool air flow path 213 for the ice-making compartment may be configured to guide the cool air passing through the second inlet hole 211*b* and flowing into a gap defined between the shroud 210 and the grille panel 220 to flow into a connection portion to the cool air duct 51 for the ice-making compartment (referring to FIG. 6). The cool air flow path 214 for the freezing compartment may be configured to guide the cool air blown by the freezing fan 231 to each of the upper, middle, and lower sections in the freezing compartment 12.

Figure 23:
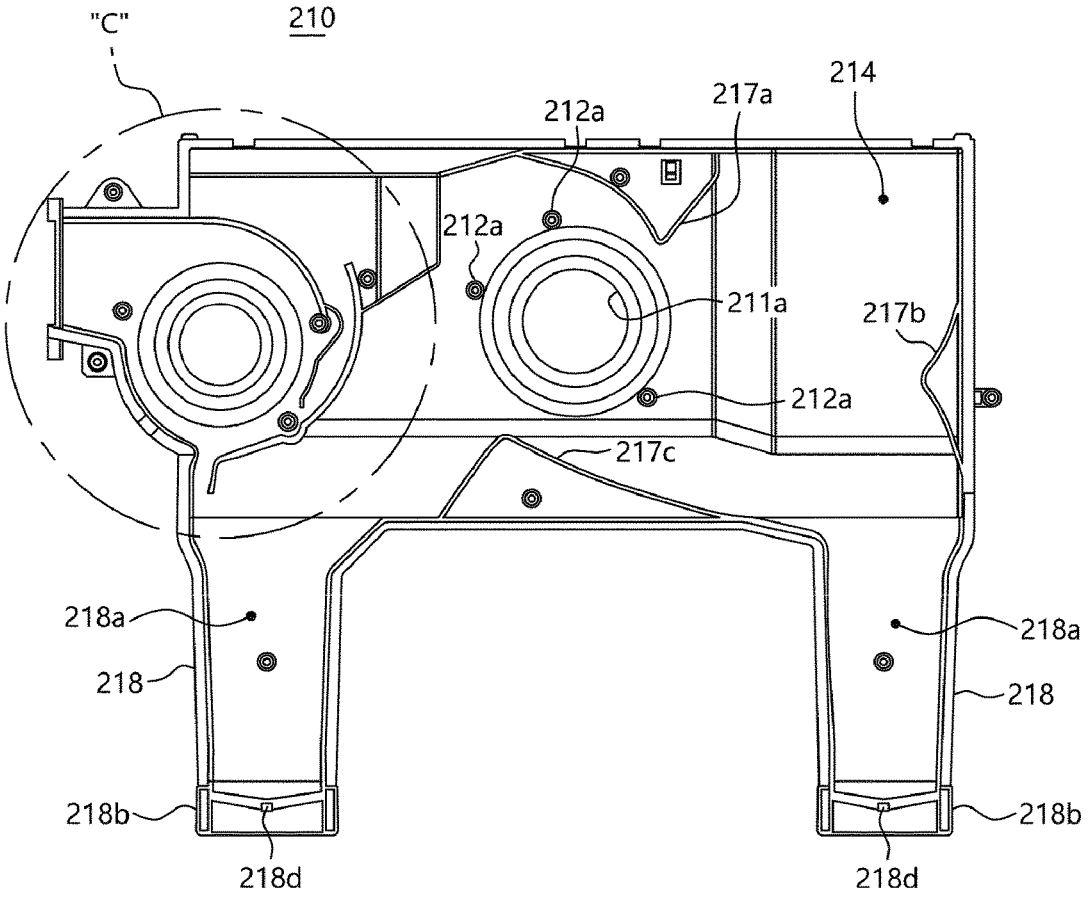
FIG. 23 is a front view showing a shroud of the freezing compartment side grille fan assembly of the refrigerator according to the embodiment of the present disclosure.
Figure 24:
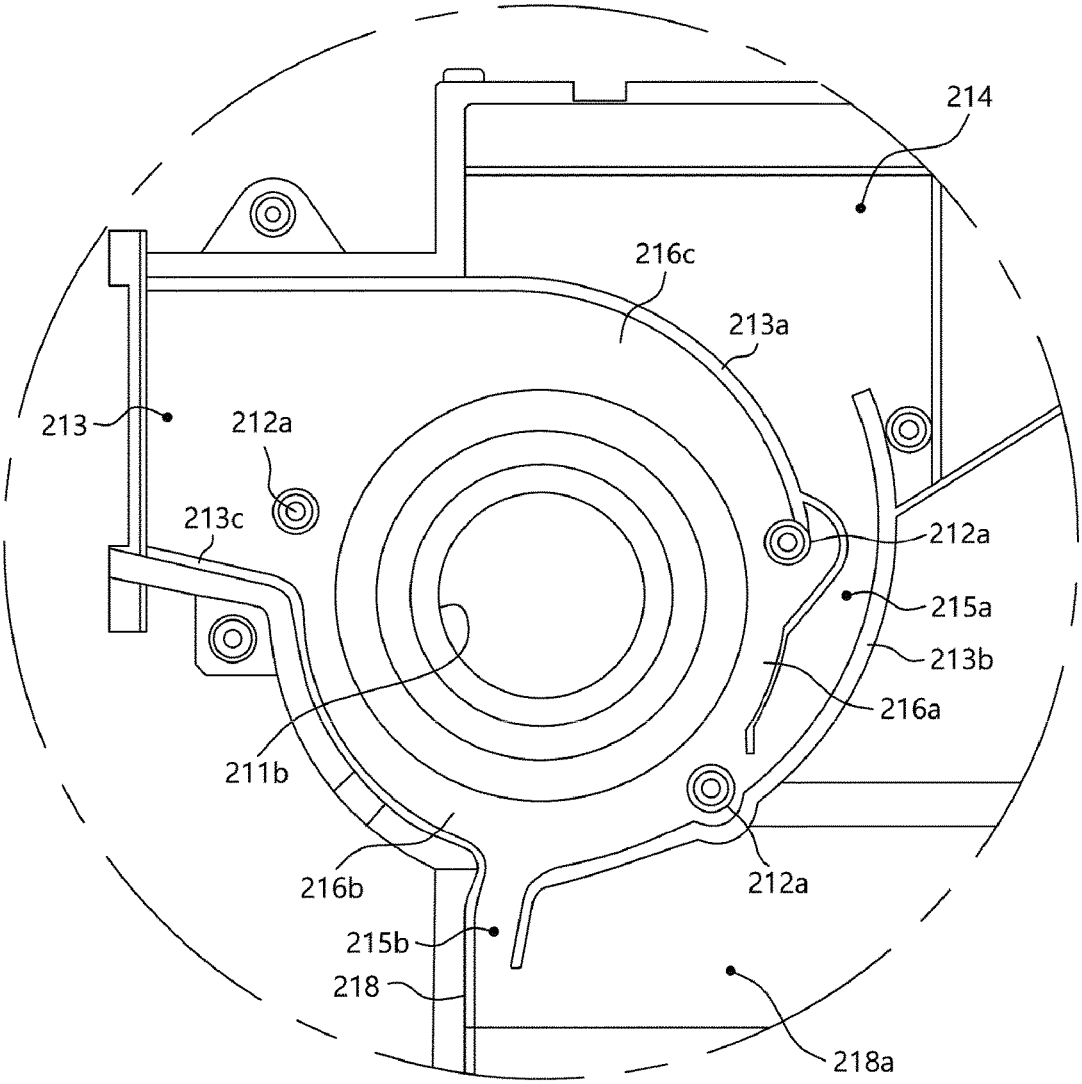
FIG. 24 is an enlarge view showing part "C" in FIG. 23.
Figure 25:
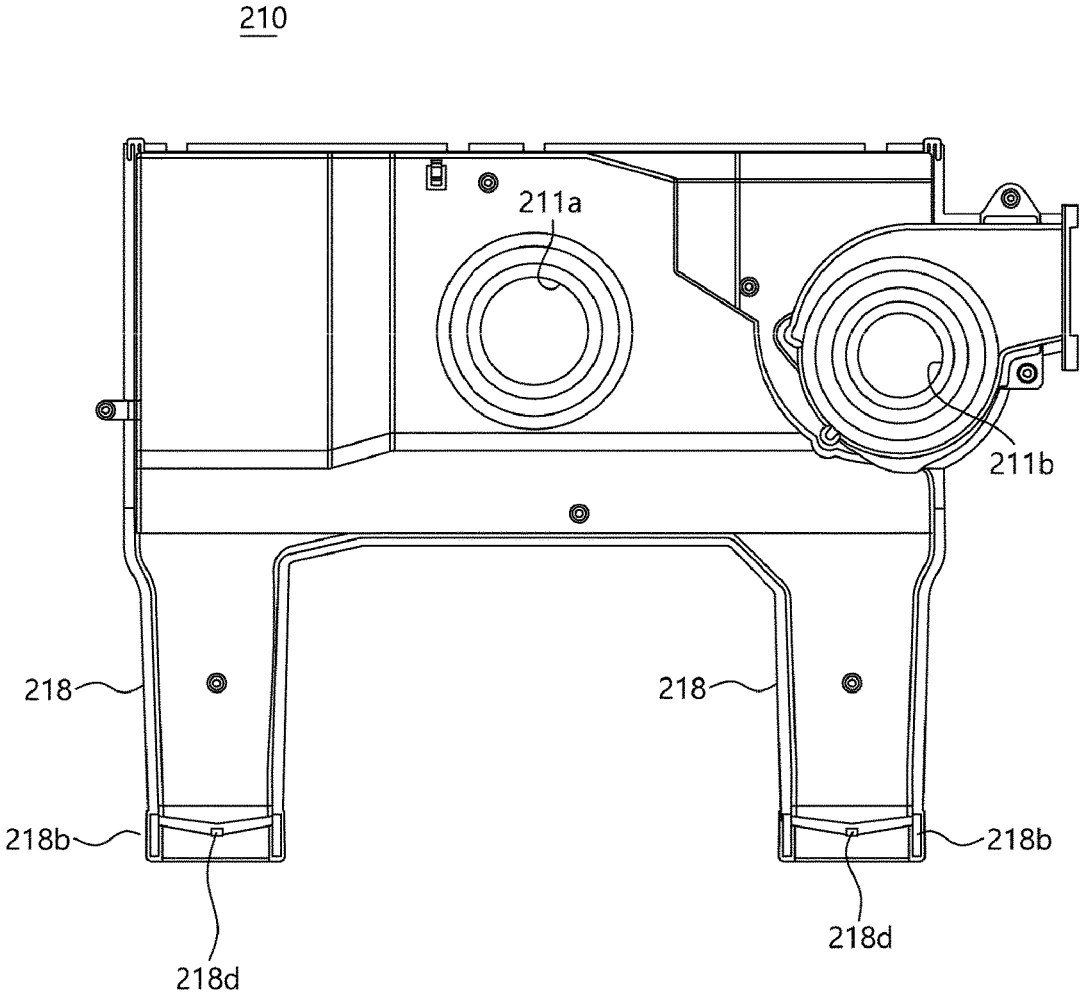
FIG. 25 is a rear view showing the shroud of the freezing compartment side grille fan assembly of the refrigerator according to the embodiment of the present disclosure.
Figure 26:
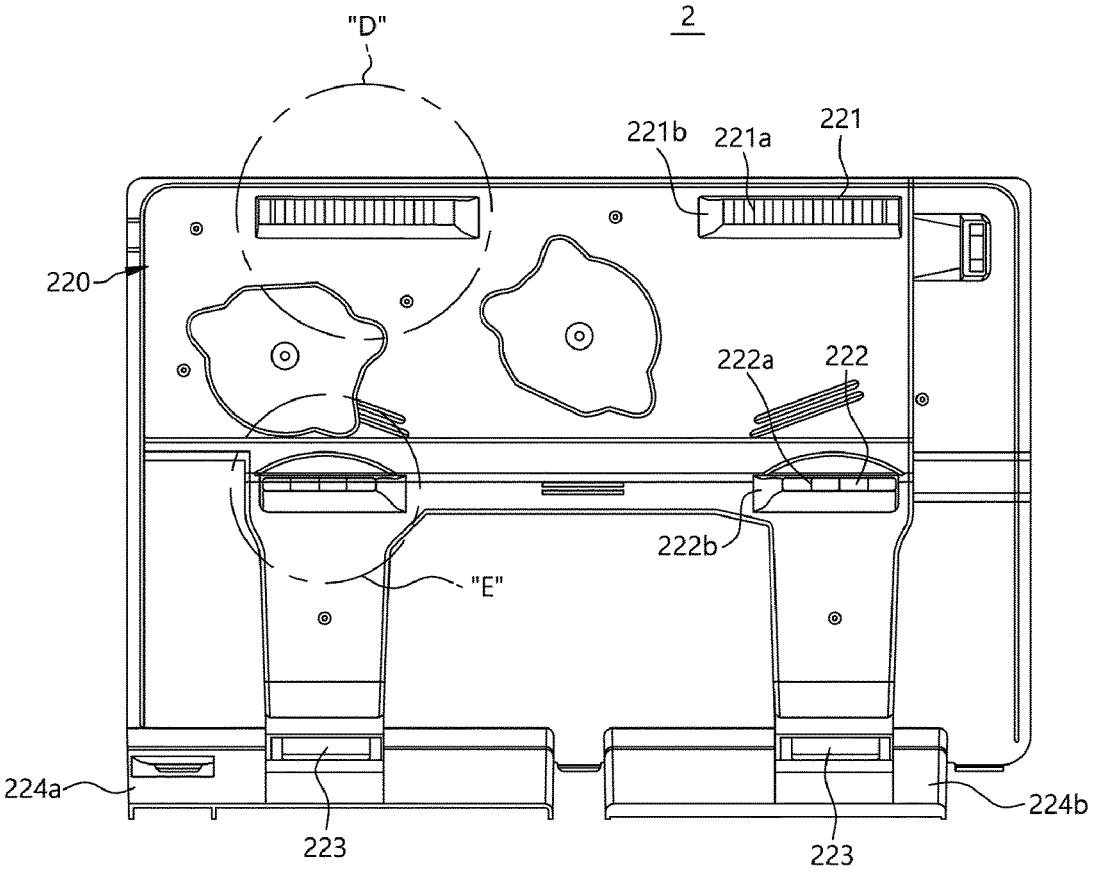
FIG. 26 is a front view showing a grille panel of the freezing compartment side grille fan assembly of the refrigerator according to the embodiment of the present disclosure.
Figure 27:
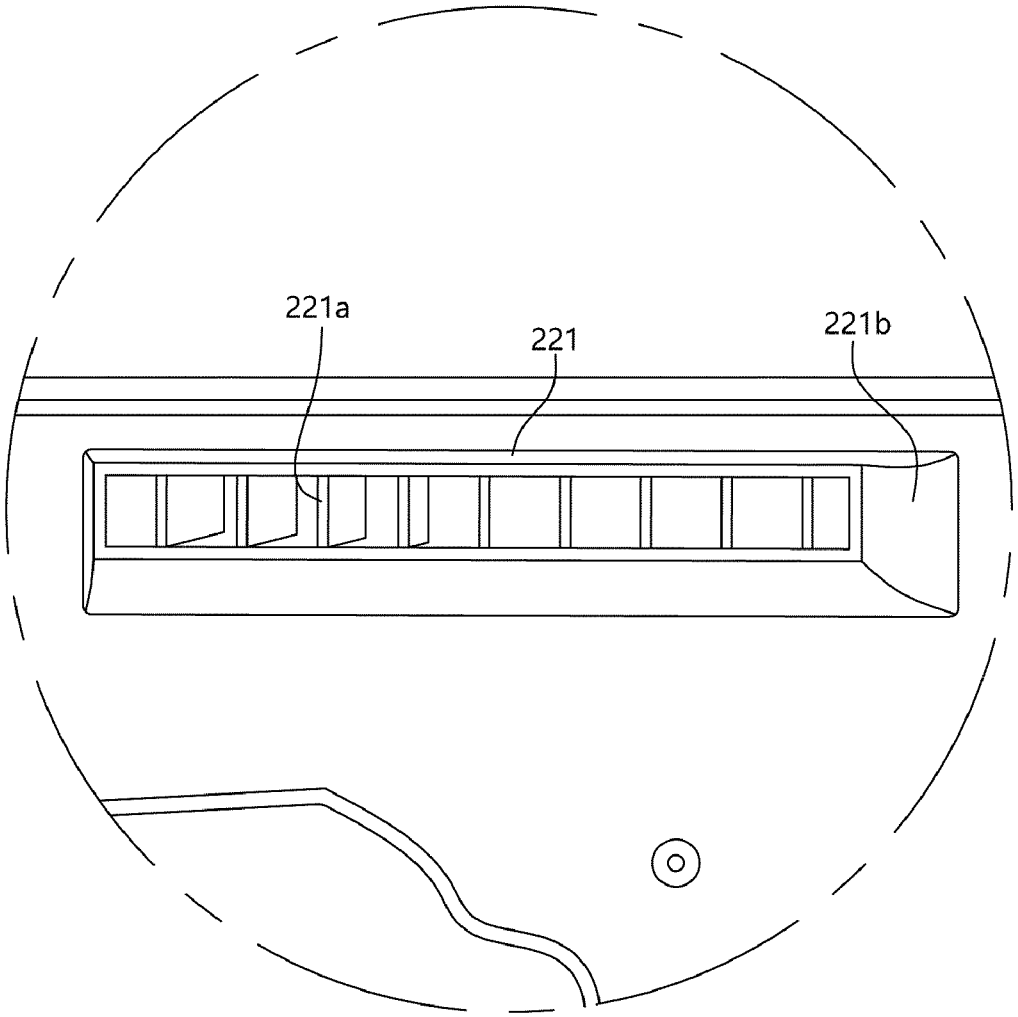
FIG. 27 is an enlarge view showing part "D" in FIG. 26.
Figure 28:
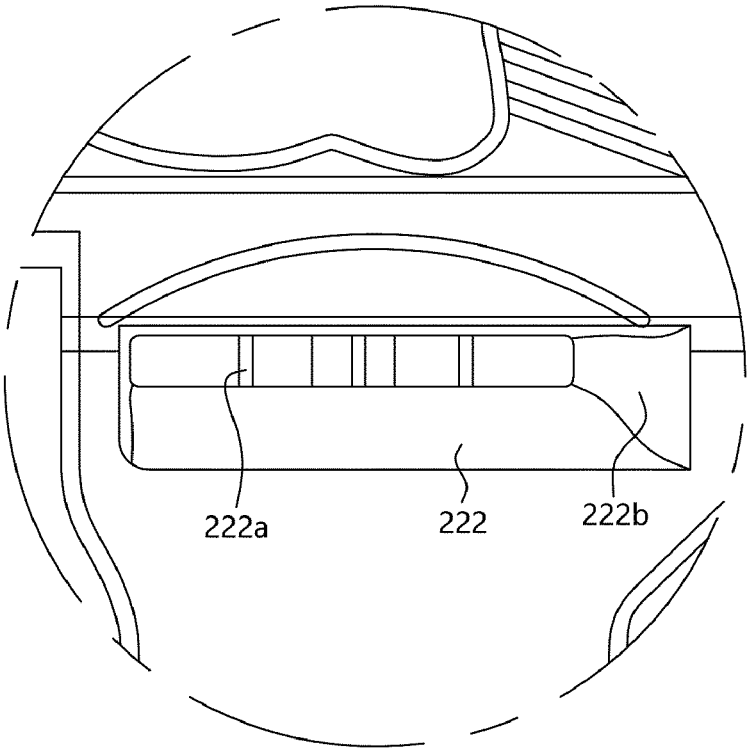
FIG. 28 is an enlarge view showing part "E" in FIG. 26.
Figure 29:
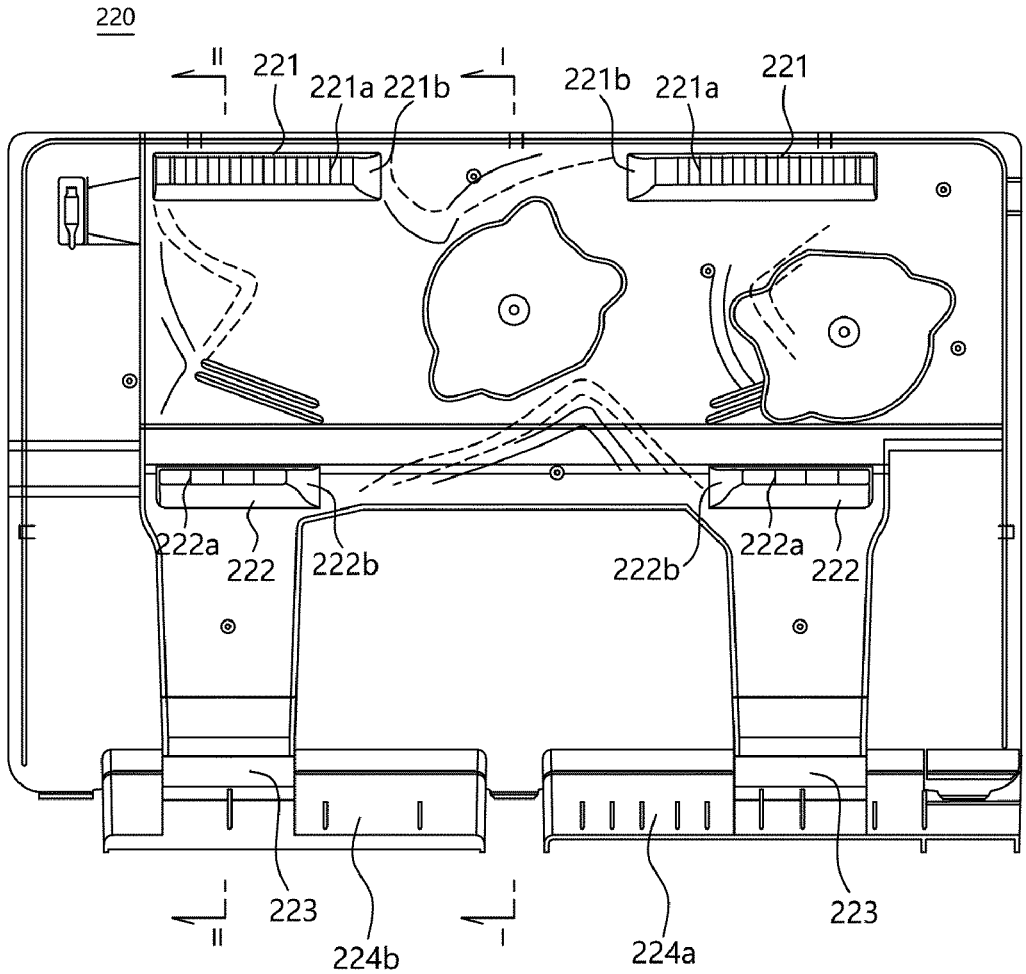
FIG. 29 is a rear view showing the shroud of the freezing compartment side grille fan assembly of the refrigerator according to the embodiment of the present disclosure.
Figure 30:
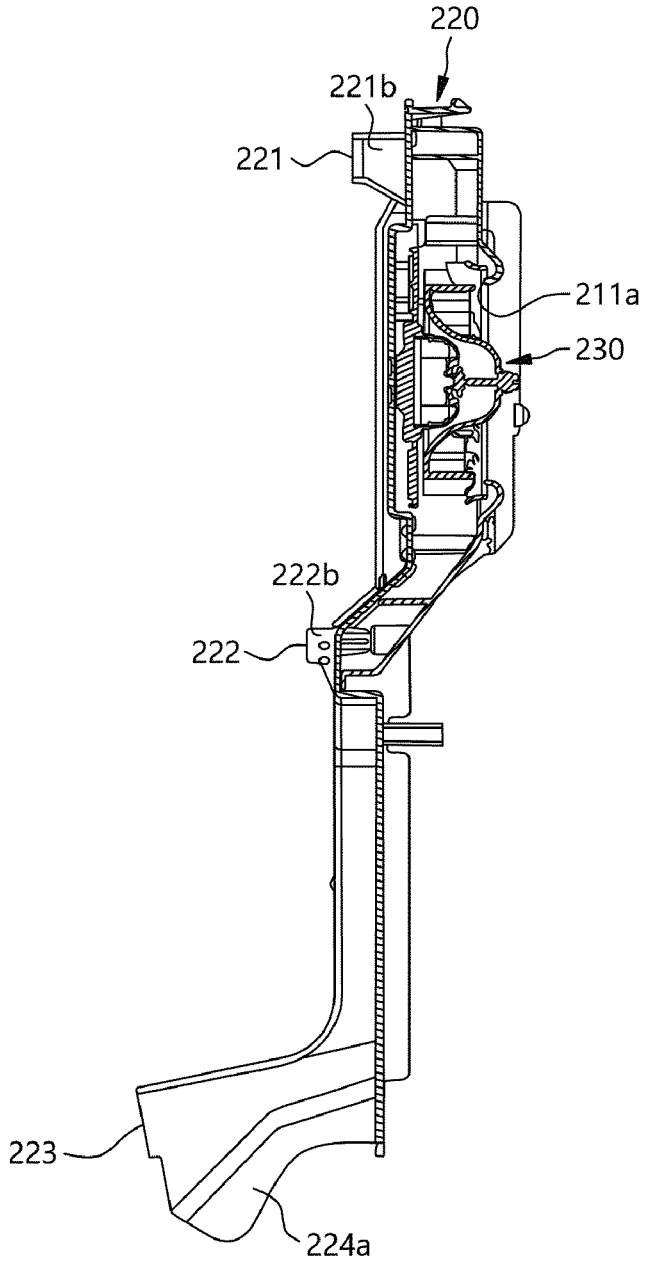
FIG. 30 is a sectional view taken along line I-I in FIG. 29.
Figure 31:
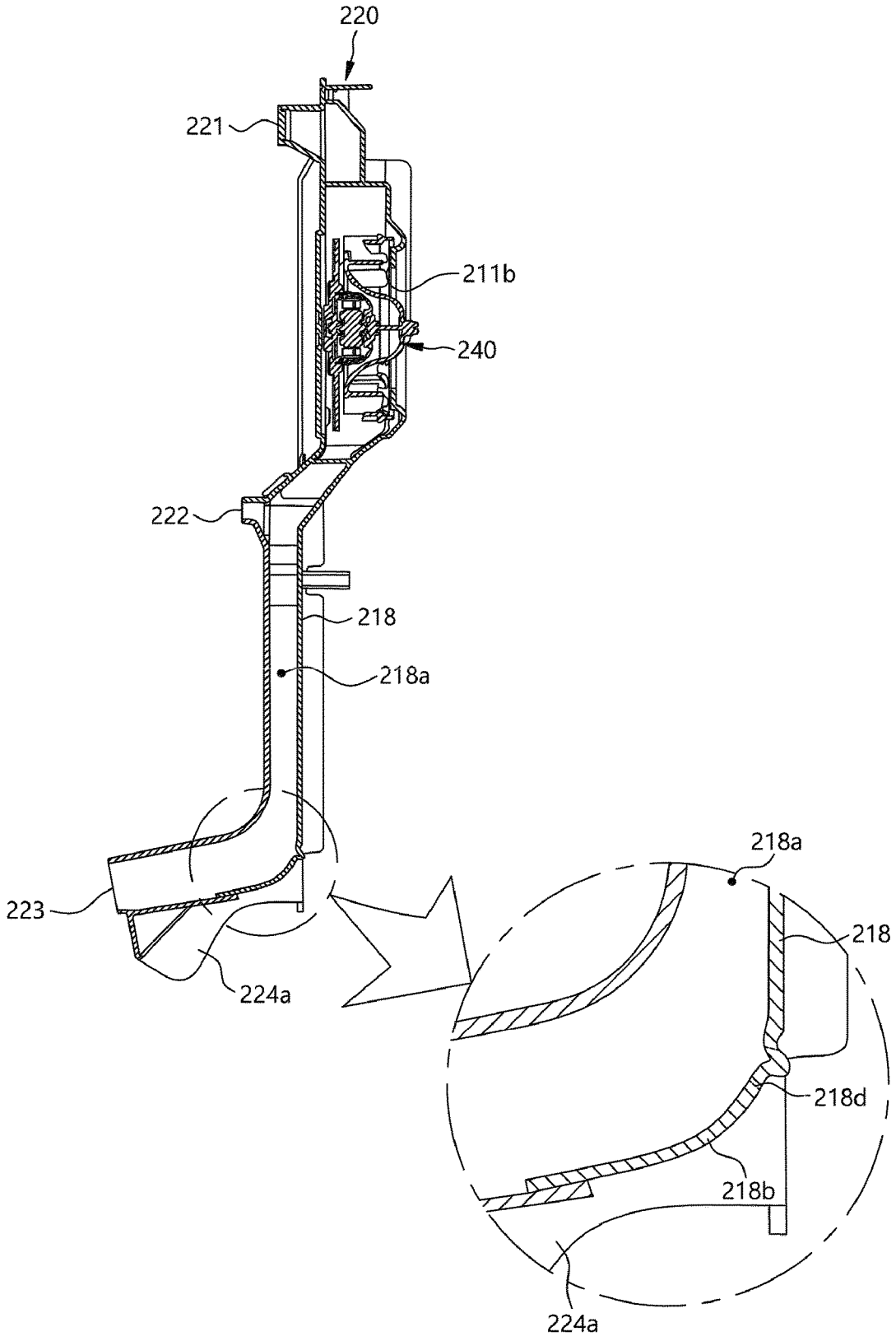
FIG. 31 is a sectional view taken along line II-II in FIG. 29.

As shown in FIGS. 23 and 24, the cool air flow path 213 for the ice-making compartment may be defined by flow path ribs 213*a* and 213*b* protruding to the front surface of the shroud 210 (shown in FIG. 24). The cool air flow path 214 for the freezing compartment may be formed of the rest of the front surface of the shroud 210 excluding the cool air flow path 213 for the ice-making compartment.

In particular, the flow path rib 213*a*, 213*b* may protrude from the front surface of the shroud 210 to form each wall surfaces in the cool air flow path 213 for the ice making compartment. That is, cool air introduced while passing through the second inlet hole 211*b* is guided to a connection portion to the cool air duct 51 for the ice-making compartment along the cool air flow path 213 for the ice making compartment formed by the flow path ribs 213*a* and 213*b*.

The flow path rib 213*a*, 213*b* includes a first circumferential flow path rib 213*a* and a second circumferential flow path rib 213*b* that may be formed along a circumference of the second inlet hole 211*b*. The portion where the second inlet hole 211*b* is provided may be partitioned from the cool air flow path 214 for the freezing compartment by the two circumferential flow path ribs 213*a* and 213*b*. The cool air passing through the second inlet hole 211*b* may be blown along the cool air flow path 213 for the ice-making compartment provided by the flow path rib 213*a*, 213*b* into the cool air duct 51 for the ice-making compartment.

The first circumferential flow path rib 213*a* may be configured to cross between the first inlet hole 211*a* and the second inlet hole 211*b* in the front surface of the shroud 210. That is, as the first circumferential flow path rib 213*a* is configured to block between the ice-making fan module 240 and the freezing fan module 230, the cool air provided from the freezing fan module 230 is prevented from being directly discharged through a cool air outlet of the cool air flow path 213 for the ice-making compartment.

In addition, the first circumferential flow path rib 213*a* may be rounded to surround a part of a circumference at one side (a side of the freezing fan module is located) of the ice-making fan module 240. Accordingly, the cool air blown in the radial direction of the ice-making fan 241 by the operation of the ice-making fan 241 may flow in a circumferential direction of the ice-making fan 241 by guidance of the first circumferential flow path rib 213*a*, and the cool air may flow toward the communication portion with the cool air duct 51 for the ice-making compartment.

The second circumferential flow path rib 213*b* may be configured to surround a lower circumference of a portion where the ice-making fan module 240 is installed, in the front surface of the shroud 210. That is, the second circumferential flow path rib 213*b* may divide the lower portion of the ice-making fan module 240 from the center portion between the ice-making fan module 240 and the freezing fan module 230.

In addition, the second circumferential flow path rib 213*b* may be rounded to surround the lower circumference of the ice-making fan module 240.

The shroud 210 may have a linear flow path rib 213*c* in addition to the two circumferential flow path ribs 213*a* and 213*b*.

The linear flow path rib 213*c* may be formed by protruding from a lower end of the second circumferential flow path rib 213*b* (an end opposite to the side where the first circumferential flow path rib is located) to penetrate through one side wall surface of the shroud 210 to the outside of the shroud.

The cool air flow path 213 for the ice-making compartment may have a predetermined length of flow path due to the linear flow path rib 213*c* and the protruding structure of the linear flow path rib 213*c*. Accordingly, cool air flowing in a circumferential direction along the two circumferential flow path ribs 213*a* and 213*b* may be forcibly supplied with the straightness to the cool air duct 51 for the ice-making compartment connected to the freezing compartment side grille fan assembly 2.

The linear flow path rib 213*c* may be formed by bending (recessing or protruding) an edge portion of the shroud 210. In addition, the linear flow path rib 213*c* may be formed in a rib protruding from a surface of the shroud 210, such as the two circumferential flow path ribs 213*a* and 213*b*, as described above.

In addition, the first circumferential flow path rib 213*a* may be formed to be spaced apart from the second circumferential flow path rib 213*b*. That is, an upper shared flow path 215*a* through which the cool air flows is may be formed as the first circumferential flow path rib 213*a* and the second circumferential flow path rib 213*b* are spaced apart from each other.

The upper shared flow path 215*a* may allow some of cool air flowing in the cool air flow path 213 for the ice-making compartment to be supplied to an upper portion of the cool air flow path 214 for the freezing compartment to be supplied to the upper section of the freezing compartment 12 through the cool air outlet 221 for the upper section.

When the freezing fan 231 and the ice-making fan 241 are operated at the same time, some of cool air blown by the ice-making fan 241 is supplied to the freezing compartment 12, so that rapid temperature control in the freezing compartment 12 may be achieved.

In addition, when only the ice-making fan 241 is operated, the pressure at the second inlet hole 211*b* where the ice-making fan 241 is located is relatively lowered than the pressure at the first inlet hole 211*a*, so there may be a problem that cool air in the freezing compartment 12 passes through the cool air flow path 214 for the freezing compartment to flow into a portion with the second evaporator 42 through the first inlet hole 211*a* and to be introduced into the cool air flow path 213 for the ice-making compartment through the second inlet hole 211*b*. However, as the upper shared flow path 215*a* is provided, even when only the ice-making fan 241 is operated, sharing cool air between the cool air flow path 214 for the freezing compartment and the cool air flow path 213 for the ice-making compartment reduces the pressure difference between the two flow paths 213 and 214. Accordingly, cool air in the freezing compartment 12 may be prevented from flowing back into the cool air flow path 213 for the ice-making compartment.

In particular, the upper shared flow path 215*a* may be formed to face an upper side of the portion where the first inlet hole 211*a* is formed. Considering that the cool air outlet 221 for the upper section of the grille panel 220 to be described below is formed on the upper side of the portion with the first inlet hole 211*a*, the upper shared flow path 215*a* is formed to face the cool air outlet 221 for the upper section, so that some of the cool air flowing in the cool air flow path 213 for the ice-making compartment may be efficiently supplied to the freezing compartment 12.

Furthermore, an upper end of the second circumferential flow path rib 213*b* may be located higher than the first inlet hole 211*a* (referring to FIG. 24). In other words, cool air flowing in the circumferential direction of the ice-making fan 241 due to rotation of the ice-making fan 241 may be prevented from being directly blown toward the upper shared flow path 215*a* between the first and second circumferential flow path ribs 213*a* and 213*b*.

However, when the upper end of the second circumferential flow path rib 213*b* is located lower than the first inlet hole 211*a*, the cool air blown from the freezing fan 231 may hit and provide interference with the air discharged from the upper shared flow path 215*a* while being provided into the upper shared flow path 215*a* between the first circumferential flow path rib 213*a* and the second circumferential flow path rib 213*b*. Therefore, the upper end of the second circumferential flow path rib 213*b* may be located higher than the first inlet hole 211*a*, so that collision between the cool air discharged from the upper shared flow path 215*a* and the cool air blown by the freezing fan 231 may be prevented.

Meanwhile, a cool air inlet side portion (a circumferential portion of the first inlet hole) of the cool air flow path 213 for the ice-making compartment may be divided into a plurality of areas 216*a*, 216*b*, and 216*c* for inflow of cool air (referring to FIG. 24).

That is, the cool air flow path 213 for the ice-making compartment may be configured as three areas as follow. A first area 216*a* may be located at each of a portion between the first circumferential flow path rib 213*a* and the ice-making fan module 240 and a portion between the second circumferential flow path rib 213*b* and the ice-making fan module 240. A second area 216*b* may be located between a lower surface of the ice-making fan module 240 and the second circumferential flow path rib 213*b*. A third area 216*c* may be located between an upper surface of the ice-making fan module 240 and the first circumferential flow path rib 213*a* and communicate with a cool air outlet side portion of the cool air flow path 213 for the ice-making compartment.

In particular, the first area 216*a* may communicate with the upper shared flow path 215*a*, the second area 216*b* may communicate with the lower shared flow path 215*b*, and the third area 216*c* may communicate with the cool air outlet side of the cool air flow path 213 for the ice-making compartment. The lower shared flow path 215*b* may be configured to guide cool air supply to a bottom side in the cool air flow path 214 for the freezing compartment, and to supply cool air to the freezing compartment 12 during the single operation of the ice-making fan 241 to relieve the pressure difference between the cool air flow path 214 for the freezing compartment (or, freezing compartment) and the cool air flow path 213 for the ice-making compartment.

In addition, the third area 216*c* may be configured to supply the amount of cool air that is approximately equal to the sum of the supply amounts of cool air of the first area 216*a* and the second area 216*b*. The second area 216*b* may be configured to supply a relatively larger amount of cool air than the first area 216*a*. That is, approximately half of the entire cool air blown by the operation of the ice-making fan 241 may be supplied to the ice-making compartment 21 through the third area 216*c*, and the other half may be supplied to the cool air flow path 214 for the freezing compartment through the first area 216*a* and the second area 216*b*.

The cool air supplied to the first area 216*a* may be discharged toward an upper space in the cool air flow path 214 for the freezing compartment through the upper shared flow path 215*a*. The cool air supplied to the second area 216*b* may be discharged toward a lower space in the cool air flow path 214 for the freezing compartment through the lower shared flow path 215*b*.

In addition, the above-described flow path ribs 213*a*, 213*b*, and 213*c* may be in close contact with a rear surface of the grille panel 220, which will be described below. Accordingly, the cool air flow path 213 for the ice-making compartment formed by the flow path ribs 213*a*, 213*b*, and 213*c* may be closed from the external environment of the freezing compartment side grille fan assembly 2.

Although not shown in the drawings, the cool air flow path 213 for the ice-making compartment may be formed by protruding from the rear surface of the grille panel 220 toward the front surface of the shroud 210.

Meanwhile, the cool air flow path 214 for the freezing compartment formed in the shroud 210 may be configured to guide the supply of cool air to the upper and middle sections in the freezing compartment 12.

An extension part 218 may be formed by protruding downward from opposite ends of a lower surface of the shroud 210. An extension flow path 218*a* communicating with the cool air flow path 214 for the freezing compartment may be provided at a front surface of the extension part 218, so that some of cool air flowing in the cool air flow path 214 for the freezing compartment may be introduced toward the lower section in the freezing compartment 12.

The extension flow path 218*a* (or the extension part) may be formed to extend downward from each of two portions facing two cool air outlets 222 for the middle section in the cool air flow path 214 for the freezing compartment to each of two portions facing two cool air outlets 223 for the lower section therein.

In addition, a bent end 218*b* bent forward may be formed on a lower end of the extension part 218, and a drainage hole 218*d* may be formed by penetrating through the bent end 218*b*. Condensed water falling into the extension flow path 218*a* through the drainage hole 218*d* may be drained to the outside of the freezing compartment side grille fan assembly 2.

A plurality of guides 217*a* and 217*b* may be formed on the front surface of the shroud 210.

That is, on the front surface of the shroud 210, the cool air flow path 213 for the ice-making compartment and the cool air flow path 214 for the freezing compartment may be separately formed by the flow path ribs 213*a*, 213*b*, and 213*c*. The cool air flow path 214 for the freezing compartment may be configured to evenly or selectively supply the cool air to each portion of the shroud 210 (or the grille panel) by the guides 217*a* and 217*b*.

The guides 217*a* and 217*b* may include a first guide 217*a* guiding an upper flow of the cool air that passes through the first inlet hole 211*a* of the shroud 210 and is introduced into the gap defined between the grille panel 220 and the shroud That is, when the cool air blown in an upper direction of the freezing fan 231 by the rotation of the freezing fan 231 hits an upper wall surface 214*a* in the cool air flow path 214 for the freezing compartment, turbulence of the air flow may occur in the hit portion and thus the cool air flow may not be efficiently performed. Considering the above problem, the first guide 217*a* may be provided in the shroud, so that the cool air blown toward the upper side of the freezing fan 231 may efficiently flow in opposite directions of the freezing fan 231.

The first guide 217*a* may be formed in an inclined or rounded inverted triangular structure that gradually expands to opposite sides thereof, as the first guide 217*a* goes upward from a portion adjacent to the first inlet hole 211*a* to the upper wall surface 214*a* in the cool air flow path 214 for the freezing compartment.

A lower end (lower vertex portion) of the first guide 217*a* may be located to be biased toward one side (a side opposite to the side where the cool air flow path for the ice-making compartment is located) front the center of the first inlet hole 211*a*. Therefore, more cool air that is rotatably blown in a circumferential direction of the freezing fan 231 may be supplied to a portion connected to the second end 52*b* of the recovery duct 52 for the ice-making compartment, in the opposite spaces in the freezing compartment 12.

In particular, it may be preferable that the lower end (lower vertex portion) of the first guide 217*a* is formed to be spaced apart from the first inlet hole 211*a* at a predetermined distance. Because of the above structure, when the first guide 217*a* is located excessively close to the first inlet hole 211*a*, a noise from cool air flow may be severely generated when the freezing fan 231 is rotated.

Furthermore, the guides 217*a* and 217*b* may include a second guide 217*b* that guides a lower flow of the cool air passing through the first inlet hole 211*a* of the shroud 210 and flowing into the gap defined between the grille panel 220 and the shroud 210.

That is, when the cool air blown in a lower direction of the freezing fan 231 by the rotation of the freezing fan 231 hits a lower wall surface in the cool air flow path 214 for the freezing compartment, turbulence of the air flow may occur in the hit portion and the flow of the cool air is not efficiently performed. Considering the above problem, the second guide 217*b* is provided in the shroud, so that the cool air blown to the lower side of the freezing fan 231 may efficiently flow in the opposite directions of the freezing fan 231.

The second guide 217*b* may be formed in an inclined or rounded triangular structure that gradually expands to opposite sides thereof, as the second guide 217*b* goes downward from a portion adjacent to the first inlet hole 211*a* to the lower wall surface in the cool air flow path 214 for the freezing compartment.

An upper end (upper vertex portion) of the second guide 217*b* may be located to be biased toward another side (the side where the cool air flow path for the ice-making compartment is located) from the center of the first inlet hole 211*a*.

Therefore, the cool air blown while being rotated in the circumferential direction of the freezing fan 231 may be sufficiently supplied to not only the middle section in the freezing compartment 12 but also the lower section therein.

In particular, it may be preferable that the upper end (upper vertex portion) of the second guide 217*b* is formed to be spaced apart from the first inlet hole 211*a* at a predetermined distance. Because of the above structure, when the second guide 217*b* is located excessively close to the first inlet hole 211*a*, a noise from cool air flow may be severely generated when the freezing fan 231 is rotated.

The front surface of the shroud 210 may have a third guide 217*c*.

That is, when the cool air blown in a side direction (a direction opposite to the side with the ice-making fan) of the freezing fan 231 hits a side wall surface (a wall surface opposite to the side with the ice-making fan) of the cool air flow path 214 for the freezing compartment, turbulence of air flow may occur in the hit portion and the flow of the cool air is not efficiently performed. Considering the above problem, the third guide 217*c* is provided in the shroud, so that the cool air blown in the side direction of the freezing fan 231 may efficiently flow toward upper and lower sides of the freezing fan 231.

The third guide 217*c* may be formed in an inclined or rounded triangular structure that gradually expands upward and downward, as the third guide 217*c* goes from the side portion (the portion opposite to the side with the ice-making fan) of the first inlet hole 211*a* to a side wall surface of the cool air flow path 214 for the freezing compartment.

The freezing compartment side grille fan assembly 2 may include the grille panel 220.

The grille panel 220 may constitute a front wall surface of the freezing compartment side grille fan assembly 2, and be located in front of the shroud 210.

Further, the grille panel 220 may have a plurality of cool air outlets 221, 222, and 223.

The cool air outlets 221, 222, and 223 may include the cool air outlet 221 for the upper section for discharging the cool air to the upper section of the freezing compartment 12, the cool air outlet 222 for the middle section for discharging the cool air to the middle section of the freezing compartment 12, and the cool air outlet 223 for the lower section for discharging the cool air to the lower section of the freezing compartment 12, as shown in FIGS. 26 and 29 to 31.

In particular, the cool air outlet 221 for the upper section may be configured as two cool air outlets that are respectively formed at opposite sides of an upper portion of the portion where the freezing fan 231 is located. The cool air outlet 222 for the middle section may be configured as two cool air outlets that are respectively formed at opposite sides of a lower portion of the portion where the freezing fan 231 is located. The cool air outlet 223 for the lower section may be configured as two cool air outlets that are respectively formed below the two cool air outlets 222 for the middle section.

In addition, the cool air outlets 221 and 222 may be formed in tube bodies protruding into the freezing compartment 12. A wall surface 221*b*, 222*b*, which is positioned adjacent to the freezing fan 231, of opposite side wall surfaces of each of the cool air outlets 221 and 222 may be formed to be inclined or rounded toward another wall surface of the opposite wall surfaces (referring to FIGS. 26 and 29).

This structure is provided to guide cool air flowing in the circumferential direction of the freezing fan 231 during operation of the freezing fan 231 to flow into the cool air outlet 221 for the upper section and the cool air outlet 222 for the middle section. That is, the cool air is blown while being rotated in the circumferential direction of the freezing fan 231, but the cool air outlet 221 for the upper section is formed to be perpendicular to a flow direction of the cool air. Therefore, a cool air inlet side portion of each of the cool air outlets 221 and 222 is formed to be inclined or rounded, so that the cool air may efficiently flow into each of the cool air outlets 221 and 222.

Furthermore, the cool air outlets 221 and 222 have a plurality of grilles 221*a* and 222*a* guiding the discharge direction of the cool air. At least a portion of each grille 221*a*, 222*a* may be formed to be inclined toward a side wall surface of the freezing compartment 12 (referring to FIGS. 17 and 18).

That is, due to the above structure, cool air discharged from the cool air outlet 221 for the upper section may be discharged toward opposite side wall surfaces in the upper section in the freezing compartment 12, and then may flow to the front in the upper section in the freezing compartment 12 along the opposite side wall surfaces in the upper section. In addition, cool air discharged from the cool air outlet 222 for the middle section may be discharged toward opposite side wall surfaces in the middle section in the freezing compartment 12 and then may flow to the front in the freezing compartment 12 along the opposite side wall surfaces in the middle section. Accordingly, the cool air may be sufficiently supplied to the stored item in the freezing compartment door 30*a*, 30*b*.

Furthermore, the grille panel 220 has suction guides 224*a* and 224*b* guiding the recovery flow of the cool air flowing in the freezing compartment 12. The suction guides 224*a* and 224*b* may be provided in lower ends of the grille panel 220 and be configured to allow the cool air recovered after circulation in the freezing compartment 12 to flow into a lower end of the second evaporator 42.

Each of the suction guides 224*a* and 224*b* may be formed to be inclined (or rounded) at the same angle (or similar) as an angle of a wall constituting the rear side bottom in the freezing compartment 12, as the suction guide goes to the lower end thereof. That is, the cool air flowing along a lower surface of the freezing compartment 12 may be guided by the suction guides 224*a* and 224*b* to efficiently flow to the lower end of the second evaporator 42.

In particular, the suction guides 224*a* and 224*b* includes the first suction guide 224*a*, which may be provided in one side in the lower ends of the grille panel 220 on the basis of the center portion of the grille panel 220, the side where the second end 52*b* of the recovery duct 52 for the ice-making compartment is located. The suction guides 224*a* and 224*b* includes a second suction guide 224*b*, which may be provided another side in the lower ends of the grille panel 220 on the basis of the center portion of the grille panel 220, the side being opposite to the first suction guide 224*a*. That is, cool air flowing through one space (a space communicating with the second end of the recovery duct for the ice-making compartment) in the freezing compartment 12 may be recovered through the first suction guide 224*a*, and cool air flowing through another space in the freezing compartment 12 may be recovered through the second suction guide 224*b*.

In addition, the first suction guide 224*a* may be formed to be open more than the second suction guide 224*b*, and the first suction guide 224*a* may be formed to have a transverse width larger than a transverse width of the second suction guide 224*b*. That is, among the two suction guides 224*a* and 224*b*, the first suction guide 224*a* at the side communicating with the recovery duct 52 for the ice-making compartment may be formed to be open more than the second suction guide 224*b* at the opposite side, so that cool air in a space at the relatively hot side in the both spaces in the freezing compartment 12 may be rapidly recovered.

The freezing compartment side grille fan assembly 2 includes the freezing fan module 230.

The freezing fan module 230 may be configured to blow cool air passing through the second evaporator 42 to the cool air flow path 214 for the freezing compartment.

The freezing fan module 230 may be located in the first inlet hole 211*a*.

Figure 32:
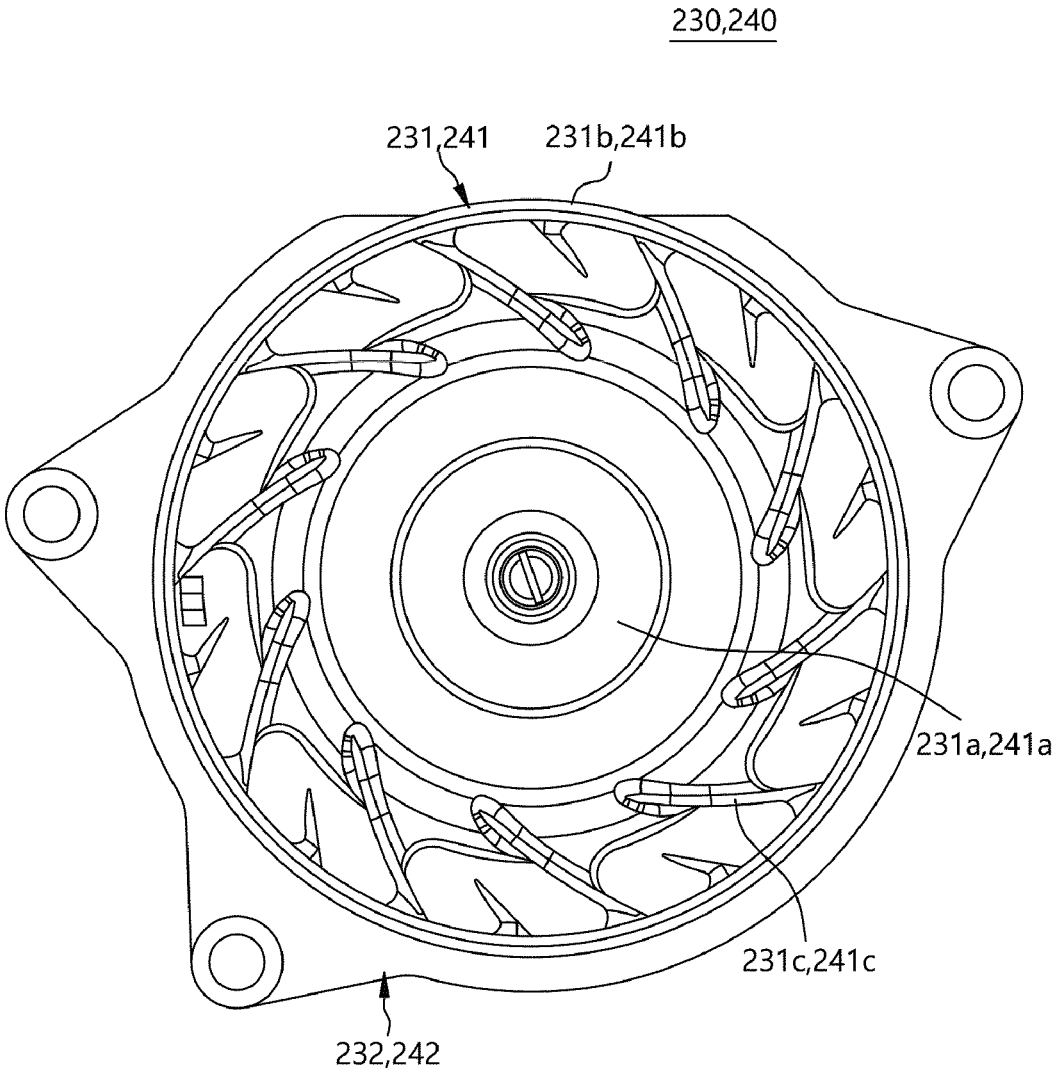
FIG. 32 is a front view showing each fan module of the refrigerator according to the embodiment of the present disclosure.
Figure 33:
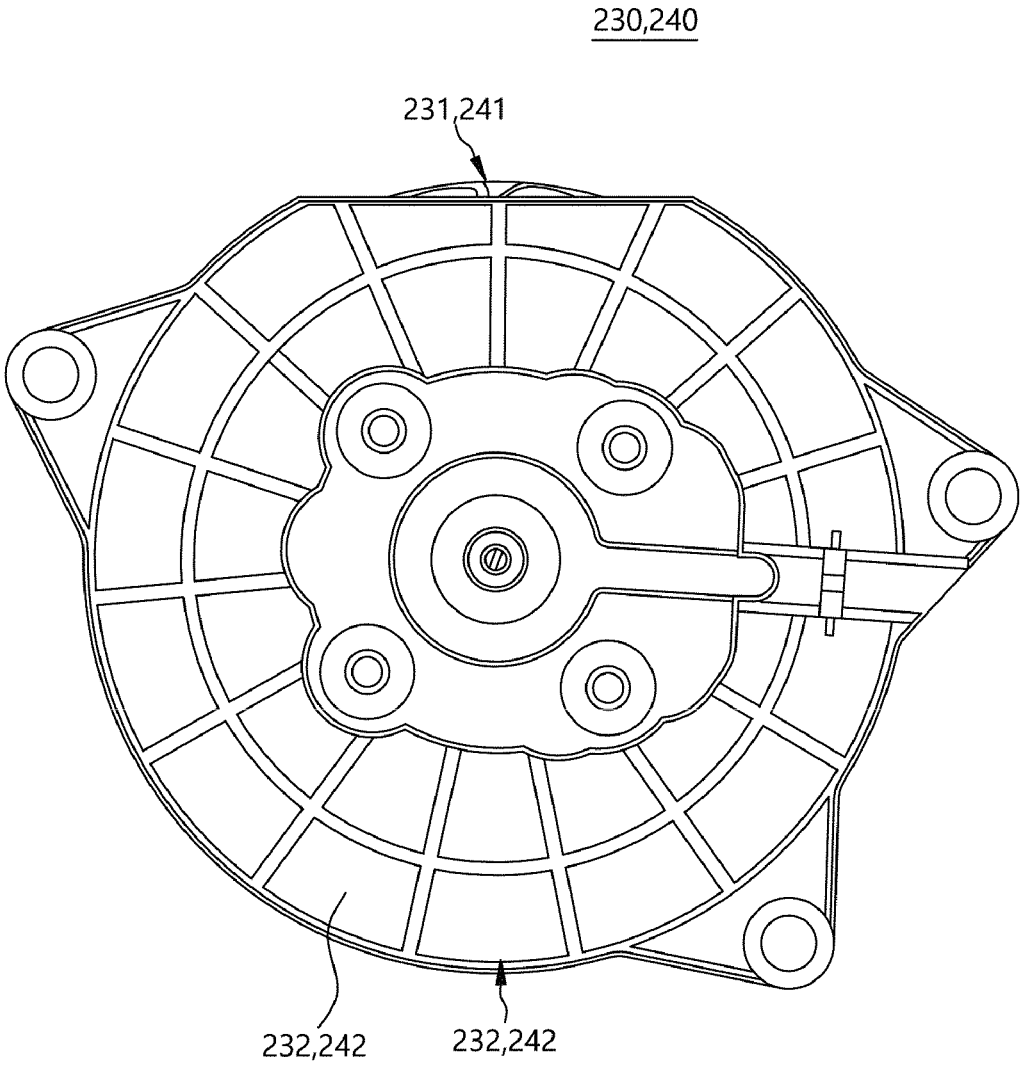
FIG. 33 is a rear view showing each fan module of the refrigerator according to the embodiment of the present disclosure.

As shown in FIGS. 32 and 33, the freezing fan module 230 includes the freezing fan 231 and a first installation frame 232.

The freezing fan module 230 may be formed in a slim centrifugal fan, so that the thickness (width in the front to rear direction) of the freezing compartment side grille fan assembly 2 may be reduced.

The freezing fan 231 may include a hub part 231*a*, a rim part 231*b*, and a plurality of impellers 231*c*.

The hub part 231*a* may be a portion shaft-coupled to a fan motor, and be formed by protruding forward (in a direction toward the cool air inlet side) as the hub part 231*a* goes to the center thereof, and be enlarged as the hub part 231*a* goes to a rear end thereof.

The rim part 231*b* may be formed to surround a circumference of the hub part 231*a*. The rim part 231*b* is formed in a cylindrical rim.

The impellers 231*c* may be provided to guide a blown direction of cool air. The impellers 231*c* may be arranged to be spaced apart from each other, and each of the impellers may be configured to allow cool air to pass through a gap defined between the impellers 231*c* while having a predetermined inclination (or curvature).

The first installation frame 232 is a portion where the freezing fan 231 is installed.

The first installation frame 232 may be configured to be coupled to a plurality of fastening ribs 212*a* formed in the shroud 210. The fastening ribs 212*a* may be respectively formed at positions in consideration of the size and wind direction of the freezing fan 231.

The freezing compartment side grille fan assembly 2 includes the ice-making fan module 240.

The ice-making fan module 240 may be configured to blow the cool air passing through the second evaporator 42 to the cool air flow path 213 for the ice-making compartment.

As shown in FIGS. 32 and 33, the ice-making fan module 240 includes a blowing fan 241 (Hereinbelow, the fan refers to "the ice-making fan") and a second installation frame 242.

The ice-making fan 241 may be formed in a slim centrifugal fan, so that the thickness (width in the front to rear direction) of the freezing compartment side grille fan assembly 2 may be reduced.

The ice-making fan 241 may include a hub part 241*a*, a rim part 241*b*, and a plurality of impellers 241*c*.

The hub part 241*a* may be shaft-coupled to a fan module, may be formed by protruding forward (in a direction toward the cool air inlet side) as the hub part 241*a* goes to the center thereof, and be enlarged as the hub part 241*a* goes to a rear end thereof.

The rim part 241*b* may be formed to surround a circumference of the hub part 241*a*. The rim part 241*b* may be formed in a cylindrical rim.

The impellers 241*c* may be provided to guide a blown direction of cool air. The impellers 241*c* may be arranged to be spaced apart from each other, and each of the impellers 241*c* may be configured to allow cool air to pass through a gap defined between the impellers while having a predetermined inclination (or curvature).

In particular, the ice-making fan 241 may be configured as a fan of the same structure and size as the freezing fan 231 of the blower fan module 230.

That is, the ice-making fan 241 and the freezing fan 231 (or, the ice-making fan module and the blower fan module) may be used in common, so that the standardization of product design may be realized by the common use of fan modules.

The second installation frame 242 is a portion where the ice-making fan 241 is installed.

The second installation frame 242 may be configured to be coupled to the plurality of the fastening ribs 212*a* formed in the shroud 210. The fastening ribs 212*a* may be respectively formed at the positions in consideration of the size and wind direction of the ice-making fan 241.

Figure 9:
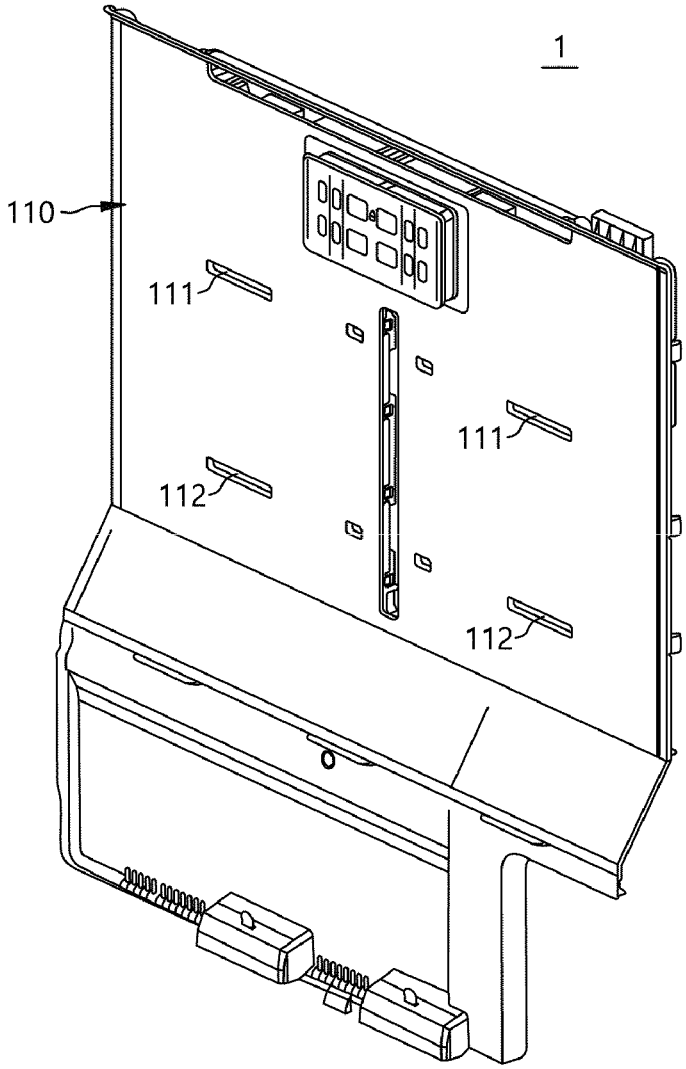
FIG. 9 is a front perspective view showing a refrigerating compartment side grille fan assembly of the refrigerator according to the embodiment of the present disclosure.
Figure 10:
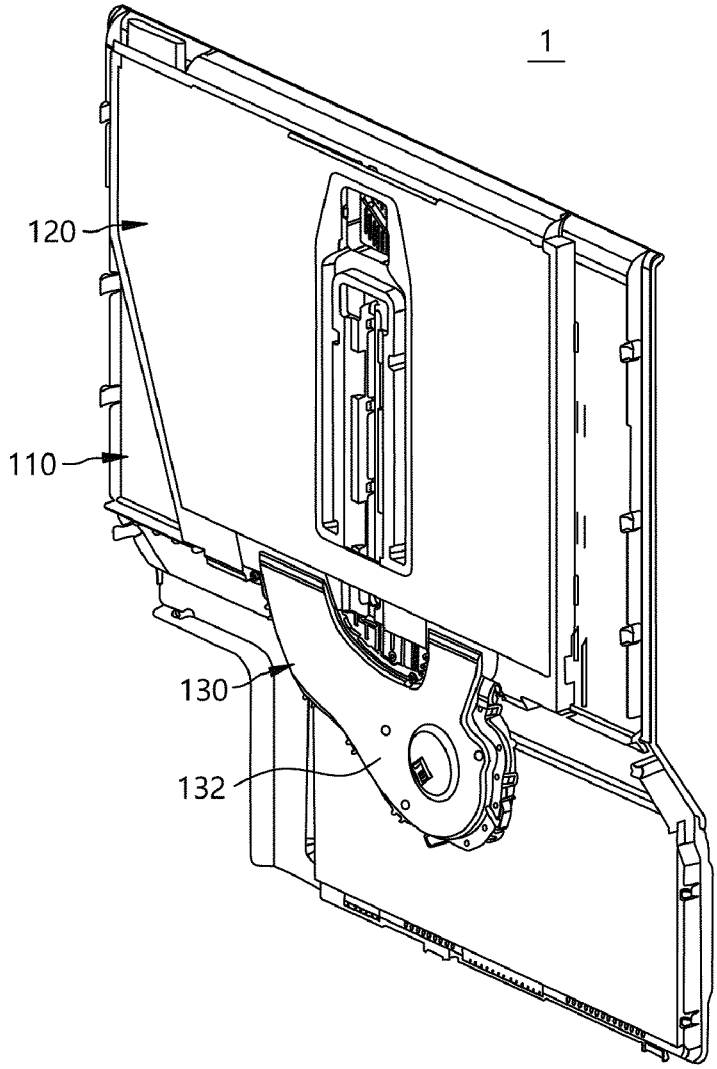
FIG. 10 is a rear perspective view showing the refrigerating compartment side grille fan assembly of the refrigerator according to the embodiment of the present disclosure.
Figure 11:
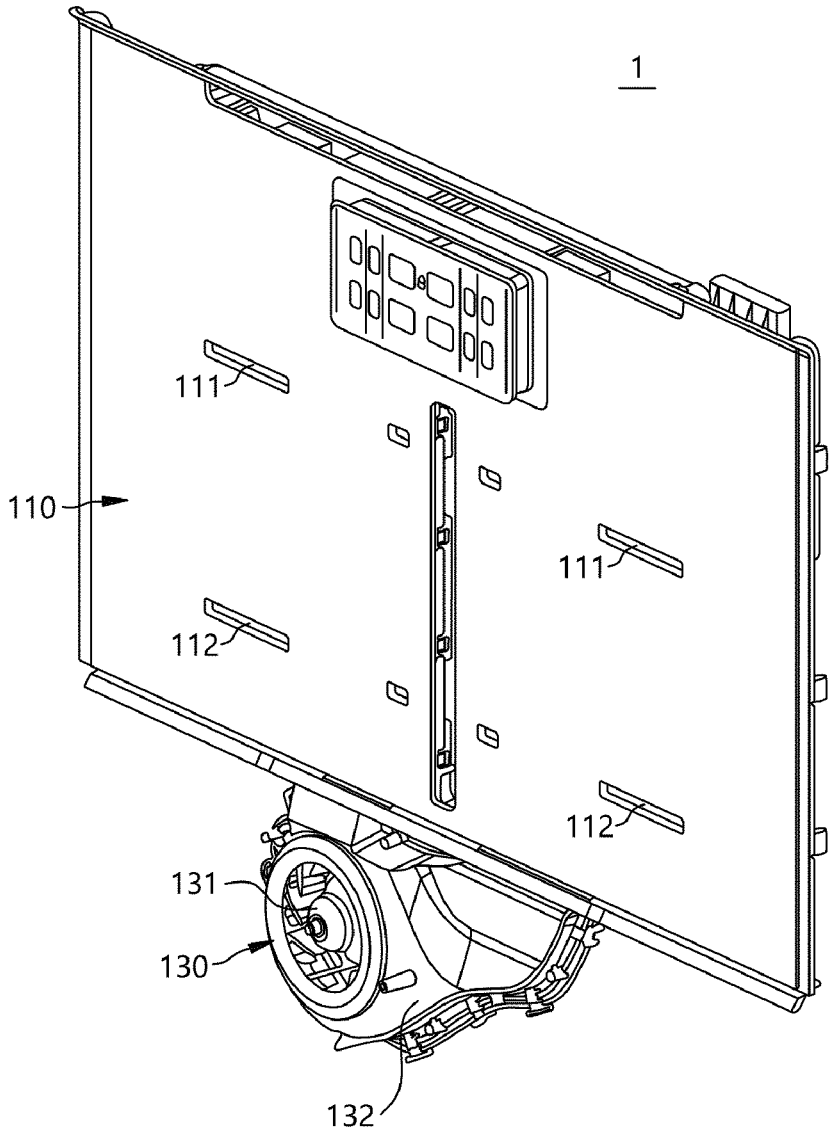
FIG. 11 is a front perspective view showing an installation state of a refrigerating fan module of the refrigerator according to the embodiment of the present disclosure.
Figure 12:
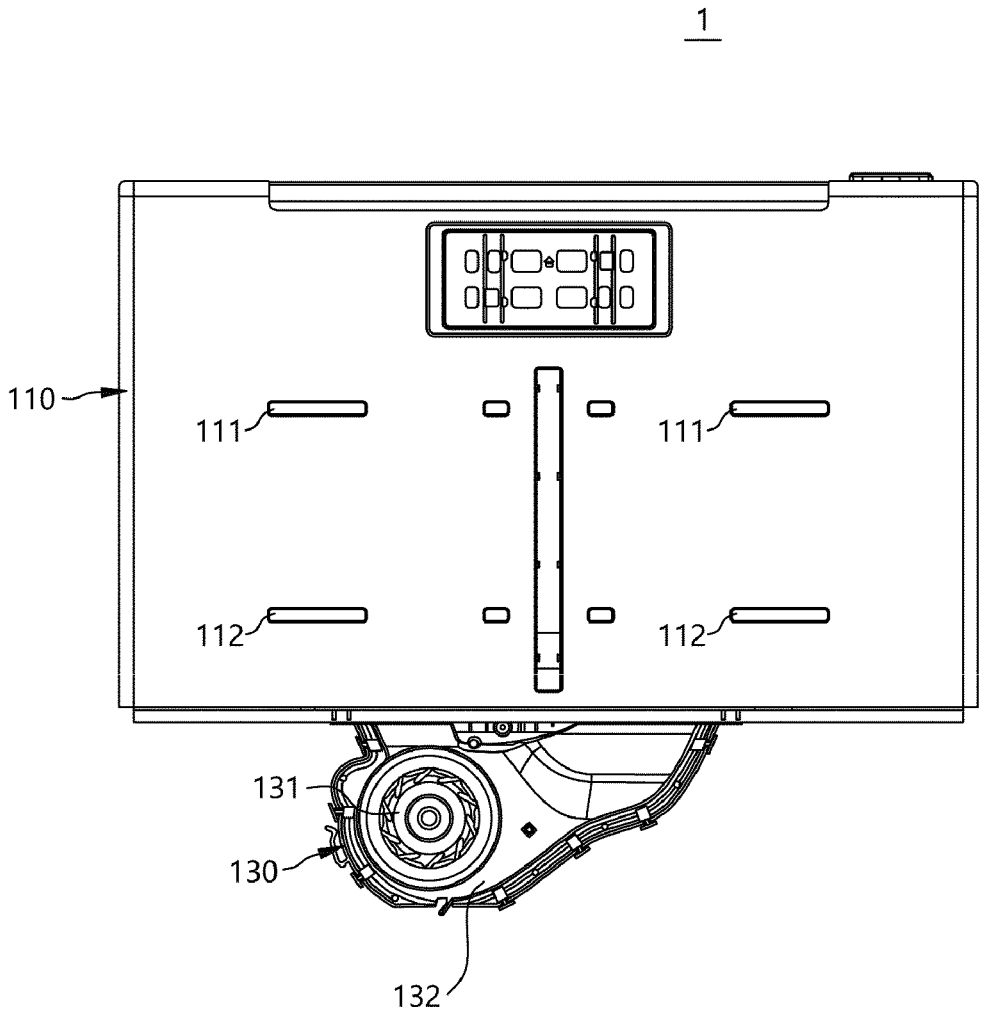
FIG. 12 is a front view showing the installation state of the refrigerating fan module of the refrigerator according to the embodiment of the present disclosure.
Figure 13:
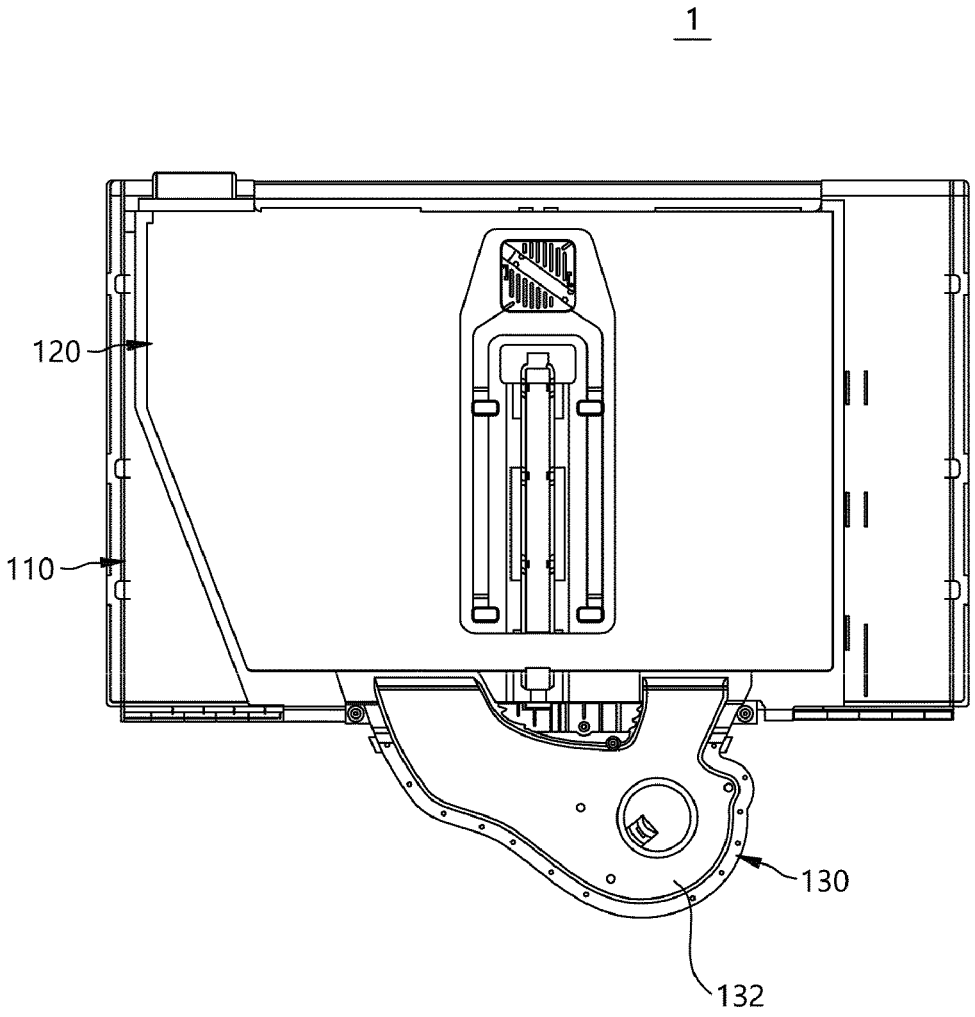
FIG. 13 is a rear view showing the installation state of the refrigerating fan module of the refrigerator according to the embodiment of the present disclosure.
Figure 14:
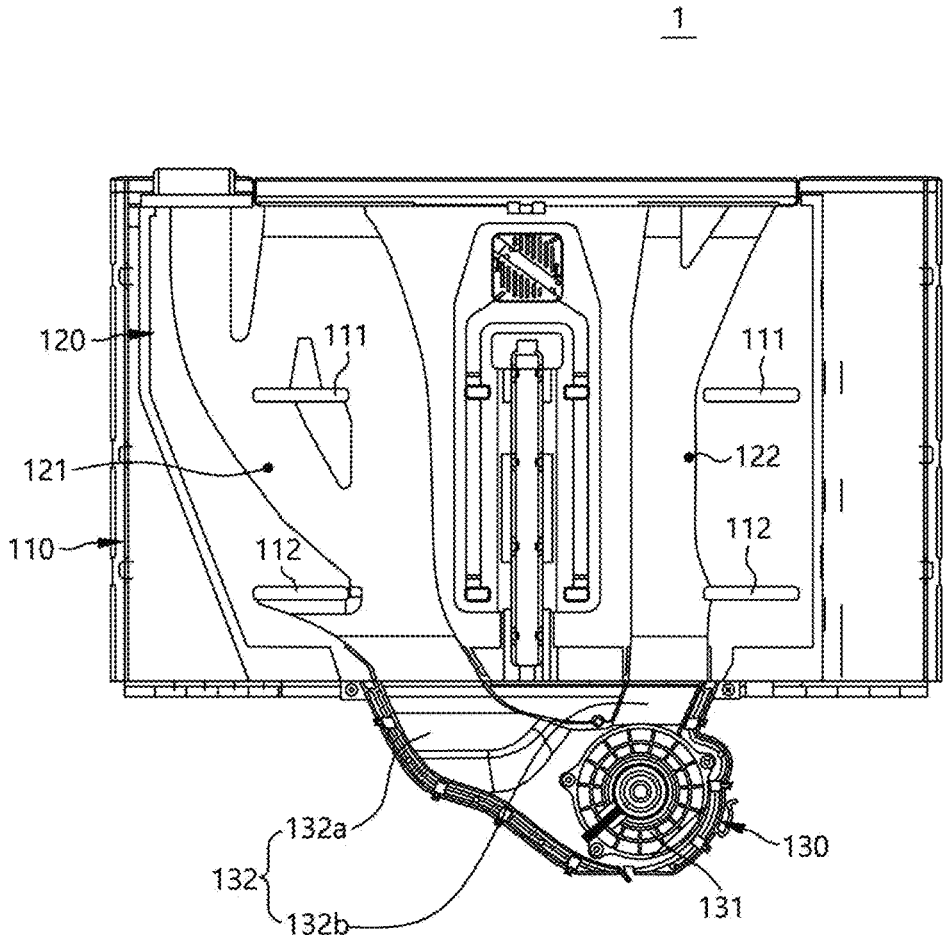
FIG. 14 is a rear view showing a structure of a cool air flow path for a refrigerating compartment of the refrigerator according to the embodiment of the present disclosure.
Figure 15:
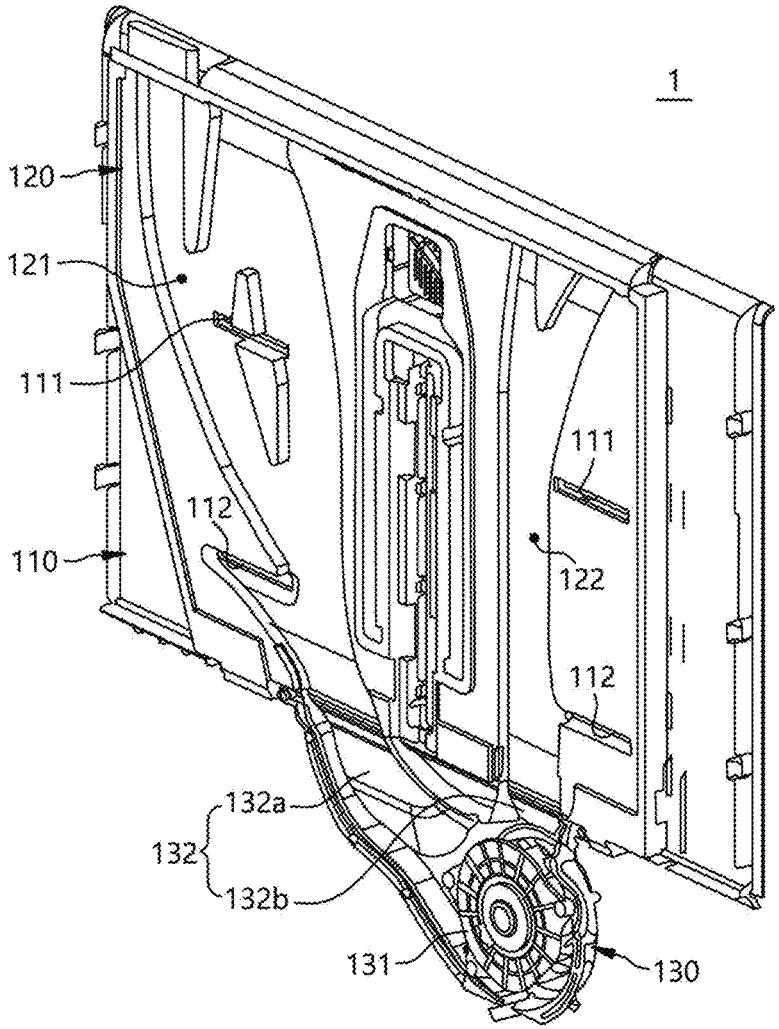
FIGS. 15 and 16 are perspective views taken from the rear, the views showing the structure of the cool air flow path for the refrigerating compartment of the refrigerator according to the embodiment of the present disclosure.
Figure 16:
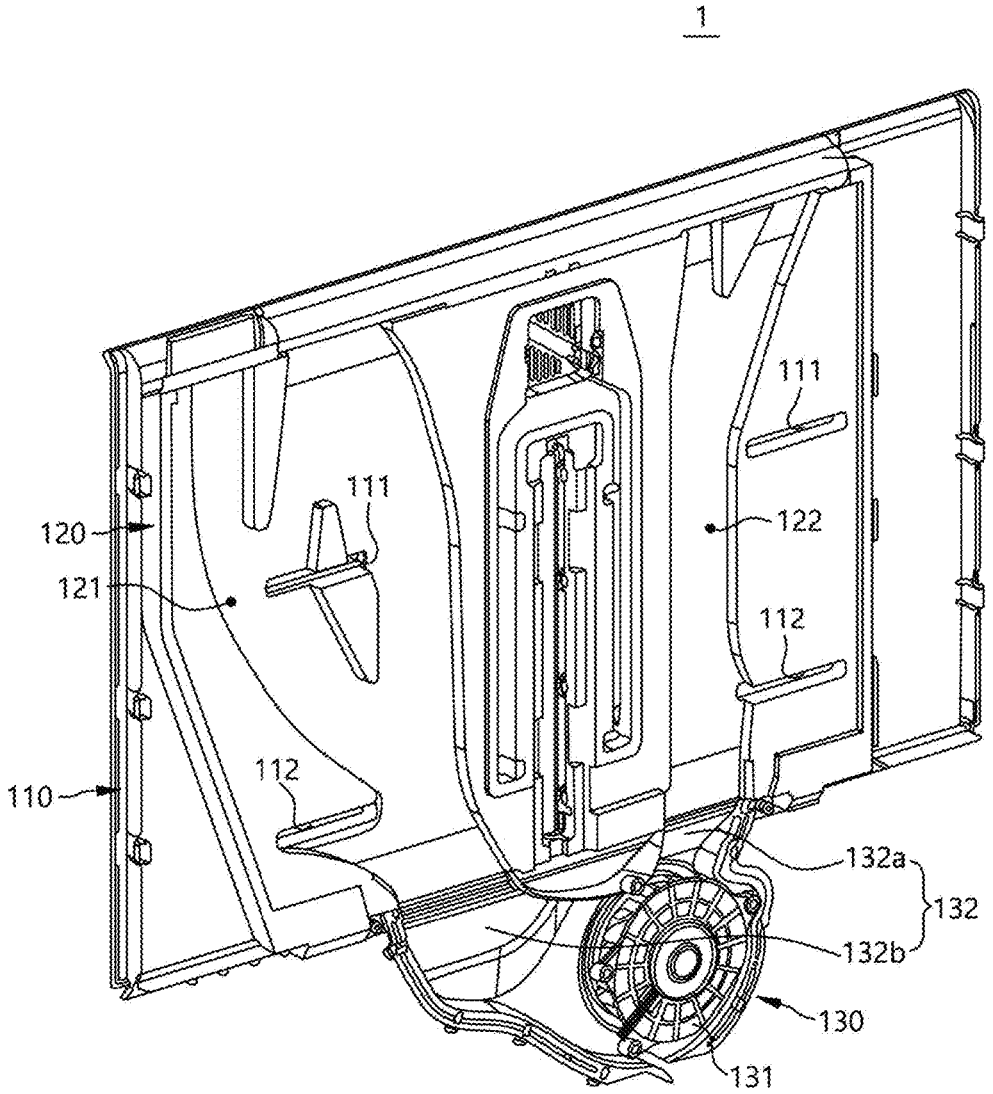
Figure 17:
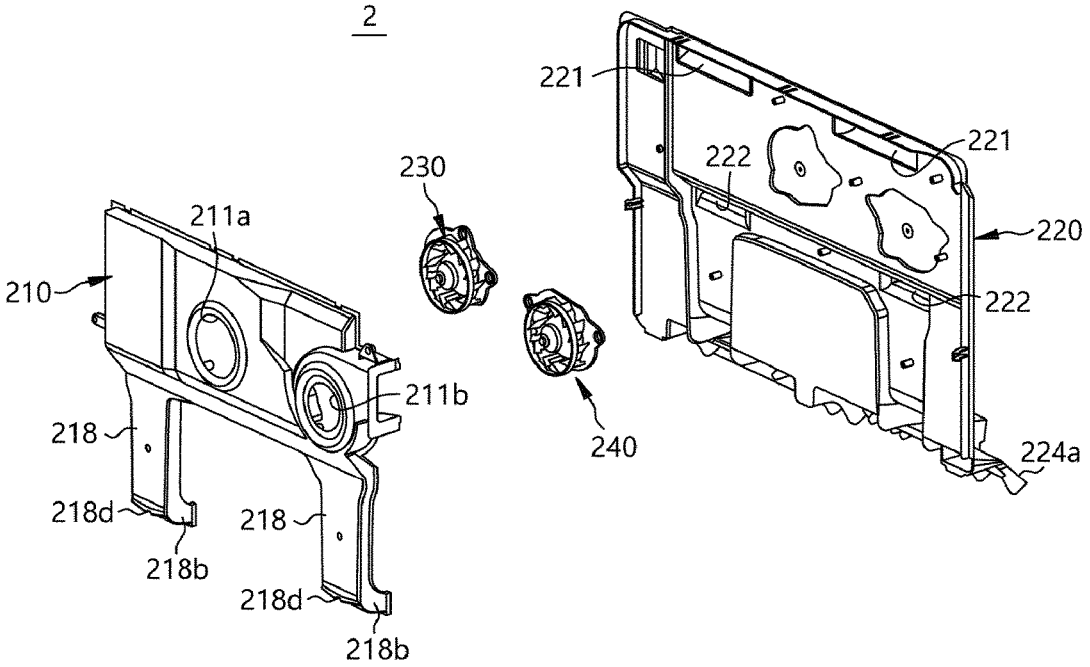
FIG. 17 is a perspective view showing a freezing compartment side grille fan assembly of the refrigerator according to the embodiment of the present disclosure.
Figure 18:
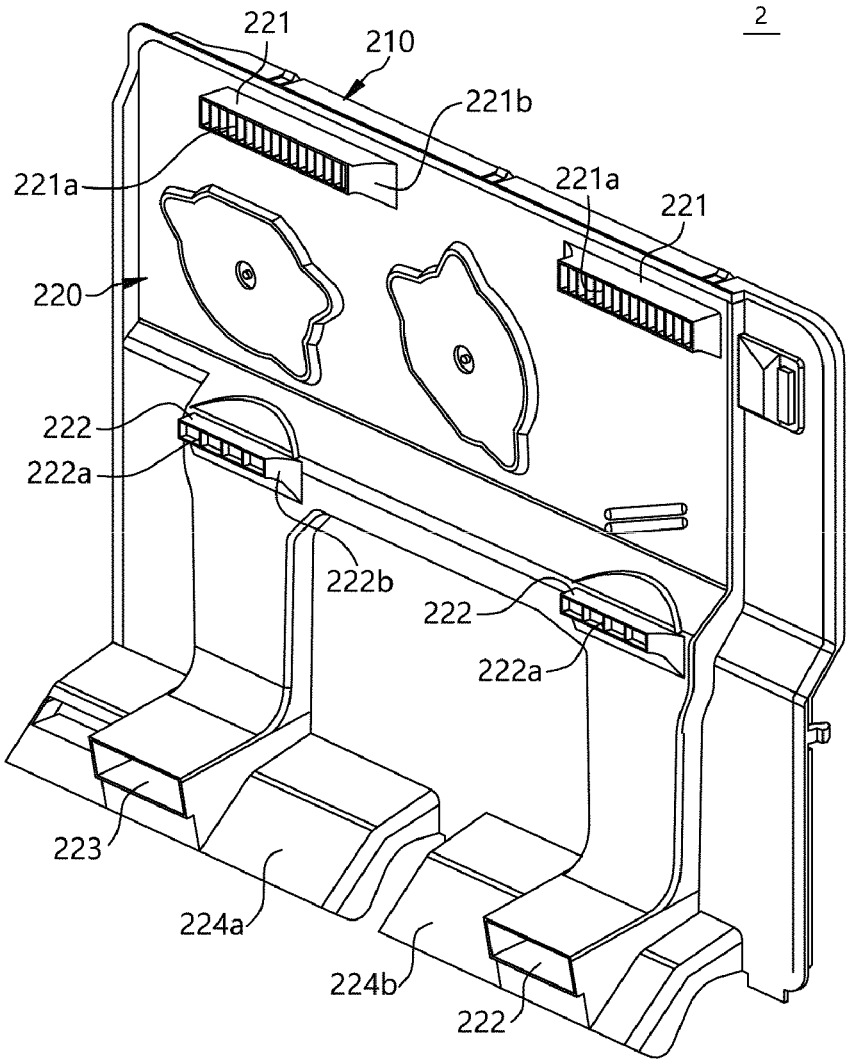
FIG. 18 is a perspective view showing a front coupling state of the freezing compartment side grille fan assembly of the refrigerator according to the embodiment of the present disclosure.
Figure 19:
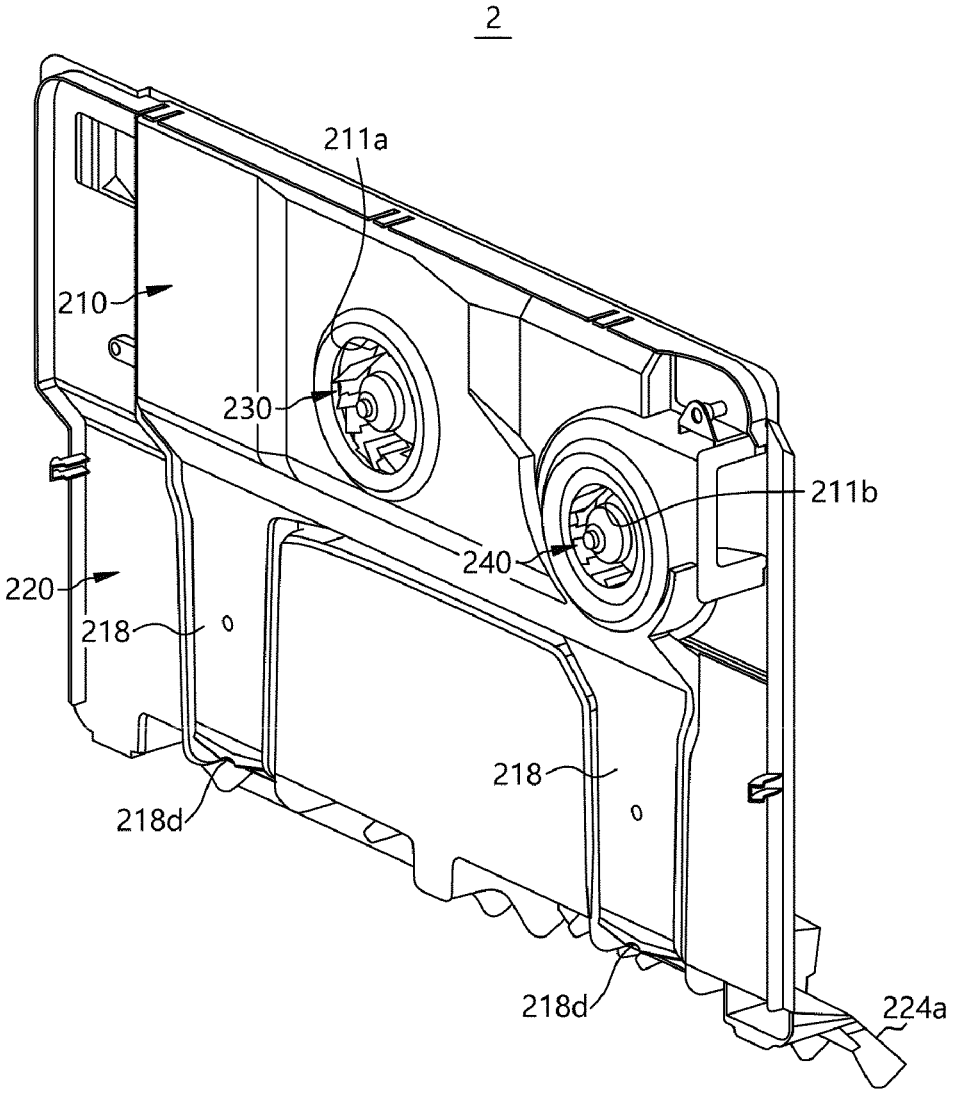
FIG. 19 is a perspective view showing a rear coupling state of the freezing compartment side grille fan assembly of the refrigerator according to the embodiment of the present disclosure.
Figure 20:
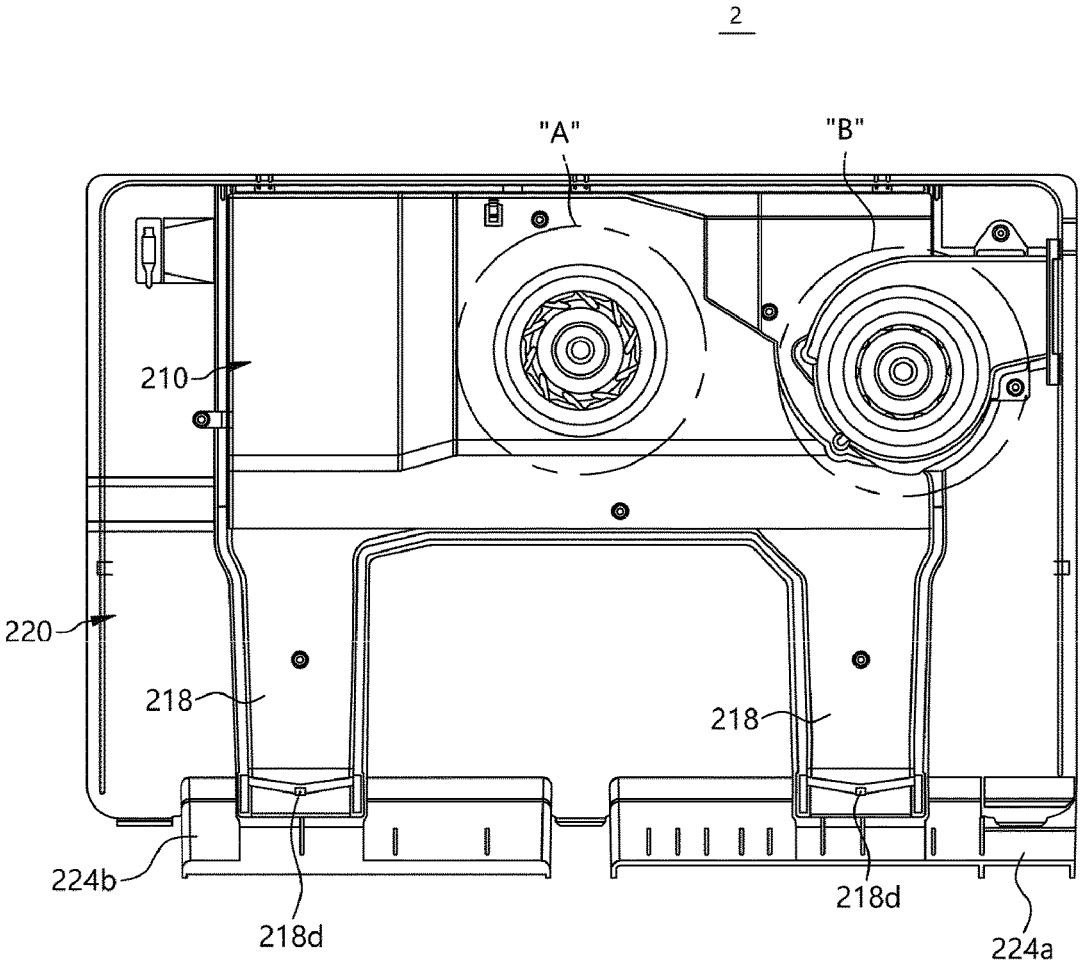
FIG. 20 is a rear view showing the freezing compartment side grille fan assembly of the refrigerator according to the embodiment of the present disclosure.

Meanwhile, the ice-making fan module 240 may be configured to be located closer to the freezing fan module 230 in comparison to the cool air outlet side of the cool air flow path 213 for the ice-making compartment (referring to FIG. 9). That is, as the ice-making fan 241 of the ice-making fan module 240 may be located to be spaced apart from the cool air outlet side (open portion) of the cool air flow path 213 for the ice-making compartment at a sufficient distance, the cool air passing through the cool air outlet side of the cool air flow path 213 for the ice-making compartment may be prevented from becoming turbulent caused when the cool air does not pass through the cool air outlet side due to the resistance of the flow of the cool air rotated along the rotational direction of the ice-making fan 241.

In addition, the ice-making fan 241 constituting the ice-making fan module 240 may be configured to be rotated at a higher rotation speed than a rotation speed of the freezing fan 231 constituting the freezing fan module 230.

That is, in the case of the freezing fan 231, since the freezing fan 231 supplies the cool air to the freezing compartment 12 in front of the freezing fan 231, the freezing fan may be rotated at a rotation speed sufficient to provide a large air volume. However, in the case of the ice-making compartment 21, since the ice-making compartment 21 is located relatively father than the freezing compartment 12, the ice-making fan 241 may be operated at a higher rotation speed than a rotation speed of the freezing fan 231, so that the cool air may be forcibly supplied to the ice-making compartment 2.

In addition, the center of the ice-making fan module 240 may be located lower than the center of the open portion at the cool air outlet side of the cool air flow path 213 for the ice-making compartment.

That is, based on the center portion of the ice-making fan 241, the cool air discharged upward may be guided to be supplied to the ice-making compartment 21 through the cool air flow path 213 for the ice-making compartment. Considering the above structure, the center portion of the ice-making fan 241 may be located lower than the center of the cool air outlet side of the cool air flow path 213 for the ice-making compartment (preferably, the lower surface of the cool air discharge portion), it is possible to allow the cool air blown from the ice-making fan 241 to be flow efficiently along the cool air flow path 213 for the ice-making compartment.

Hereinbelow, according to the embodiment of the present disclosure, the temperature control process for each storage compartment 11, 12, 21 of the refrigerator will be described in detail.

The temperature control process of the refrigerating compartment 11 will be described.

The temperature control of the refrigerating compartment 11 may be performed by the operations of the refrigerating fan module 130 and the compressor. That is, operation for controlling the temperature in the refrigerating compartment 11 may be performed by rotation of the refrigerating fan 131 due to power supply to the refrigerating fan module 130 and by heat-exchange of the first evaporator 41 due to operation of the compressor.

When the refrigerating fan 131 of the refrigerating fan module 130 is operated, air in the refrigerating compartment 11 may flow to pass through the first evaporator 41 by a blowing force of the refrigerating fan 131, and be heat-exchanged while passing through the first evaporator 41.

Figure 34:
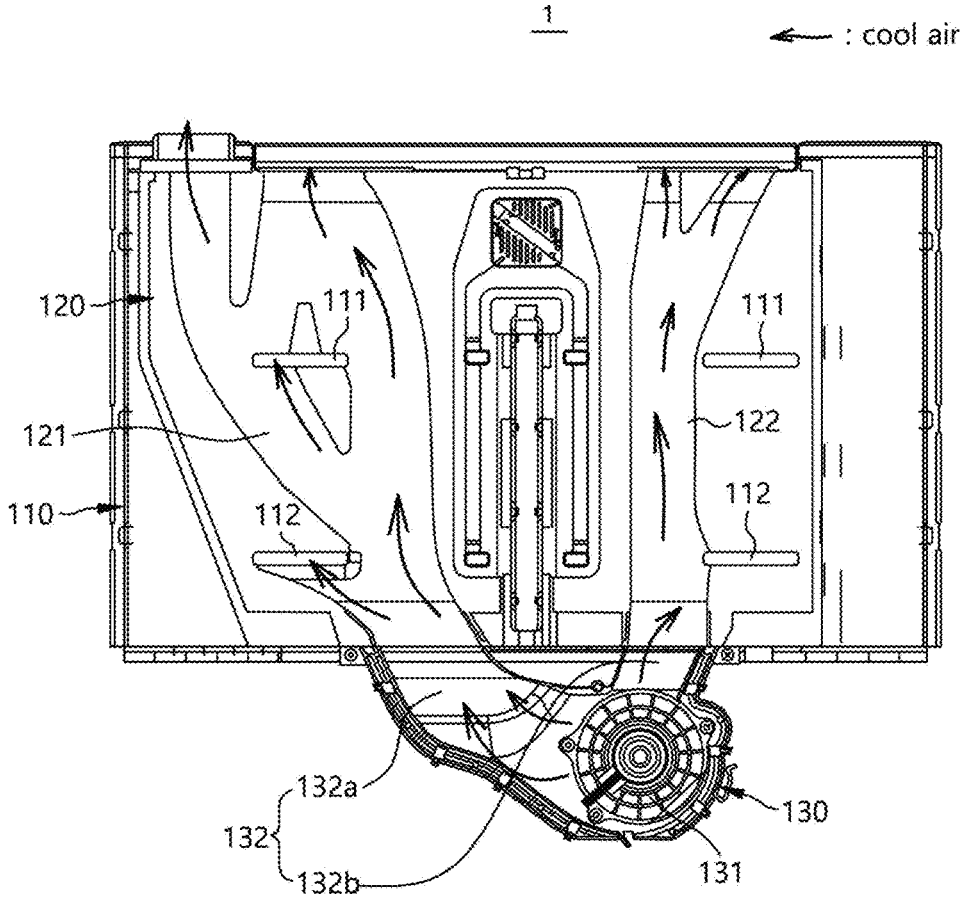
FIG. 34 is a rear view of the refrigerating compartment side grille fan assembly, the view showing a cool air flow during temperature control of the refrigerating compartment of the refrigerator according to the embodiment of the present disclosure.

Furthermore, while the heat exchanged air (cool air) is blown in a circumferential direction of the refrigerating fan 131 after flowing into the fan duct 132 of the refrigerating compartment side grille fan assembly 1, the cool air may be supplied to the first cool air flow path 121 for the refrigerating compartment and the second cool air flow path 122 for the refrigerating compartment of the duct unit 120, as shown in FIG. 34.

Figure 35:
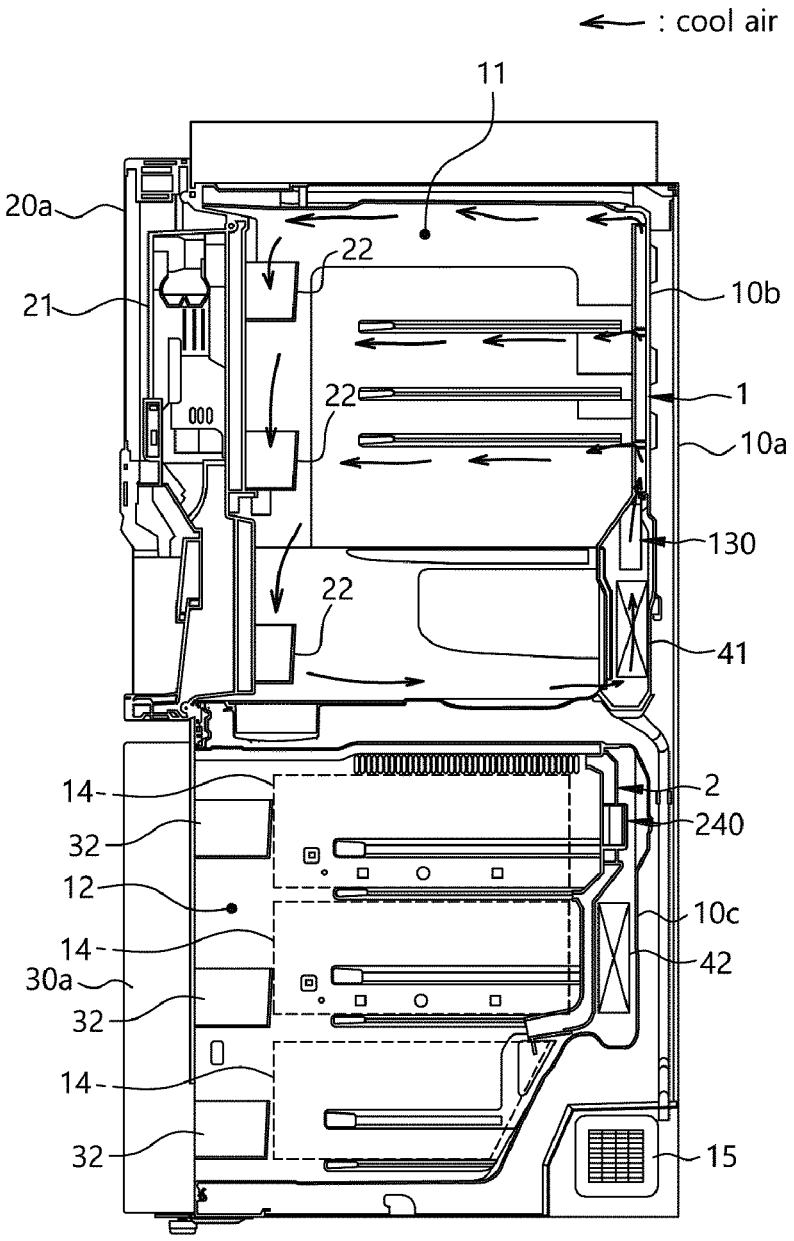
FIG. 35 is a side sectional view showing the cool air flow during the temperature control of the refrigerating compartment of the refrigerator according to the embodiment of the present disclosure.

The cool air supplied to the cool air flow paths 121 and 122 for the refrigerating compartment may flow along the cool air flow paths 121 and 122 and pass through the cool air outlets 111 and 112 located at the cool air flow paths 121 and 122 of the refrigerating compartment side grille panel 110. Then, the cool air may be discharged to the upper and lower sections in the refrigerating compartment 11, as shown in FIG. 35.

In particular, a greater amount of the cool air discharged to the refrigerating compartment 11 may be supplied to the second refrigerating compartment door 20*b* in comparison to the first refrigerating compartment door 20*a* with the ice-making compartment 21. Whereby, unnecessary cool air supply may be prevented and sufficiently supply of cool air to the storage box provided on the inner wall of the second refrigerating compartment door 20*b* may be performed.

Figure 36:
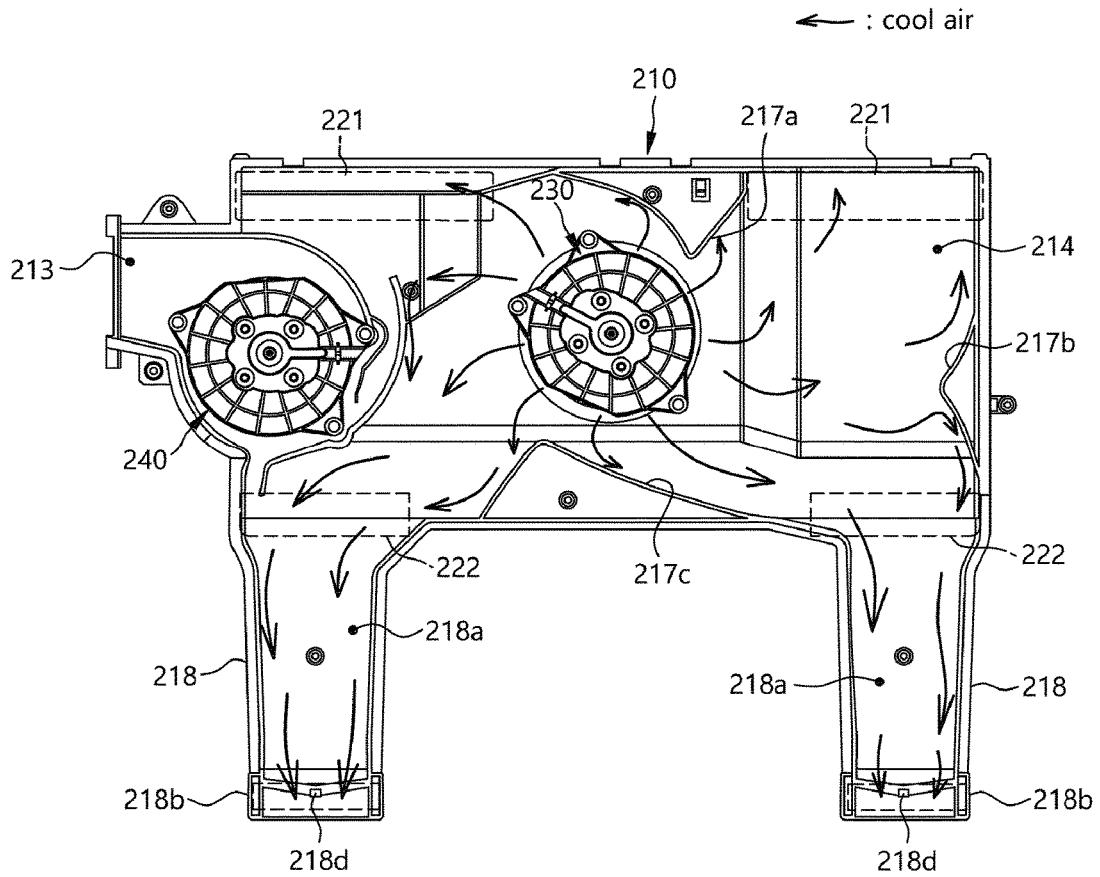
FIG. 36 is a front view of the shroud, the view showing a cool air flow during temperature control of a freezing compartment of the refrigerator according to the embodiment of the present disclosure.
Figure 37:
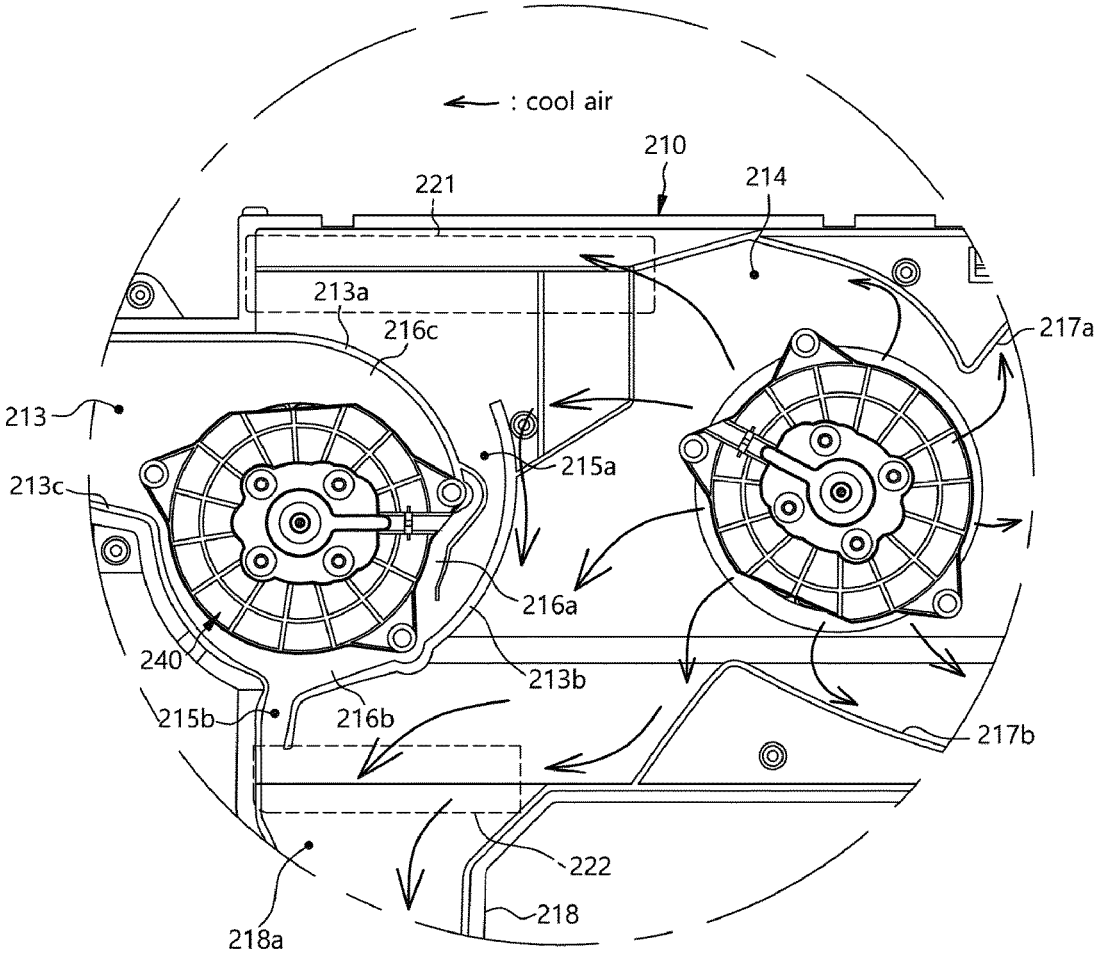
FIG. 37 is an enlarged front view of a main part of the shroud, the view showing the cool air flow during the temperature control of the freezing compartment of the refrigerator according to the embodiment of the present disclosure.
Figure 38:
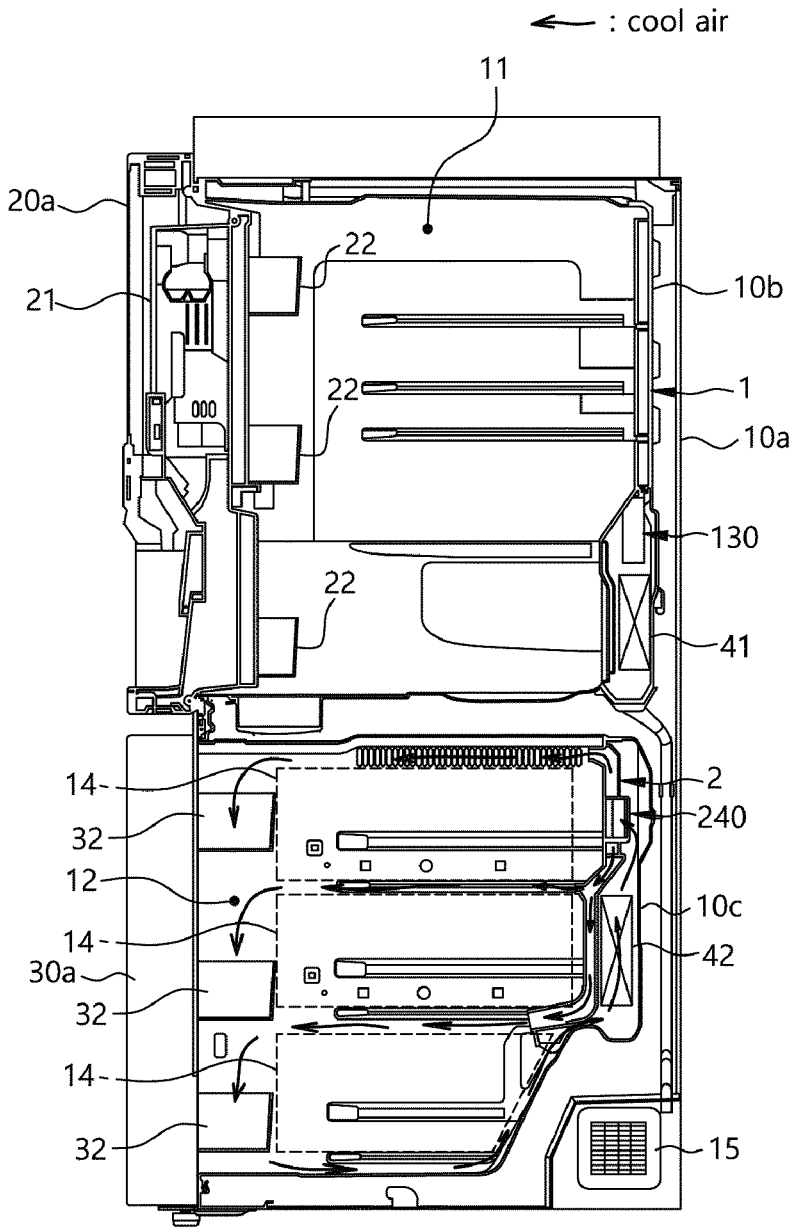
FIG. 38 is a side sectional view showing the cool air flow during the temperature control of the freezing compartment of the refrigerator according to the embodiment of the present disclosure.

The temperature control process of the freezing compartment 12 will be described with reference to FIGS. 36 to 38.

The temperature control of the freezing compartment 12 may be performed by the operations of the freezing fan module 230 and the compressor. That is, operation for controlling the temperature in the freezing compartment 122 may be performed by rotation of the freezing fan 231 due to power supply to the freezing fan module 230 and heat-exchange of the second evaporator 42 due to operation of the compressor.

The temperature control of the freezing compartment 12 may be performed by the operations of the freezing fan module 230 and the compressor. That is, operation for controlling the temperature in the freezing compartment 122 may be performed by rotation of the freezing fan 231 due to power supply to the freezing fan module 230 and heat-exchange of the second evaporator 42 due to operation of the compressor.

Further, the heat exchanged air (cool air) may pass through the first inlet hole 211*a* of the shroud 210 and then flow into the cool air flow path 214 for the freezing compartment.

The cool air flowing into the cool air flow path 214 for the freezing compartment and blown to the upper space therein may flow into the portions where the cool air outlets 221 for the upper section are located in the cool air flow path 214 for the freezing compartment by guidance of the first guide 217*a*. Continuously, the cool air may be discharged to the upper section in the freezing compartment 12 through the two cool air outlets 221 for the upper section.

The cool air blown to a lower side in the cool air flow path 214 for the freezing compartment may flow into the portions where the two cool air outlets 222 for the middle section are located in the cool air flow path 214 for the freezing compartment by guidance of the second guide 217*b*. Then, the cool air may be discharged to the middle section in the freezing compartment 12 through the two cool air outlets 222 for the middle section. In the cool air flowing by the guidance of the second guide 217*b*, while cool air flowing into a portion where any one of the cool air outlets 222 for the middle section is located (the side opposite to the side where the ice-making fan is located) is guided in a vertical direction by the third guide 217*c*, some of the cool air may flow into the cool air outlet 221 for the upper section at the related side, and the rest of the cool air may flow into the cool air outlet 222 for the middle section at the related side.

In addition, the cool air flowing into the two cool air outlets 222 for the middle section by the guidance of the second guide 217*b* and the third guide 217*c* may be partially discharged to the middle section in the freezing compartment 12 through the two cool air outlets 222 for the middle section. The rest of the cool air may flow toward the two cool air outlets 223 for the lower section by guidance of the extension flow path 218*a*, and then, may be discharged to the lower section in the freezing compartment 12 through the two cool air outlets 223 for the lower section.

Therefore, the cool air may be evenly supplied to all the upper, middle, and lower sections of opposite sides in the freezing compartment 12.

In particular, in the cool air supplied to the freezing compartment 12, the cool air discharged through the two cool air outlets 221 for the upper section and the two cool air outlets 222 for the middle section may be guided by the grilles 221*a* and 222*a* formed on the cool air outlets 221 and 222. Whereby, some of the cool air passing through the cool air outlet 221 for the upper section and the cool air outlet 222 for the middle section may be discharged toward a side wall in the freezing compartment 12 by guidance of a part of the grilles 221*a* and 222*a*, and then may flow toward a front space in the freezing compartment 12 along the side wall to be supplied to the stored item stored in the storage box 32 of the freezing compartment door 30*a*, 30*b*.

Furthermore, the cool air supplied into the two freezing compartments 12 by passing through the cool air outlets 221, 222, and 223 may flow in the two freezing compartments 12, and the two suction guides 224*a* and 224*b* formed in the grille panel 220 may guide the cool air to be recovered to the cool air inlet side of the second evaporator 42.

The first suction guide 224*a* of the two suction guides 224*a* and 224*b*, the first suction guide 224*a* being located adjacent to the side communicating with the recovery duct 52 for the ice-making compartment, may be formed to be larger than the second suction guide 224*b* at the opposite side. The second end 52*b* of the recovery duct 52 for the ice-making compartment may be located adjacent to a side portion of the first suction guide 224*a*. Therefore, even when cool air recovered through the recovery duct 52 for the ice-making compartment may be introduced into the freezing compartment 12, the cool air is directly discharged through the first suction guide 224*a*, so that temperature change in the freezing compartment 12 may be minimized.

Meanwhile, during the temperature control of the freezing compartment 12, the ice-making fan 241 may also be operated.

That is, in the case of the ice-making operation, the ice-making fan 241 may be set to be always operated except for under special conditions (e.g., when ice is in full in the ice-making compartment). Considering the above configuration, the ice-making operation may be continuously performed during the freezing operation.

However, when the ice-making operation is also performed during the freezing operation, the flow of cool air flowing through the second inlet hole 211*b* and the cool air flow path 213 for the ice-making compartment in order may be generated by the operation of the ice-making fan 241.

In particular, some of the cool air generated by the operation of the ice-making fan 241 may be supplied into the cool air flow path 214 for the freezing compartment through the upper shared flow path 215*a*. The rest of the cool air may be supplied into the ice-making compartment 21 through the cool air duct 51 for the ice-making compartment connected to the cool air flow path 213 for the ice-making compartment.

In particular, some of the cool air generated by the operation of the ice-making fan 241 may be supplied into the cool air flow path 214 for the freezing compartment through the upper shared flow path 215*a*. The rest of the cool air may be supplied into the ice-making compartment 21 through the cool air duct 51 for the ice-making compartment connected to the cool air flow path 213 for the ice-making compartment.

Figure 39:
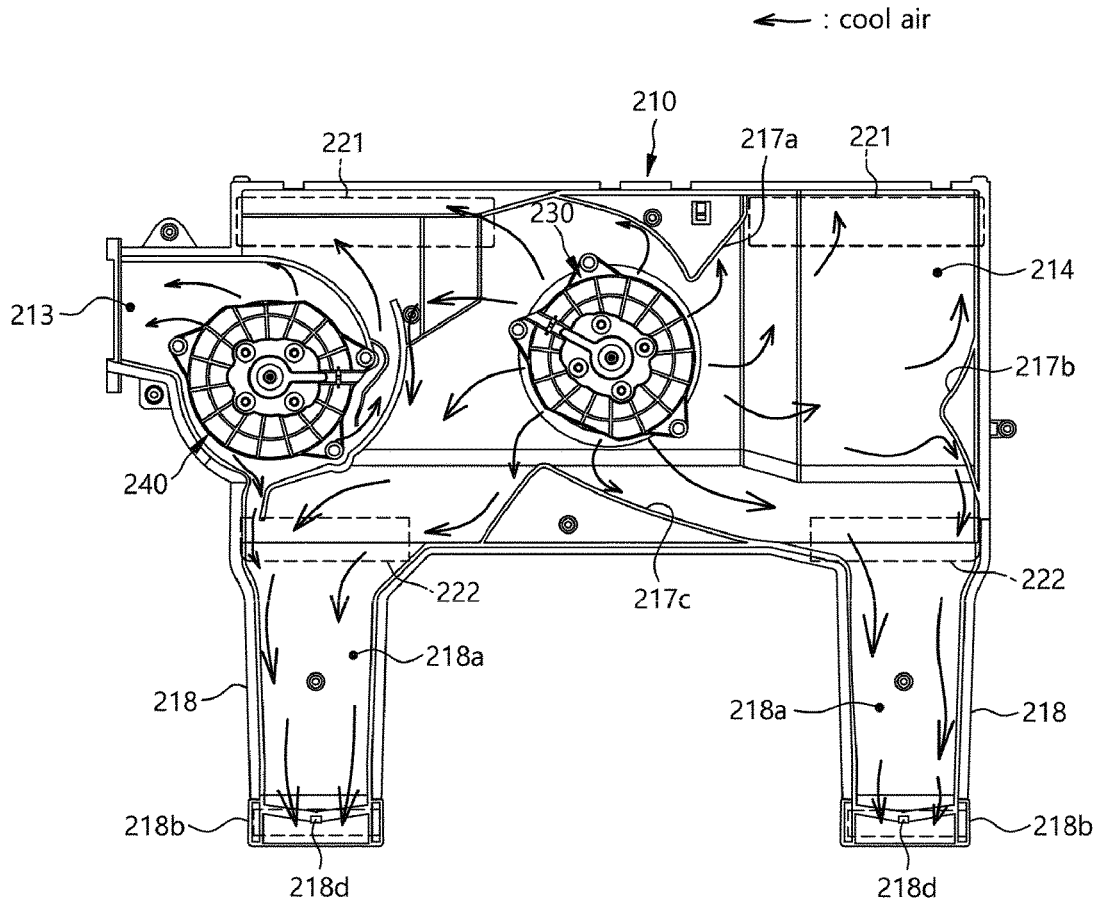
FIG. 39 is a front view of the shroud, the view showing a cool air flow when the freezing compartment and the ice-making compartment are simultaneously operated in the refrigerator according to the embodiment of the present disclosure.
Figure 40:
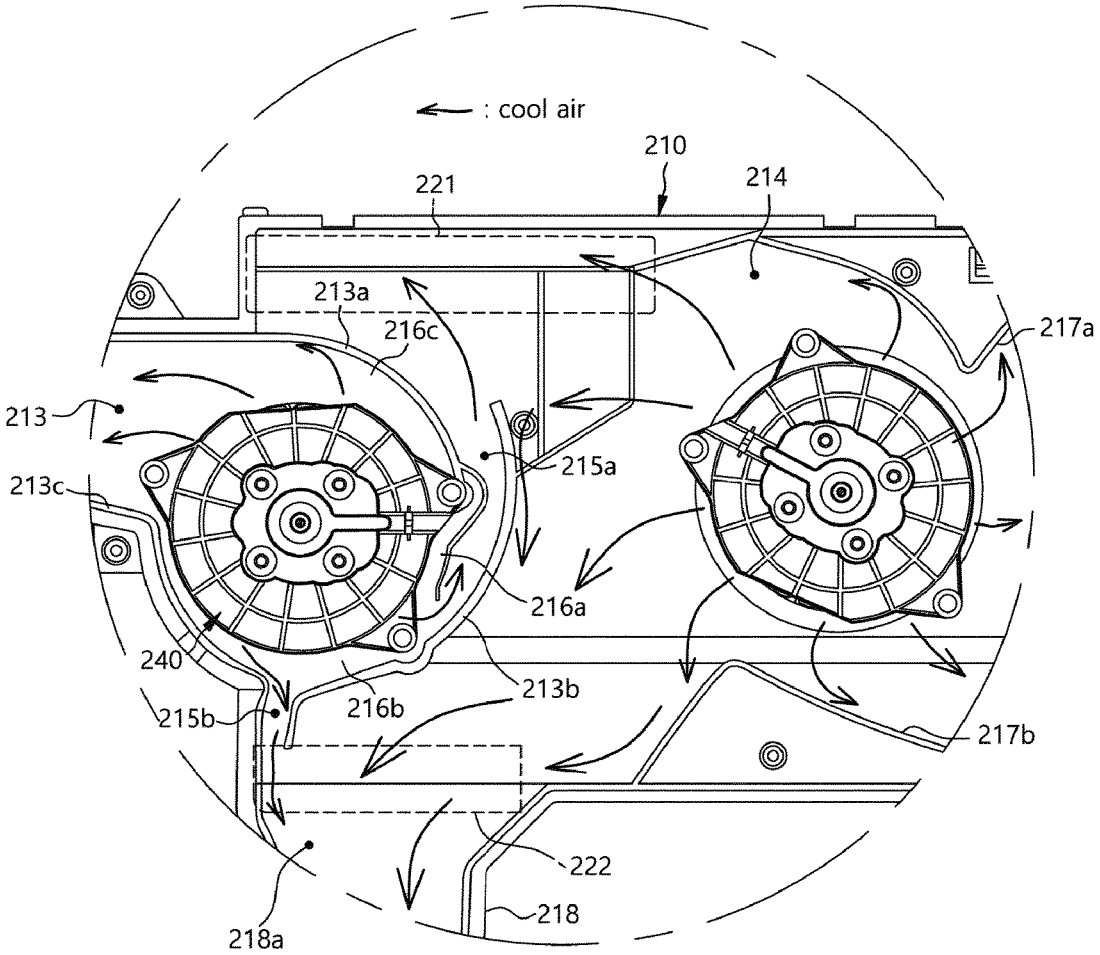
FIG. 40 is an enlarged front view of a main part of the shroud, the view showing the cool air flow when the freezing compartment and the ice-making compartment are simultaneously operated in the refrigerator according to the embodiment of the present disclosure.

Therefore, not only the cool air blown by the operation of the freezing fan 231 but also the cool air blown by the operation of the ice-making fan 241 may be supplied into the freezing compartment 12, so that sufficient cool air supply may be performed in the freezing compartment 12, as shown in FIGS. 39 and 40.

In particular, the cool air supplied through the upper shared flow path 215*a* may be provided to the upper section of the space with the recovery duct 52 for the ice-making compartment in the opposite spaces in the freezing compartment 12. The cool air supplied through the lower shared flow path 215*b* may be provided to the lower section of the space with the recovery duct 52 for the ice-making compartment. Considering the above flows, the space with the recovery duct 52 for the ice-making compartment may receive a greater amount of cool air than another space opposite to the space. Accordingly, even when the recovery duct 52 for the ice-making compartment is connected to one of the opposite spaces in the freezing compartment 12, the opposite spaces in the freezing compartment 12 may be maintained within the same (or similar) temperature range.

The operation of the temperature control (ice-making operation) of the ice-making compartment 21 will be described with reference to FIGS. 41 to 44.

The temperature control of the ice-making compartment 21 may be performed by the operation of the ice-making fan 241 due to power supply to the ice-making fan module 240. At this time, the compressor may be operated or stopped in response to the operating conditions of the freezing compartment 12.

Figure 41:
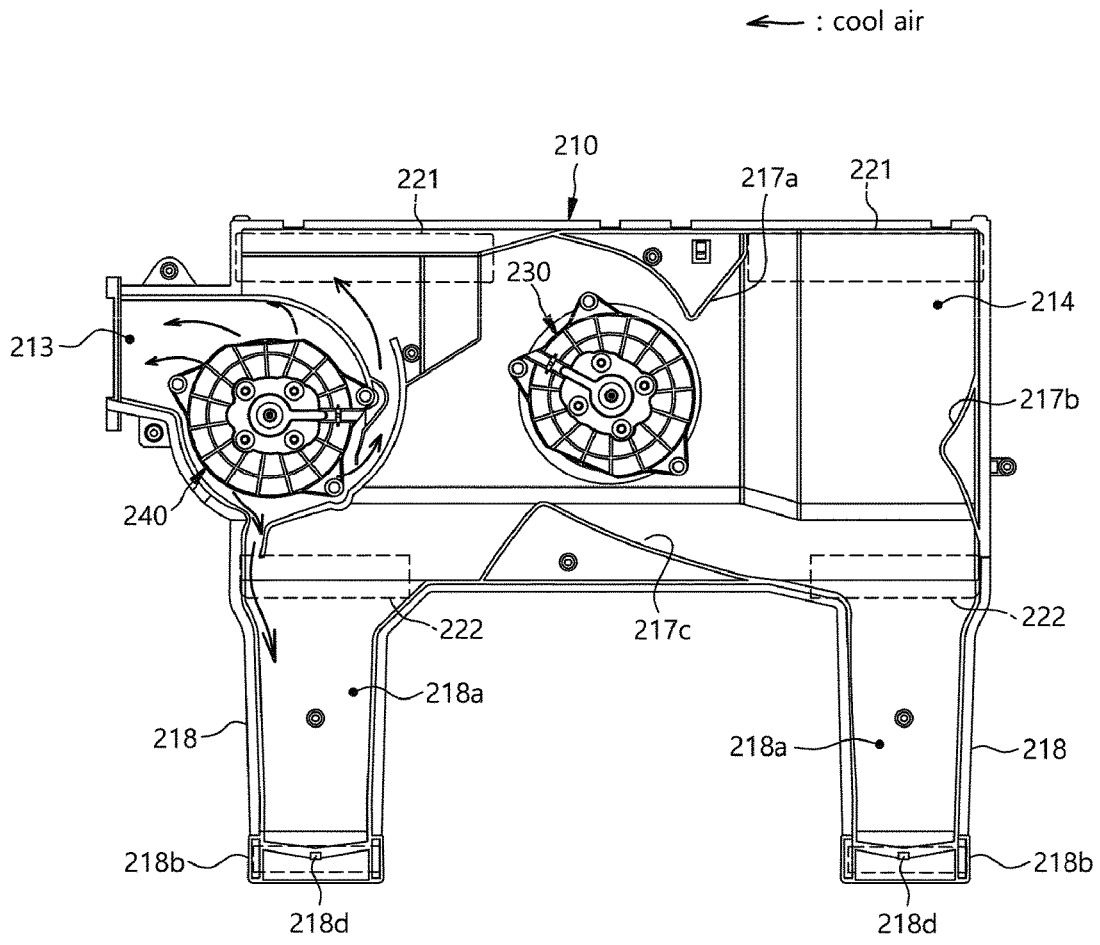
FIG. 41 is a front view of the shroud, the view showing a cool air flow during temperature control of the ice-making compartment of the refrigerator according to the embodiment of the present disclosure.
Figure 42:
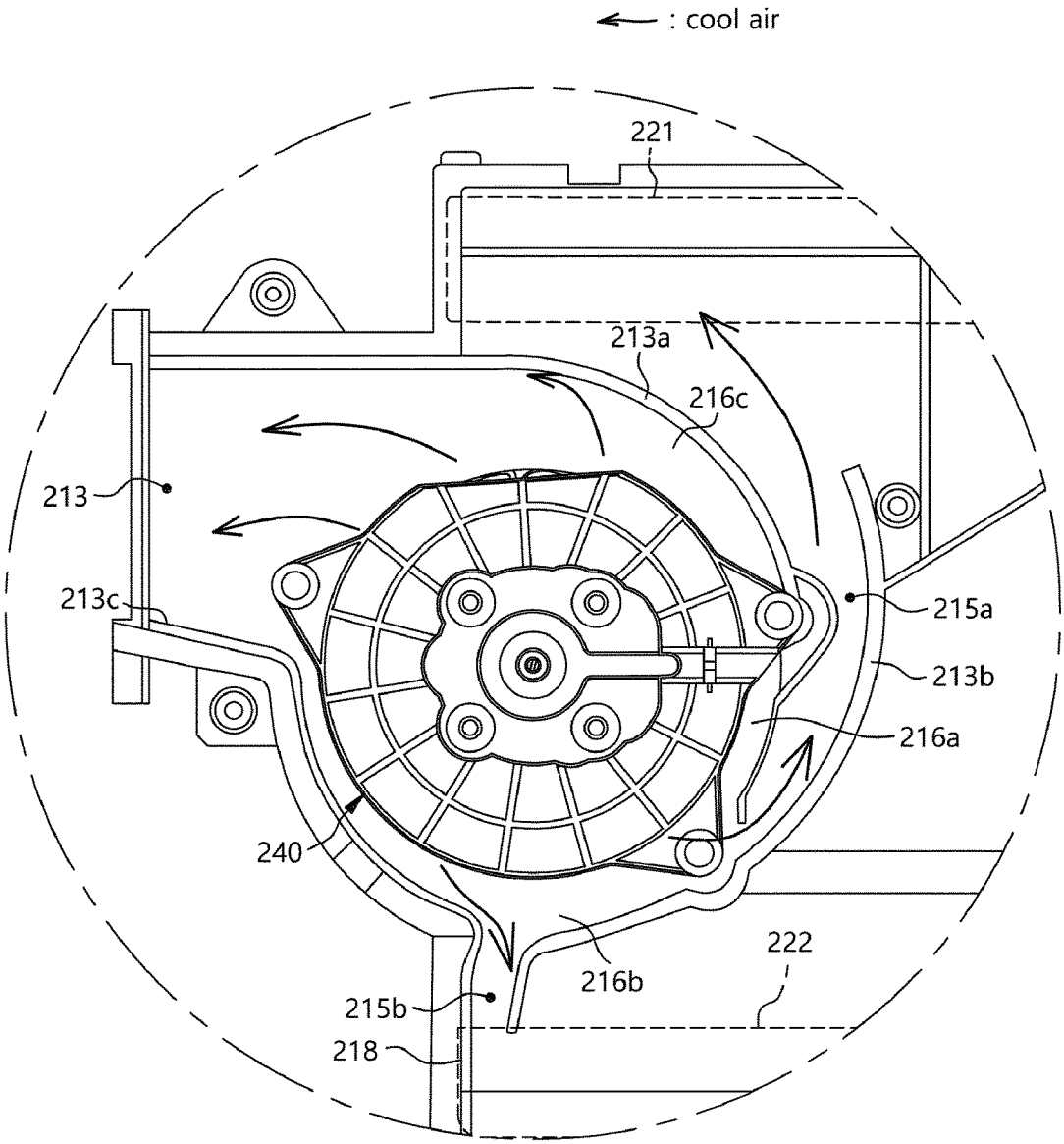
FIG. 42 is an enlarged front view of a main-part of the shroud, the view showing the temperature control of the ice-making compartment of the refrigerator according to the embodiment of the present disclosure.

When the ice-making fan 241 is operated, air in the freezing compartment 12 may pass through the second evaporator 42 and pass through the second inlet hole 211*b* of the shroud 210 by the air blowing force of the ice-making fan 241, and then flows into the first area 216*a*, the second area 216*b*, and the third area 216*c* of the cool air flow path 213 for the ice-making compartment. Continuously, the air is discharged from the cool air flow path 213 for the ice-making compartment through the communication portions with the areas 216*a*, 216*b*, and 216*c*. The above operation is as shown in FIGS. 41 and 42.

The cool air flowing into the first area 216*a* by the operation of the ice-making fan 241 passes through the upper shared flow path 215*a* to be supplied to the upper surface side of the cool air flow path 214 for the freezing compartment. The cool air blown to the second area 216*b* passes through the lower shared flow path 215*b* to be supplied to the extension flow path 218*a*. The cool air blown to the third area 216*c* passes through the cool air duct 51 for the ice-making compartment to be supplied to the ice-making compartment 21.

Figure 43:
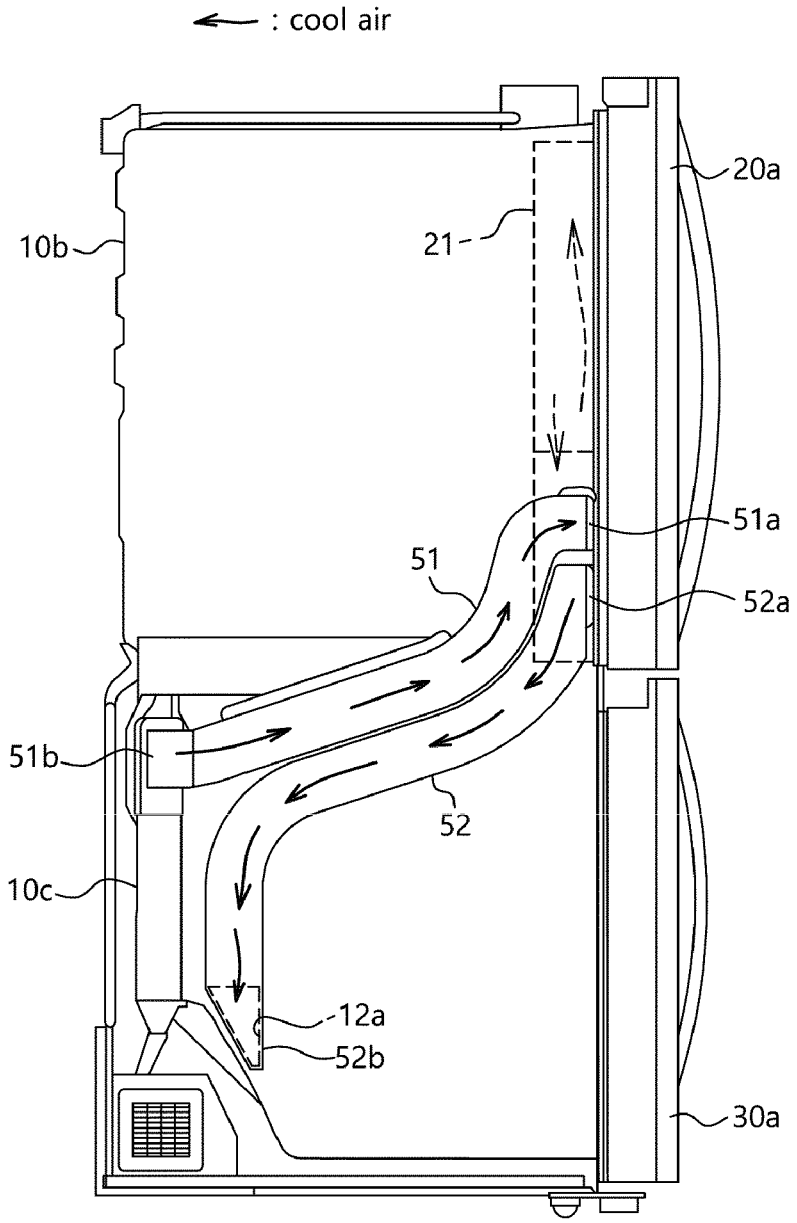
FIG. 43 is a side view showing a cool air flow during the temperature control of the ice-making compartment of the refrigerator according to the embodiment of the present disclosure.
Figure 44:
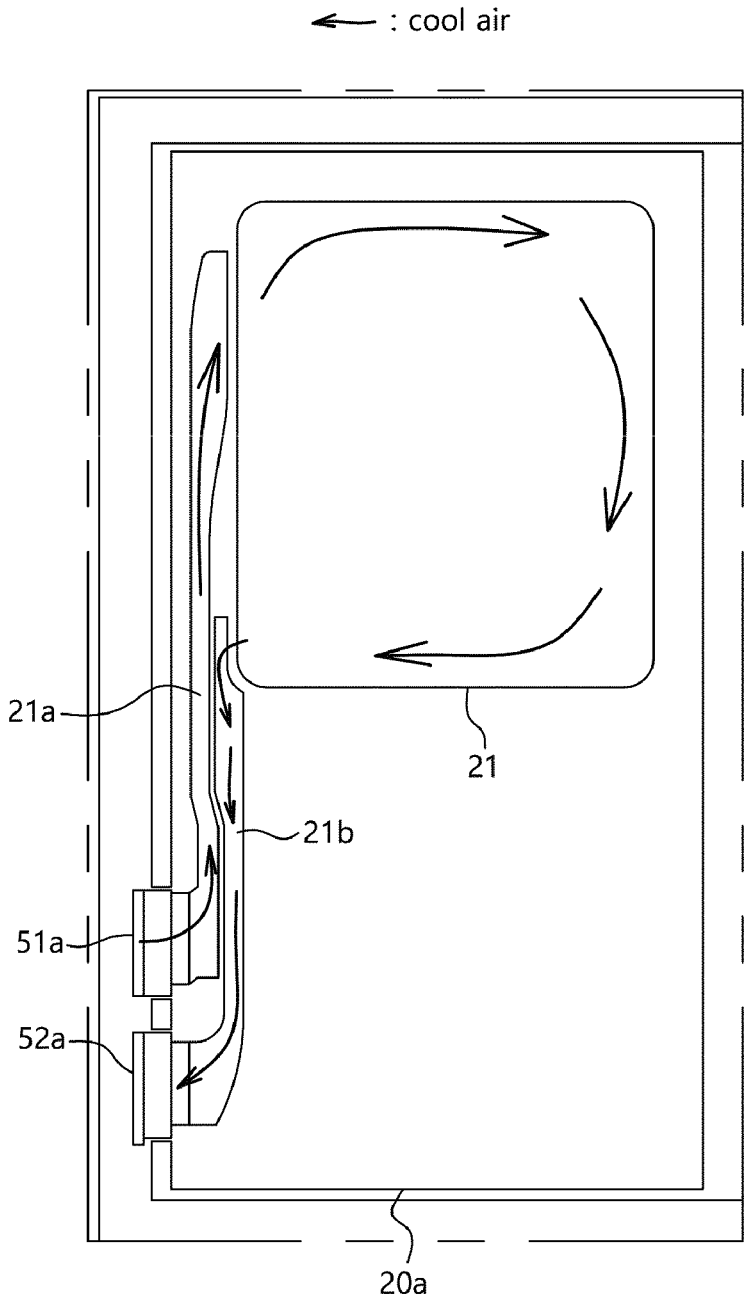
FIG. 44 is a view schematically showing a cool air flow in the ice-making compartment during the temperature control of the ice-making compartment of the refrigerator according to the embodiment of the present disclosure.

In addition, the cool air passing through the upper shared flow path 215*a* and supplied to the cool air flow path 214 for the freezing compartment is supplied to the freezing compartment 12 through the cool air outlet 221 for the upper section while being blown toward the cool air outlet 221 for the upper section in the cool air flow path 214 for the freezing compartment. The cool air passing through the lower shared flow path 215*b* and supplied to the cool air flow path 214 for the freezing compartment is supplied to the freezing compartment 12 through the cool air outlet 223 for the lower section while flowing along the side wall surface of the extension flow path 218*a*. The above flows are as shown in FIGS. 43 and 44.

In addition, the cool air passing through the upper shared flow path 215*a* and supplied to the cool air flow path 214 for the freezing compartment may be supplied to the freezing compartment 12 through the cool air outlet 221 for the upper section while being blown toward the cool air outlet 221 for the upper section in the cool air flow path 214 for the freezing compartment. The cool air passing through the lower shared flow path 215*b* and supplied to the cool air flow path 214 for the freezing compartment may be supplied to the freezing compartment 12 through the cool air outlet 223 for the lower section while flowing along the side wall surface of the extension flow path 218*a*. The above flows are as shown in FIGS. 43 and 44.

Accordingly, the inside of the freezing compartment 12 may maintain a pressure state similar to a pressure state of the cool air flow path 213 for the ice-making compartment by the cool air supplied through the upper shared flow path 215*a* and the lower shared flow path 215*b*. That is, since the pressures of the freezing compartment 12 and the ice-making compartment 21 are roughly balanced, even when only the ice-making fan 241 is operated for the ice-making operation, the cool air in the freezing compartment 12 may be prevented from (or, be minimized) passing through the cool air flow path 214 for the freezing compartment and the first inlet hole 211*a* in reverse and flowing into the second inlet hole 211*b* and the cool air flow path 213 for the ice-making compartment.

Meanwhile, when the cool air heat-exchanged while passing through the second evaporator 42 passes through the second inlet hole 211*b* and is discharged in the radial direction of the ice-making fan 241, the cool air may pass through the second inlet hole 211*b* in reverse due to the flow resistance.

However, the second inlet hole 211*b* may be configured to cover each impeller 241*c* of the ice-making fan 241 (or, to cover at least half of each impeller), so that the cool air blown from the ice-making fan 241 is prevented from flowing back such that the cool air is discharged through the second inlet hole 211*b*. Furthermore, the cool air may be blown to the cool air flow path 213 for the ice-making compartment with a blowing pressure higher than a blowing pressure of the cool air passing through the first inlet hole 211*a* and blown along the cool air flow path 214 for the freezing compartment.

By the high blowing pressure, the cool air may be efficiently supplied to the ice-making compartment 21 through the cool air duct 51 for the ice-making compartment connected to the cool air flow path 213 for the ice-making compartment.

In addition, the cool air discharged to the third area 216*c* may flow toward the second area 216*b* located in the rotating direction of the ice-making fan 241. However, considering that the third area 216*c* and the second area 216*b* are partitioned from each other by the ice-making fan module 240, the entire cool air discharged to the third area 216*c* may flow toward the cool air outlet side of the cool air flow path 213 for the ice-making compartment by the guidance of the cool air flow path 213 for the ice-making compartment.

Accordingly, the amount of the cool air supplied to the ice-making compartment 21 is less than the amount of the cool air supplied to the freezing compartment 12, but the cool air may be efficiently forced-supplied to the ice-making compartment 21 by the high blowing pressure.

Furthermore, the cool air supplied to the ice-making compartment 21 freezes water (or other beverages) in an ice tray while flowing in the ice-making compartment 21.

The cool air flowing in the ice-making compartment 21 may flow into the recovery duct 52 for the ice-making compartment. Continuously, the cool air may be recovered to the freezing compartment 12 while being guided by the recovery duct 52 for the ice-making compartment.

Then, the cool air recovered to the freezing compartment 12 may be directly suctioned into the first suction guide 224*a* located to face the recovery duct 52 for the ice-making compartment and be recovered to the cool air inlet side of the second evaporator 42.

Accordingly, the temperature in the ice-making compartment 21 may be controlled as the above-described circulation of air (cool air) is repeatedly performed.

As described above, the refrigerator of the present disclosure is configured to reduce the amount of cool air discharged to the first refrigerating compartment door 20*a* to supply the rest of cool air to another portion in the refrigerator. Accordingly, the storage box provided in the second refrigerating compartment door 20*b* may also receive sufficient cool air.

The refrigerator of the present disclosure is configured to supply a greater amount of cool air to the space communicating with the recovery duct 52 for the ice-making compartment of the opposite spaces in the freezing compartment 12 than the amount of cool air supplied to the other space. Accordingly, temperature difference for each portion in the freezing compartment 12 may be minimized.

In particular, even when cool air passing through the ice-making compartment 21 provided in the first refrigerating compartment door 20*a* is recovered to the freezing compartment 12, temperature change in the freezing compartment 12 may be minimized.

The refrigerator of the present disclosure is configured to allow the cool air flow path 213 for the ice-making compartment and the cool air flow path 214 for the freezing compartment to partially share cool air with each other. By the structure, when the ice-making fan 241 and the freezing fan 231 are operated simultaneously, some of cool air supplied through the cool air flow path 213 for the ice-making compartment may be supplied to the freezing compartment 12 through the cool air flow path 214 for the freezing compartment. Accordingly, the supply amount of cool air supplied to the freezing compartment 12 may be increased, and in particular, even when only the ice-making fan 241 is operated, cool air in the freezing compartment 12 may be prevented from flowing back into the cool air flow path 213 for the ice-making compartment.

The refrigerator of the present disclosure is configured such that the upper shared flow path 215*a* and the lower shared flow path 215*b* supply cool air to the cool air outlets 221 and 223 for the upper and lower sections located at any one side of the cool air flow path 214 for the freezing compartment. Accordingly, a greater amount of cool air may be supplied to the side communicating with the recovery duct 52 for the ice-making compartment of the opposite spaces in the freezing compartment 12, thereby allowing the opposite spaces in the freezing compartment 12 to be maintained in a predetermined temperature.

The refrigerator of the present disclosure is configured to efficiently discharge condensed water to the outside of the freezing compartment side grille fan assembly 2 even when the condensed water is generated in the portion with the ice-making fan module 240, so that the ice-making fan module 240 may be prevented from freezing.

The invention claimed is:

1. A refrigerator comprising:

a cabinet that defines a refrigerating compartment and a freezing compartment disposed below the refrigerating compartment, the freezing compartment having an upper section and a lower section disposed below the upper section;

a refrigerating compartment door comprising an ice-making compartment;

a plurality of freezing compartment doors;

a recovery duct that is fluidly connected to the ice-making compartment and extends along one of a plurality of side walls of the cabinet, the recovery duct having a first end that is in fluid communication with a first space defined at a first side of the freezing compartment and configured to guide air from the ice-making compartment toward the freezing compartment;

a first evaporator configured to exchange heat with air to be supplied to the refrigerating compartment;

a refrigerating compartment side grille fan assembly that is disposed at the refrigerating compartment and configured to supply the air heat-exchanged with the first evaporator to the refrigerating compartment;

a second evaporator configured to exchange heat with air to be supplied to the freezing compartment and the ice-making compartment;

a freezing compartment side grille fan assembly that is disposed at the freezing compartment and configured to supply the air heat-exchanged with the second evaporator to the freezing compartment and the ice-making compartment; and a freezing compartment side grille panel that faces the freezing compartment and that defines a suction guide at a lower end of the freezing compartment side grille panel, the suction guide being inclined forward toward the freezing compartment and configured to receive air from the freezing compartment and to provide the air toward an inlet side of the second evaporator, and wherein the recovery duct extends along a side wall of the freezing compartment to a position below a lower end of the second evaporator, the recovery duct having a second end that is located at a side of the suction guide and positioned forward relative to a front side of the second evaporator.

2. The refrigerator of claim 1, further comprising a partition wall that is disposed in the freezing compartment and divides the freezing compartment into left and right spaces, and wherein the partition wall crosses a center region of the freezing compartment side grille fan assembly.

3. The refrigerator of claim 1, further comprising:

a cool air duct that is fluidly connected to the ice-making compartment and disposed at one of the side walls of the cabinet, the cool air duct being configured to guide air blown by the freezing compartment side grille fan assembly to the ice-making compartment.

4. The refrigerator of claim 3, wherein the cool air duct has:

a first end that passes through one of a plurality of side walls of the refrigerating compartment and is exposed to the refrigerating compartment; and a second end that is connected to a side surface of the freezing compartment side grille fan assembly and configured to receive the air blown by the freezing compartment side grille fan assembly.

5. The refrigerator of claim 4, further comprising:

a supply guide duct disposed at the refrigerating compartment door and configured to, based on the refrigerating compartment door being closed, connect to the second end of the cool air duct and receive air from the cool air duct.

6. The refrigerator of claim 1, wherein the freezing compartment side grille fan assembly further comprises:

a shroud that defines a rear wall surface of the freezing compartment side grille fan assembly, wherein at least one of the freezing compartment side grille panel and the shroud has an inner surface defining:

a first cool air flow path disposed between the freezing compartment side grille panel and the shroud and configured to guide air blown by a freezing fan to the upper and lower sections of the freezing compartment, and a second cool air flow path disposed between the freezing compartment side grille panel and the shroud and configured to guide air blown by an ice-making fan.

7. The refrigerator of claim 6, wherein the freezing compartment side grille fan assembly further comprises a flow path rib that separates the first cool air flow path and the second cool air flow path from each other, and wherein the flow path rib defines an upper shared flow path that is configured to, based on operation of the ice-making compartment, supply a part of the air in the second cool air flow path to an upper space of the first cool air flow path.

8. The refrigerator of claim 7, wherein the flow path rib further defines a lower shared flow path that is configured to, based on operation of the ice-making compartment, supply a part of the air in the second cool air flow path to a lower space of the first cool air flow path.

9. The refrigerator of claim 6, wherein the freezing compartment side grille fan assembly further comprises a flow path rib that separates the first cool air flow path and the second cool air flow path from each other, and wherein the flow path rib defines a lower shared flow path that is configured to, based on operation of an ice-making fan, supply a part of cool air in the second cool air flow path to a lower space of the first cool air flow path.

10. The refrigerator of claim 9, wherein the freezing compartment side grille fan assembly defines a drainage hole at the first cool air flow path, the drainage hole being configured to discharge condensed water introduced into the first cool air flow path through the lower shared flow path.

11. The refrigerator of claim 1, further comprising:

a recovery guide duct disposed at the refrigerating compartment door and configured to, based on the refrigerating compartment door being closed, connect to the second end of the recovery duct and provide air to the recovery duct.

12. The refrigerator of claim 1, wherein the second end of the recovery duct passes through a hole defined at the side wall of the freezing compartment, and wherein a height of the hole is greater than a transverse width of the hole.

13. The refrigerator of claim 1, wherein the second end of the recovery duct has an opening that extends downward along the side wall of the freezing compartment, and wherein a front-rear width of the opening decreases as the opening extends downward.

14. The refrigerator of claim 1, further comprising another refrigerating compartment door that does not include the ice-making compartment, wherein the refrigerating compartment has:

a first space facing the another refrigerating compartment door that does not include the ice-making compartment; and a second space facing the refrigerating compartment door that includes the ice-making compartment, wherein the refrigerating compartment side grille fan assembly is configured to supply a first amount of air to the first space of the refrigerating compartment and to supply a second amount of air to the second space of the refrigerating compartment, and wherein the first amount of air supplied to the first space of the refrigerating compartment is greater than the second amount of air supplied to the second space of the refrigerating compartment.

15. The refrigerator of claim 1, wherein the side wall of the freezing compartment defines a penetration hole that receives the second end of the recovery duct, and wherein an edge of the penetration hole is parallel to the side of the suction guide.

16. The refrigerator of claim 1, wherein an edge of the second end of the recovery duct is inclined along the suction guide.

* * * * *